US007818113B2

(12) United States Patent
Kajiwara et al.

(10) Patent No.: US 7,818,113 B2
(45) Date of Patent: Oct. 19, 2010

(54) VALVE TIMING CONTROL APPARATUS AND VALVE TIMING CONTROL ARRANGEMENT

(75) Inventors: Yasuhiro Kajiwara, Kariya (JP); Minoru Wada, Obu (JP)

(73) Assignee: Denso Corporation, Kariya (JP)

( * ) Notice: Subject to any disclaimer, the term of this patent is extended or adjusted under 35 U.S.C. 154(b) by 51 days.

(21) Appl. No.: 12/424,066

(22) Filed: Apr. 15, 2009

(65) Prior Publication Data

US 2009/0265083 A1 Oct. 22, 2009

(30) Foreign Application Priority Data

Apr. 17, 2008 (JP) ..... 2008-108085
Jul. 18, 2008 (JP) ..... 2008-187312
Jul. 24, 2008 (JP) ..... 2008-190468
Jul. 25, 2008 (JP) ..... 2008-192851

(51) Int. Cl.
*F02D 41/30* (2006.01)
*F01L 1/34* (2006.01)

(52) U.S. Cl. ..... 701/105; 123/90.17

(58) Field of Classification Search ..... 701/101–103, 701/105, 106, 110, 114, 115; 123/90.15–90.17, 123/339.18, 339.29, 347, 348, 673, 674, 123/90.27, 90.31; 464/1, 2, 160
See application file for complete search history.

(56) References Cited

U.S. PATENT DOCUMENTS 5,211,257 A * 5/1993 Shuzo et al. ..... 192/58.92
5,333,577 A * 8/1994 Shinojima ..... 123/90.15
5,351,663 A * 10/1994 Makimura et al. ..... 123/90.27
5,363,817 A * 11/1994 Ikeda et al. ..... 123/90.15
5,562,071 A * 10/1996 Urushihata et al. ..... 123/90.15
6,431,131 B1 8/2002 Hosoya et al.
6,532,921 B2 * 3/2003 Sato et al. ..... 123/90.17
6,647,935 B2 * 11/2003 Aoyama et al. ..... 123/90.16

(Continued)

FOREIGN PATENT DOCUMENTS

JP 2000-230437 8/2000

(Continued)

OTHER PUBLICATIONS

U.S. Appl. No. 12/169,203, Yasuhiro Shikata et al., filed Jul. 8, 2008, (JP 2007-185198).

*Primary Examiner*—Stephen K Cronin
*Assistant Examiner*—Johnny H Hoang
(74) *Attorney, Agent, or Firm*—Nixon & Vanderhye PC

(57) ABSTRACT

A valve timing control apparatus for a valve timing adjustment mechanism that adjusts timing of opening and closing an intake or exhaust valve of an engine includes an output-side rotor, a cam-side rotor, a hydraulic pump, a control device, a control valve, a storage device. The control device outputs a signal associated with rotation of one of the rotors relative to the other one. The control valve controls the speed of the rotation. The storage device prestores standard data indicating a predetermined relation between a dead zone width and a parameter correlated with the dead zone width for each hydraulic oil temperature. A value of the parameter of the adjustment mechanism during a hold state is learned by changing the signal. The control device computes the signal based on the value learned, the standard data, and hydraulic oil temperature.

29 Claims, 24 Drawing Sheets

U.S. PATENT DOCUMENTS

| | | | | |
|---|---|---|---|---|
| 6,739,298 | B2 * | 5/2004 | Kusano et al. | 123/90.17 |
| 6,925,977 | B2 * | 8/2005 | Hirowatari et al. | 123/90.17 |
| 6,968,817 | B2 * | 11/2005 | Hirowatari et al. | 123/90.17 |
| 7,150,251 | B2 * | 12/2006 | Watanabe et al. | 123/90.17 |
| 7,451,730 | B2 * | 11/2008 | Nguyen et al. | 123/90.17 |
| 2003/0000489 | A1 | 1/2003 | Majima et al. | |
| 2003/0164149 | A1 | 9/2003 | Kondou et al. | |
| 2006/0060160 | A1 * | 3/2006 | Nakayama | 123/90.17 |

FOREIGN PATENT DOCUMENTS

| | | |
|---|---|---|
| JP | 2000-257454 | 9/2000 |
| JP | 2004-251254 | 9/2004 |
| JP | 2007-224744 | 9/2007 |

* cited by examiner

UPPER-LIMIT PRODUCT
ACTUAL-USE PRODUCT

INTEGRATED DUTY
50
25
0

DUTY VALUE D (%)
60
55
50
45
D0'
D0''

PHASE (°CA)
ADVANCE
RETARD
TARGET PHASE (TEST PATTERN)
ACTUAL PHASE
ACTUAL PHASE
8.0
8.2
8.4
8.6
8.8
9.0
9.2
9.4
9.6
9.8
10.0
TIME (sec)

DEAD ZONE WIDTH BASE MAP

| OIL TEMPERATURE (°C) | | -30 | -25 | ··· | 75 | 80 |
|---|---|---|---|---|---|---|
| DEAD ZONE WIDTH e10 | ADVANCE | 10.0 | 9.0 | ··· | 1.5 | 1.0 |
| | RETARD | 9.0 | 8.2 | ··· | 1.4 | 1.2 |
| INTEGRATED DUTY d10 | ADVANCE | 5.0 | 4.5 | ··· | 0.8 | 0.5 |
| | RETARD | 4.5 | 2.3 | ··· | 0.7 | 0.6 |

LOWER-LIMIT PRODUCT
UPPER-LIMIT PRODUCT
ACTUAL-USE PRODUCT
TARGET VALUE
VALVE TIMING (°CA)
ADVANCE
RETARD
CONTROL DUTY (%)
60
55
50
45
INTEGRATED DUTY
50
25
0
TIME (sec)

FIG. 17

DEAD ZONE WIDTH BASE VALUE MAP

| OIL TEMPERATURE (°C) (COOLANT TEMPERATURE) | | -30 | -25 | ··· | 75 | 80 |
|---|---|---|---|---|---|---|
| DEAD ZONE WIDTH | ADVANCE | F1 | F2 | ··· | F3 | F4 |
| | RETARD | F1' | F2' | ··· | F3' | F4' |
| INTEGRATED DUTY | ADVANCE | G1 | G2 | ··· | G3 | G4 |
| | RETARD | G1' | G2' | ··· | G3' | G4' |

$$\left(\begin{array}{c} F1>F2>\cdots>F3>F4 \\ F1'>F2'>\cdots>F3'>F4' \\ G1>G2>\cdots>G3>G4 \\ G1'>G2'>\cdots>G3'>G4' \end{array}\right)$$

FIG. 18

LEARNING CORRECTION COEFFICIENT MAP

| RATIO OF INTEGRATED DUTY a2/a1 | 1.0 | ····· | ····· | ····· | 10 |
|---|---|---|---|---|---|
| LEARNING CORRECTION COEFFICIENT (ADVANCE) | K1 | K2 | K3 | K4 | K5 |
| LEARNING CORRECTION COEFFICIENT (RETARD) | K1' | K2' | K3' | K4' | K5' |

$$\left(\begin{array}{c} K1<K2<K3<K4<K5 \\ K1'<K2'<K3'<K4'<K5' \end{array}\right)$$

FORCIBLE CHANGE WIDTH MAP

| OIL TEMPERATURE (°C) (COOLANT TEMPERATURE) | | -30 | -25 | ··· | 75 | 80 |
|---|---|---|---|---|---|---|
| TARGET VALUE FORCIBLE CHANGE WIDTH (°CA) | ADVANCE | H1 | H2 | ··· | H3 | H4 |
| | RETARD | H1' | H2' | ··· | H3' | H4' |

$$\left(\begin{array}{c} H1>H2>\cdots>H3>H4 \\ H1'>H2'>\cdots>H3'>H4' \end{array}\right)$$

HOLD DUTY CORRECTION AMOUNT MAP

| OIL TEMPERATURE (degC) (COOLANT TEMPERATURE) | -30 | ..... | ..... | ..... | 80 |
|---|---|---|---|---|---|
| CORRECTION AMOUNT (%) | A1 | A2 | A3 | A4 | A5 |

( A1>A2>A3>A4>A5 )

A1, A2, A3: PREDETERMINED VALUES OF CORRECTION AMOUNT
B: DIFFERENCE BETWEEN LEARNED VALUE L AND STANDARD VALUE C = L - C

HOLD DUTY STANDARD VALUE MAP

| OIL TEMPERATURE (degC) (COOLANT TEMPERATURE) | -30 | ..... | ..... | ..... | 80 |
|---|---|---|---|---|---|
| HOLD DUTY STANDARD VALUE (%) | C1 | C2 | C3 | C4 | C5 |

( C1>C2>C3>C4>C5 )

C1, C2, ..., C5: PREDETERMINED VALUES OF STANDARD VALUE
B: DIFFERENCE BETWEEN LEARNED VALUE L AND STANDARD VALUE C5 = L - C5

HOLD DUTY STEADY-STATE DEVIATION CORRECTION MAP (ADVANCE SIDE)

| STEADY-STATE DEVIATION (°CA) | -9 | ..... | ..... | ..... | 9 |
|---|---|---|---|---|---|
| CORRECTION AMOUNT (%) | E1 | E2 | E3 | E4 | E5 |

( E1<E2<E3<E4<E5 )

HOLD DUTY STEADY-STATE DEVIATION CORRECTION MAP (RETARD SIDE)

| STEADY-STATE DEVIATION (°CA) | -9 | ..... | ..... | ..... | 9 |
|---|---|---|---|---|---|
| CORRECTION AMOUNT (%) | E1' | E2' | E3' | E4' | E5' |

( E1'<E2'<E3'<E4'<E5' )

VALVE TIMING CONTROL APPARATUS AND VALVE TIMING CONTROL ARRANGEMENT

CROSS REFERENCE TO RELATED APPLICATION

This application is based on and incorporates herein by reference Japanese Patent Application No. 2008-108085 filed on Apr. 17, 2008, Japanese Patent Application No. 2008-187312 filed on Jul. 18, 2008, Japanese Patent Application No. 2008-190468 filed on Jul. 24, 2008, and Japanese Patent Application No. 2008-192851 filed on Jul. 25, 2008.

BACKGROUND OF THE INVENTION

1. Field of the Invention

The present invention relates to a valve timing control apparatus for a valve timing adjustment mechanism that changes timing of opening and closing an intake valve or an exhaust valve.

The present invention also relates to a valve timing control apparatus that is capable of learning a width of a dead zone of a control signal, wherein a hydraulic variable valve mechanism is unable to respond to the control signal when the signal is within the dead zone.

The present invention also relates to a valve timing control apparatus for an internal combustion engine, the valve timing control apparatus being capable of learning a hold control amount required for maintaining actual value of the valve timing at a constant state.

2. Description of Related Art

The above valve timing adjustment mechanism includes an output-side rotor, a cam-side rotor, a hydraulic pump, and a control valve. The output-side rotor is rotatable synchronously with an output shaft of an internal combustion engine, and the cam-side rotor is rotatable synchronously with a camshaft that opens and closes an intake valve or an exhaust valve. The hydraulic pump supplies hydraulic oil such that one of the above rotors rotates relative to the other one of the rotors. The control valve controls speed of the relative rotation by controlling the supply of hydraulic oil in accordance with a drive command signal outputted by a control device (see JP-A-2003-254017).

In the adjustment mechanism, in a hold case, where the relative rotation speed is zero and thereby the rotational position of the one of the rotors relative to the other is maintained, slight change of the drive command signal hardly changes speed of the relative rotation. However, when the change of the drive command signal exceeds a certain amount, the relative rotation speed suddenly changes. As above, a change amount of a drive command signal from a first value to a second value is referred as a "dead zone width". For example, when the drive command signal is at the first value, the relative rotational position is under the hold state, and when the drive command signal is changed from the first value to become the second value, the relative rotation speed starts changing sharply.

The dead zone width changes depending on individual differences of the adjustment mechanisms or variations with time of the adjustment mechanisms. Moreover, when temperature of hydraulic oil is lower, viscosity of hydraulic oil becomes higher. Thereby, the dead zone width of each of the adjustment mechanisms widely changes with temperature. As a result, in a case, where relative rotation speed is controlled by operating the control valve through the drive command signal, the resulting relative rotation speed may widely change depending on a magnitude of the dead zone width even when the same drive command signal is given. Thus, the computation of the drive command signal in consideration of the dead zone width at the time of the operation is important for accurately controlling the relative rotation speed. If the relative rotation speed is accurately controlled, it is possible to minimize hunting, and also to improve responsivity by quickly rotating one of the rotors relative to the other to a desired position. In other words, it is possible to quickly adjust timing of opening and closing the intake valve or the exhaust valve to desired timing.

JP-A-2003-254017 proposes to execute an inching control that alternately executes a forcible drive control and a stop control for predetermined durations when a difference between an actual relative rotational position and a target position is large. The forcible drive control forcibly drives the relative rotation speed to the maximum, and the stop control stops the relative rotation of the rotors. However, is it very difficult to adjust inching cycle, a forcible drive duration, a rotation stop duration in order to improve responsivity if the inching control is put into practice.

Recently, the more and more internal combustion engines mounted on the vehicles are provided with hydraulic variable valve timing apparatuses that change valve timing of opening and closing the intake valve or the exhaust valve of the engine in order to increase the output, to improve the fuel efficiency, and to reduce exhaust gas emission. The hydraulic variable valve timing apparatus computes a control duty for controlling a hydraulic control valve, which adjusts drive oil pressure, based on a difference between target valve timing and actual valve timing, and the hydraulic control valve is driven based on the computed control duty such that flow amount (oil pressure) of hydraulic oil supplied to an advance chamber and a retard chamber of the variable valve timing apparatus is changed, and thereby the valve timing is advanced or retarded.

As shown in JP-A-2001-164964, JP-A-2003-336529, and JP-A-2007-107539, in the hydraulic variable valve timing apparatus, a change characteristic (response characteristic) of the valve timing variable speed relative to change of the control duty of the hydraulic control valve is non-linear, and there is a dead zone, in which change of valve timing relative to change of the control duty is very slow. Thus, it is known that responsivity of the variable valve timing control may remarkably deteriorate disadvantageously when the control duty stays within the above dead zone.

Thus, in JP-A-2003-336529 and JP-A-2007-107539, in order to learn the width of the dead zone, the control signal is oscillated by an amplitude greater than a magnitude of a possible dead zone width. Then, while the actual valve timing oscillates around target value (a center of the dead zone), the amplitude of the control signal is gradually reduced. Then, the dead zone width is learned based on the amplitude of the control signal when the oscillation of the actual valve timing stops. Also, under a state, where the actual valve timing is maintained unvibrated at the target value, the amplitude of the control signal is gradually increased. The dead zone width is learned based on the amplitude of the control signal at a time when the actual valve timing starts vibrating. When the target value changes during the variable valve timing control, the control signal is offset-corrected based on the learned value of the dead zone width.

However, the dead zone width learning methods described in JP-A-2003-336529 and JP-A-2007-107539 require trouble of adjusting a cycle and the amplitude for oscillating the control signal disadvantageously.

Recently, more and more internal combustion engines mounted on the vehicles are equipped with hydraulic variable valve mechanisms that change valve timing (opening-closing timing) of an intake valve and an exhaust valve of the engine in order to improve output, to improve fuel efficiency, and to reduce exhaust gas emission. The hydraulic variable valve mechanism as described in JP-A-2007-224744 and JP-A-2004-251254, a control amount (control duty) of a hydraulic control valve for controlling oil pressure is computed based on a feed-back correction amount and a hold control amount (hold duty). The feed-back correction amount is determined based on a difference between the target value and the actual valve timing, and the hold control amount corresponds to an amount that is required to maintain the actual valve timing under a constant state. By driving the hydraulic control valve based on the control amount to change a flow amount (oil pressure) of hydraulic oil supplied to an advance chamber and a retard chamber of the variable valve timing apparatus, valve timing is advanced or retarded. In the above operation, the hold control amount is learned in consideration of that the hold control amount may change depending on manufacturing variations and variation with time of the variable valve mechanism and the hydraulic control valve.

Because fluidity (viscosity) of hydraulic oil and a clearance between components of the variable valve mechanism change with oil temperature, the hold control amount required for maintaining the actual valve timing at the constant state changes with oil temperature.

As shown in JP-A-2000-230437, a hold control amount is learned for each of multiple temperature sections.

However, in the system that learns the hold control amount of each of the multiple temperature sections, in a case, where the hold control amount has been learned in a certain temperature section and a hold control amount in the other temperature section different from the above certain section has not been learned, the hold control amount learned in the certain temperature section is not able to be used for executing the variable valve timing control in the other temperature section. Thus, the accuracy in performing the variable valve timing control may deteriorate. Furthermore, because the frequency of executing the learning operation for learning the hold control amount is different for the different temperature section. As a result, accuracy in the learning operation of the hold control amount may become lower for the temperature section having the lower frequency. Therefore, the accuracy in the variable valve timing control may deteriorate disadvantageously.

SUMMARY OF THE INVENTION

The present invention is made in view of the above disadvantages. Thus, it is an objective of the present invention to address at least one of the above disadvantages.

To achieve at least one of the objectives of the present invention, there is provided a valve timing control apparatus for a valve timing adjustment mechanism that adjusts timing of opening and closing one of an intake valve and an exhaust valve of an internal combustion engine having an output shaft and a camshaft, the valve timing control apparatus including an output-side rotor, a cam-side rotor, a hydraulic pump, a control device, a control valve, and a storage device. The output-side rotor is rotatable synchronously with the output shaft. The cam-side rotor is rotatable synchronously with the camshaft that opens and closes the one of the intake valve and the exhaust valve. The hydraulic pump is configured to supply hydraulic oil such that one of the output-side and cam-side rotors rotates relative to the other one of the rotors. The control device outputs a drive command signal associated with rotation of the one of the rotors relative to the other one of the rotors. The control valve controls the speed of the rotation of the one of the rotors relative to the other one of the rotors by controlling supply of the hydraulic oil in accordance with the drive command signal outputted by the control device. The storage device prestores standard data indicating a predetermined relation for a reference product of the valve timing adjustment mechanism between a dead zone width and a parameter correlated with the dead zone width for each hydraulic oil temperature. The dead zone width corresponds to a change amount of the drive command signal that is changed from a first value to a second value. When the drive command signal is the first value, the rotors are in a hold state, where the speed of the rotation of the one of the rotors relative to the other one of the rotors is substantially zero such that a rotational position of the one of the rotors relative to the other one of the rotors is substantially maintained. When the drive command signal is changed from the first value and becomes the second value, the speed of the rotation of the one of the rotors relative to the other one of the rotors starts changing sharply. A value of the parameter of the dead zone width of the valve timing adjustment mechanism is detected and learned by changing the drive command signal during the hold state. The control device computes the drive command signal based on the learned value, the standard data, and hydraulic oil temperature.

To achieve at least one of the objectives of the present invention, there is also provided a valve timing control arrangement having the above valve timing control apparatus and the above valve timing adjustment mechanism.

To achieve at least one of the objectives of the present invention, there is also provided a valve timing control apparatus for an internal combustion engine having an intake valve and an exhaust valve, the valve timing control apparatus including a variable valve mechanism, dead zone width learning means, and control means. The variable valve mechanism uses oil pressure as a drive source to change a valve opening-closing characteristic of at least one of the intake valve and the exhaust valve. The dead zone width learning means executes a learning operation, in which the dead zone width learning means changes a control amount used for controlling the variable valve mechanism by changing a target value of the valve opening-closing characteristic from a first value to a second value in order to learn a value of one of a width of a dead zone and a dead zone width correlation parameter that is correlated with the dead zone width when the valve opening-closing characteristic is maintained at the first value. The variable valve mechanism is limited from being controlled even when the control amount of the variable valve mechanism is changed within the dead zone. The dead zone width learning means executes the learning operation when a predetermined dead zone width learning execution condition is established. The dead zone width learning means learns the value of the one of the dead zone width and the dead zone width correlation parameter during a period before a predetermined learning time has elapsed since a time, at which the dead zone width learning means forcibly changes the target value. The control means offset-corrects the control amount for controlling the variable valve mechanism based on the learned value learned by the dead zone width learning means after the dead zone width learning means completes the learning operation. The control means drives the variable valve mechanism based on the corrected control amount.

To achieve at least one of the objectives of the present invention, there is also provided a valve timing control apparatus for an internal combustion engine having an intake valve and an exhaust valve, the valve timing control apparatus including a variable valve mechanism, dead zone width learning means, control means, and a temperature detecting unit. The variable valve mechanism uses oil pressure as a drive source to change a valve opening-closing characteristic of at least one of the intake and exhaust valves. The dead zone width learning means executes a learning operation, in which the dead zone width learning means changes a control amount used for controlling the variable valve mechanism by changing a target value of the valve opening-closing characteristic from a first value to a second value in order to learn a value of a dead zone width correlation parameter that is correlated with a width of a dead zone when the valve opening-closing characteristic is maintained at the first value. The variable valve mechanism is limited from being controlled even when the control amount of the variable valve mechanism is changed within the dead zone. The control means drives the variable valve mechanism by offset correcting the control amount of the variable valve mechanism based on the learned value of the dead zone width correlation parameter after the learning operation by the dead zone width learning means is completed. The temperature detecting unit detects an oil temperature parameter that is associated with one of an oil temperature of the variable valve mechanism and a temperature correlated with the oil temperature. The dead zone width learning means forcibly changes the target value in order to learn the value of the dead zone width correlation parameter when a predetermined dead zone width learning execution condition is established. The dead zone width learning means changes one of a forcible change width of the target value at the beginning of the learning operation and a control gain during the learning operation in accordance with the oil temperature parameter detected by the temperature detecting unit, the forcible change width corresponding to a difference between the first value and the second value of the target value of the valve opening-closing characteristic.

To achieve at least one of the objectives of the present invention, there is also provided a valve timing control apparatus for an internal combustion engine having an intake valve and an exhaust valve, the valve timing control apparatus including a variable valve mechanism, an oil pressure control device, control means, a temperature detecting unit, a nonvolatile storage unit, and hold control amount learning means. The variable valve mechanism adjusts valve timing of at least one of the intake valve and the exhaust valve based on oil pressure serving as a drive source. The oil pressure control device controls pressure of oil that drives the variable valve mechanism. The control means controls the oil pressure control device such that an actual value of the valve timing becomes a target value of the valve timing. The control means computes a control amount used for controlling the oil pressure control device based on a feed-back correction amount, which is determined based on a difference between the target value and the actual value of the valve timing and based on a hold control amount, which is required to maintain the actual value of the valve timing under a constant state. The temperature detecting unit detects an oil temperature parameter that is one of an oil temperature and a temperature that is correlated with the oil temperature. The nonvolatile storage unit prestores hold control amount standard characteristic data that defines a relation between the oil temperature parameter and the hold control amount. The hold control amount learning means learns a value of the hold control amount of a predetermined temperature section. The control means determines the hold control amount of a temperature section corresponding to the oil temperature parameter based on the learned value of the hold control amount of the predetermined temperature section and based on a retrieved value of the hold control amount standard characteristic data, which is retrieved from the storage unit, in order to compute the control amount of the oil pressure control device.

BRIEF DESCRIPTION OF THE DRAWINGS

The invention, together with additional objectives, features and advantages thereof will be best understood from the following description, the appended claims and the accompanying drawings in which:

FIG. 17 is a diagram for conceptually explaining a dead zone width base value map;

FIG. 18 is a diagram for conceptually explaining a learning correction coefficient map;

DETAILED DESCRIPTION OF PREFERRED EMBODIMENTS

First Embodiment

In the first embodiment of the present invention, a valve timing control apparatus and a valve timing control arrangement of the present invention is applied to a valve timing adjustment mechanism for a gasoline engine (internal combustion engine). The valve timing adjustment mechanism of the first embodiment will be described below with reference to accompanying drawings.

Figure 1:
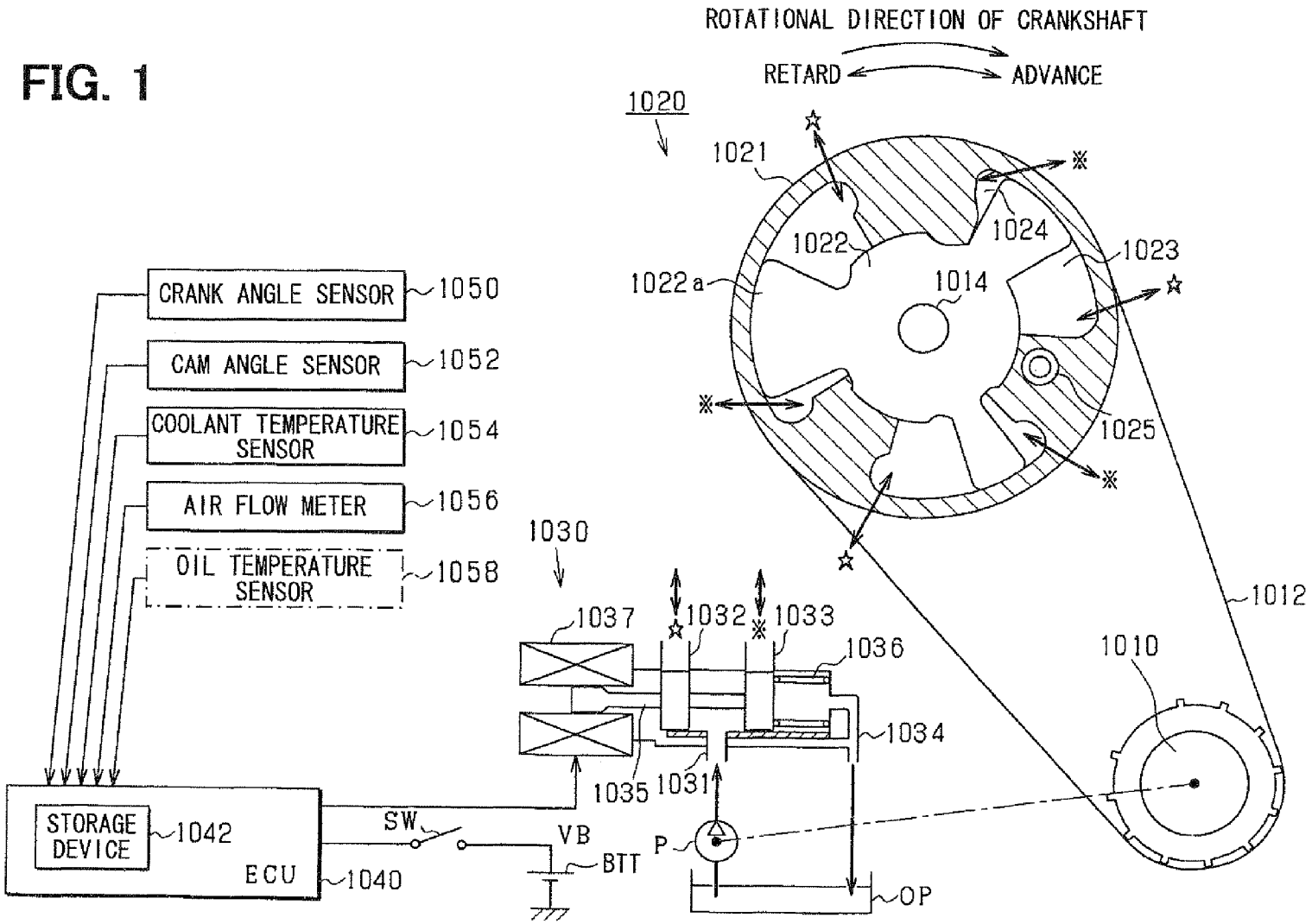
FIG. 1 is a drawing illustrating a general configuration of a valve timing adjustment mechanism and a control system according to the first embodiment of the present invention.

FIG. 1 shows a general configuration of a control system according to the present embodiment.

As shown in FIG. 1, a crankshaft 1010, which serves as an output shaft of the internal combustion engine, transmits a drive force to a camshaft 1014 through a belt 1012 and a valve timing adjustment mechanism 1020. The valve timing adjustment mechanism 1020 controls a rotation angle of the camshaft 1014 relative to a rotation angle of the crankshaft 1010 in order to control timing of opening and closing an exhaust valve (not shown) or an intake valve (not shown). In other words, the valve timing adjustment mechanism 1020 controls a relative rotational position of the camshaft 1014 relative to the crankshaft 1010 in order to control timing of opening and closing the exhaust valve or the intake valve. For example, the valve timing adjustment mechanism 1020 adjusts an valve overlap between the intake valve and the exhaust valve in accordance with an operational state of the engine.

The valve timing adjustment mechanism 1020 includes a housing 1021 (output-side rotor) and a vane rotor 1022 (cam-side rotor). The housing 1021 is mechanically connected with the crankshaft 1010, and the vane rotor 1022 is mechanically connected with the camshaft 1014.

In the present embodiment, the vane rotor 1022 includes multiple projection portions 1022*a*, and the housing 1021 receives the vane rotor 1022 therein. Each of the projection portions 1022*a* of the vane rotor 1022 and an inner wall of the housing 1021 define therebetween a retard chamber 1023 and an advance chamber 1024. The retard chamber 1023 is used for retarding the rotation angle (relative rotation angle) of the camshaft 1014 relative to the crankshaft 1010. Also, the advance chamber 1024 is used for advancing the relative rotation angle. It should be noted that the valve timing adjustment mechanism 1020 further includes a lock mechanism 1025 that locks the housing 1021 with the vane rotor 1022 at a predetermined rotational position relative to each other. For example, the lock mechanism 1025 may lock the housing 1021 with the vane rotor 1022 at a full retard position or at an intermediate position between the full retard position and a full advance position.

The valve timing adjustment mechanism 1020 is oil-actuated by incompressible working fluid (hydraulic oil) that is supplied to and discharged from the retard chambers 1023 and the advance chambers 1024. The valve timing adjustment mechanism 1020 serves as a hydraulic actuator, and supply and discharge of the hydraulic oil is adjusted by an oil control valve (OCV) 1030 serving as a "control valve".

The OCV 1030 receives hydraulic oil discharged from an engine-actuated hydraulic pump P that receives a driving force from the crankshaft 1010 of the engine. The OCV 1030 supplies the received hydraulic oil to the retard chamber 1023 or the advance chamber 1024 through a supply route 1031 and a corresponding one of a retard route 1032 and an advance route 1033. Also, the OCV 1030 discharges hydraulic oil from the retard chamber 1023 or the advance chamber 1024 to an oil pan OP through a drain route 1034 and a corresponding one of the retard route 1032 and the advance route 1033. The OCV 1030 includes a spool 1035 that adjusts a flow channel area between (a) the retard route 1032 or the advance route 1033 and (b) the supply route 1031 or the drain route 1034. More specifically, the OCV 1030 further includes a spring 1036 and a solenoid 1037. The spring 1036 urges the spool 1035 leftward in FIG. 1, and the solenoid 1037 generates a force that is applied to the spool 1035 rightward in FIG. 1. As a result, the adjustment of duty of a drive command signal and the giving of the adjusted drive command signal to the solenoid 1037 control an amount of displacement of displacing the spool 1035.

The control of relative rotation angle by the operation of the OCV 1030 is executed by an electronic control device (ECU) 1040. The ECU 1040 mainly includes a microcomputer and receives detection values indicating various operational states of the internal combustion engine detected by a crank angle sensor 1050, a cam angle sensor 1052, a coolant temperature sensor 1054, and an air flow meter 1056. For example, the crank angle sensor 1050 detects a rotation angle of the crankshaft 1010, and the cam angle sensor 1052 detects a rotation angle of the camshaft 1014. Also, the coolant temperature sensor 1054 detects a coolant temperature of the internal combustion engine, and the air flow meter 1056 detects an amount of intake air. The ECU 1040 executes various computations based on the above detection values, and the ECU 1040 operates various actuators of the internal combustion engine, such as the OCV 1030, based on the computation result.

It should be noted that the ECU 1040 includes a memory 1042 (storage device) that stores data used for the above various computations. The memory 1042 is one of multiple memories. The memory 1042 is capable of always storing data regardless of a connection state with a battery BTT serving as an electric power supplier of the ECU 1040. In other words, the memory 1042 is capable of always storing data regardless of an operational state of a power source switch SW. For example, the memory 1042 may be a back-up memory that is always supplied with power regardless of a main electrical connection state between the ECU 1040 and the battery BTT. Also, the memory 1042 may be a nonvolatile memory, such as EEPROM, that is capable of storing data without power supply.

A control of the relative rotational position executed by the ECU 1040 will be described below.

When the urging force of the spring 1036 that urges the spool 1035 to the left in FIG. 1 is greater than the force generated by a magnetic field of the solenoid 1037 that urges the spool 1035 in a direction opposite from the urging direction by the spring 1036, the spool 1035 is displaced toward the left in FIG. 1. When the spool 1035 is displaced leftward further from a position shown in FIG. 1, the hydraulic pump P supplies oil to the retard chamber 1023 through the supply route 1031 and the retard route 1032. Also, oil is drained the oil pan OP from the advance chamber 1024 through the advance route 1033 and the drain route 1034. Thus, the vane rotor 1022 is rotated counterclockwise in FIG. 1. In other words, the vane rotor 1022 is rotated relative to the housing 1021 in the retard direction.

In contrast, when the force generated by the magnetic field of the solenoid 1037 for urging the spool 1035 in the right direction in FIG. 1 is greater than the urging force of the spring 1036 for urging the spool 1035 in the left direction in FIG. 1, the spool 1035 is displaced in the right direction in FIG. 1. When the spool 1035 is displaced rightward further from the position shown in FIG. 1, the hydraulic pump P supplies oil to the advance chamber 1024 through the supply route 1031 and the advance route 1033, and also oil is drained to the oil pan OP from the retard chamber 1023 through the retard route 1032 and the drain route 1034. Thus, the vane rotor 1022 is rotated clockwise in FIG. 1. In other words, the vane rotor 1022 is rotated relative to the housing 1021 in the advance direction.

In short, the OCV 1030 controls supply and discharge of hydraulic oil of the retard chamber 1023 and the advance chamber 1024 in order to control pressure of hydraulic oil in the retard chamber 1023 and the advance chamber 1024. Thereby, the OCV 1030 controls speed of the relative rotation of the vane rotor 1022 relative to the housing 1021. Also, the ECU 1040 controls an operation of the OCV 1030 in order to control the relative rotational position of the vane rotor 1022 relative to the housing 1021. It should be noted that when the spool 1035 is located at a position to close the retard route 1032 and the advance route 1033 as shown in FIG. 1, flow of oil between the retard chamber 1023 and the advance chamber 1024 is stopped, and thereby the relative rotational position is maintained or held. The above operational state is referred as a hold state in the present embodiment. In the above hold state, hydraulic oil slightly leaks from the retard chamber 1023 and the advance chamber 1024, and thereby hydraulic oil of an amount equivalent to an amount of the leaked oil needs to be always supplied to the chambers 1023, 1024.

Figure 2A:
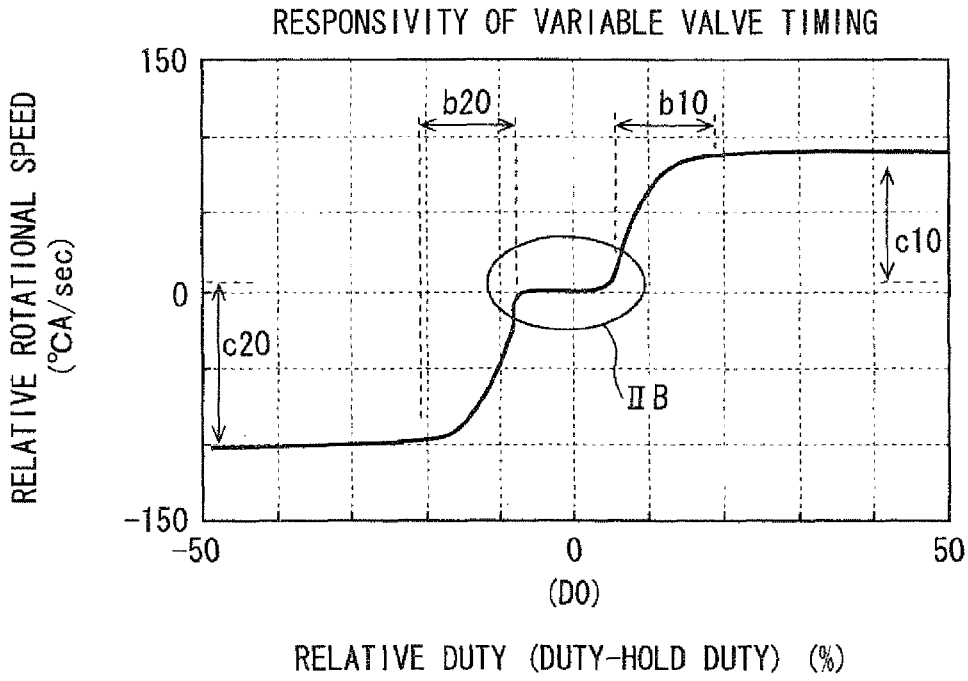
FIG. 2A is a chart illustrating a relation between a duty value of drive command signal and a relative rotation speed of a vane rotor.

In the ECU 1040, by energizing the solenoid 1037 of the OCV 1030, the position of the spool 1035 is controlled such that the relative rotation angle is controlled. Specifically, in the present embodiment, the energization to the solenoid 1037 is controlled by the drive command signal that is adjusted by a duty control. More specifically, the drive command signal is periodically changed between two values (ON and OFF), and a ratio of the ON duration (or OFF duration) to a duration of the one cycle is adjusted. FIG. 2A shows a relation between (a) a duty value (duty cycle) of the drive command signal outputted to the solenoid 1037 and (b) the relative rotation speed of the vane rotor 1022. The relative rotation speed of the vane rotor 1022 corresponds to the rotation speed of the camshaft 1014 relative to the crankshaft 1010.

As shown in FIG. 2A, when the duty value indicates a value D0, the relative rotation speed becomes zero. In other words, when the duty value is the value D0, the rotational position of the vane rotor 1022 relative to the housing 1021 is maintained. In contrast, when the duty value is smaller than the value D0, the vane rotor 1022 or the camshaft 1014 is displaced in the retard direction. Moreover, the speed of the relative rotation of the vane rotor 1022 in the retard direction becomes greater as the duty value becomes smaller. However, when the duty value is greater than the value D0, the vane rotor 1022 is displaced in the advance direction. Moreover, the speed of the relative rotation in the advance direction becomes greater as the duty value becomes greater.

By learning the duty value "D0" as a hold duty value and by feed-back controlling the relative rotation angle to a target value (target phase) based on the hold duty value, it is possible to appropriately control the relative rotation angle to the target value. It should be noted that an abscissa axis in FIGS. 2A and 2B indicates a relative duty that corresponds to a difference between an actual duty value and the hold duty value.

Figure 3:
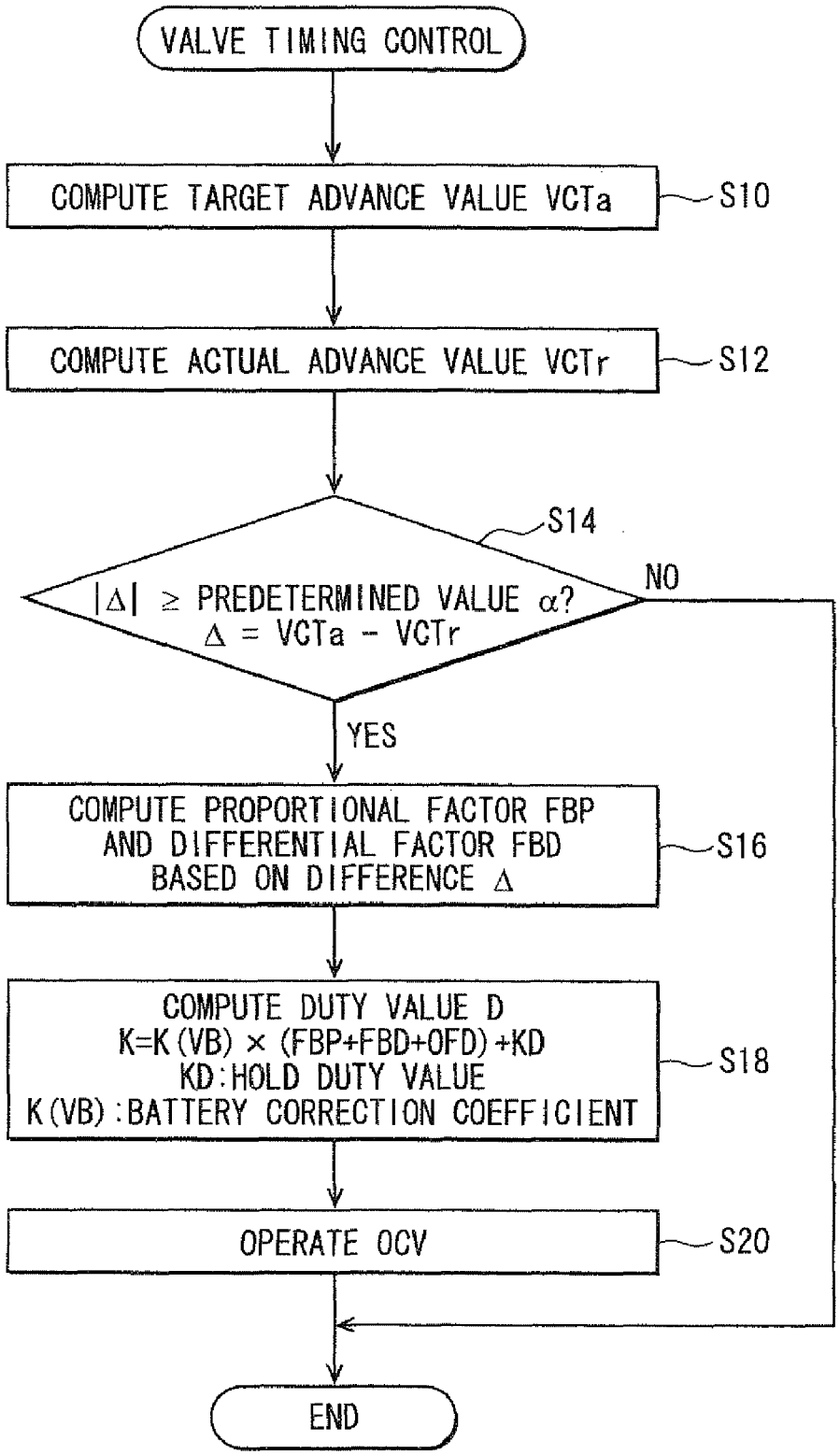
FIG. 3 is a flow chart illustrating a procedure of a feed-back control executed by a microcomputer of an ECU shown in FIG. 1 for controlling a relative rotation angle.

FIG. 3 shows a procedure of the feed-back control for controlling the relative rotation angle according to the present embodiment. The process is repeatedly executed by the ECU 1040 by predetermined intervals, for example.

In the series of steps in the process, firstly, at step S10, a target advance value VCTa is computed based on parameters defining the operational state of internal combustion engine, such as the rotational speed of the crankshaft 1010 and the intake air amount. The target advance value VCTa serves as a target value for the relative rotation angle of the camshaft 1014 relative to the crankshaft 1010. The target advance value VCTa corresponds to a "target relative rotational position" and may be referred as a target phase in the present embodiment.

Then, control proceeds to step S12, where an actual advance value VCTr is computed based on the detection value of the crank angle sensor 1050 and the detection value of the cam angle sensor 1052. The actual advance value VCTr corresponds to an actual relative rotation angle of the camshaft 1014 relative to the crankshaft 1010. Then, control proceeds to step S14, where it is determined whether an absolute value of a difference $\Delta$ between the actual advance value VCTr and the target advance value VCTa is equal to or greater than a predetermined value $\alpha$. The predetermined value $\alpha$ defines a threshold value for determining whether to execute a feed-back control during a transitional state based on the difference between the actual advance value VCTr and the target advance value VCTa.

When it is determined at step S14 that the absolute value of the difference is equal to or greater than the predetermined value α the actual advance value VCTr is feed-back controlled to the target advance value VCTa (feed-back control is executed such that the actual advance value VCTr becomes the target advance value VCTa. Firstly, at step S16, a proportional factor FBP and a differential factor FBD based on the difference Δ between the target advance value VCTa and the actual advance value VCTr are computed. Then, control proceeds to step S18, where the duty value of drive command signal D is computed.

duty value D is defined as the ratio between the pulse duration of the ON state or activation state and the period of the one cycle including ON and OFF states, for example. The duty value D is computed by adding a hold duty value KD to multiplication of a correction coefficient K multiplied by a summary of the proportional factor FBP, the differential factor FBD, and an offset correction amount OFD (described later) as shown by an equation in step S18 of the flow chart in FIG. 3. The correction coefficient K compensates change of the voltage VB of the battery BTT. In other words, change in the amount of energy supplied to the OCV 1030 caused by change of the voltage of the battery BTT relative to a standard value (for example, "14 V") is corrected such that substantially the same energy is supplied regardless of the voltage VB of the battery BTT. When the duty value D is computed as above, control proceeds to step S20, where the OCV 1030 is operated based on the duty value D.

It should be noted that when it is determined at step S14 that the absolute value of the difference is smaller than the predetermined value α, or when the process in step S20 is completed, the series of steps in the process is temporarily stopped.

Figure 4:
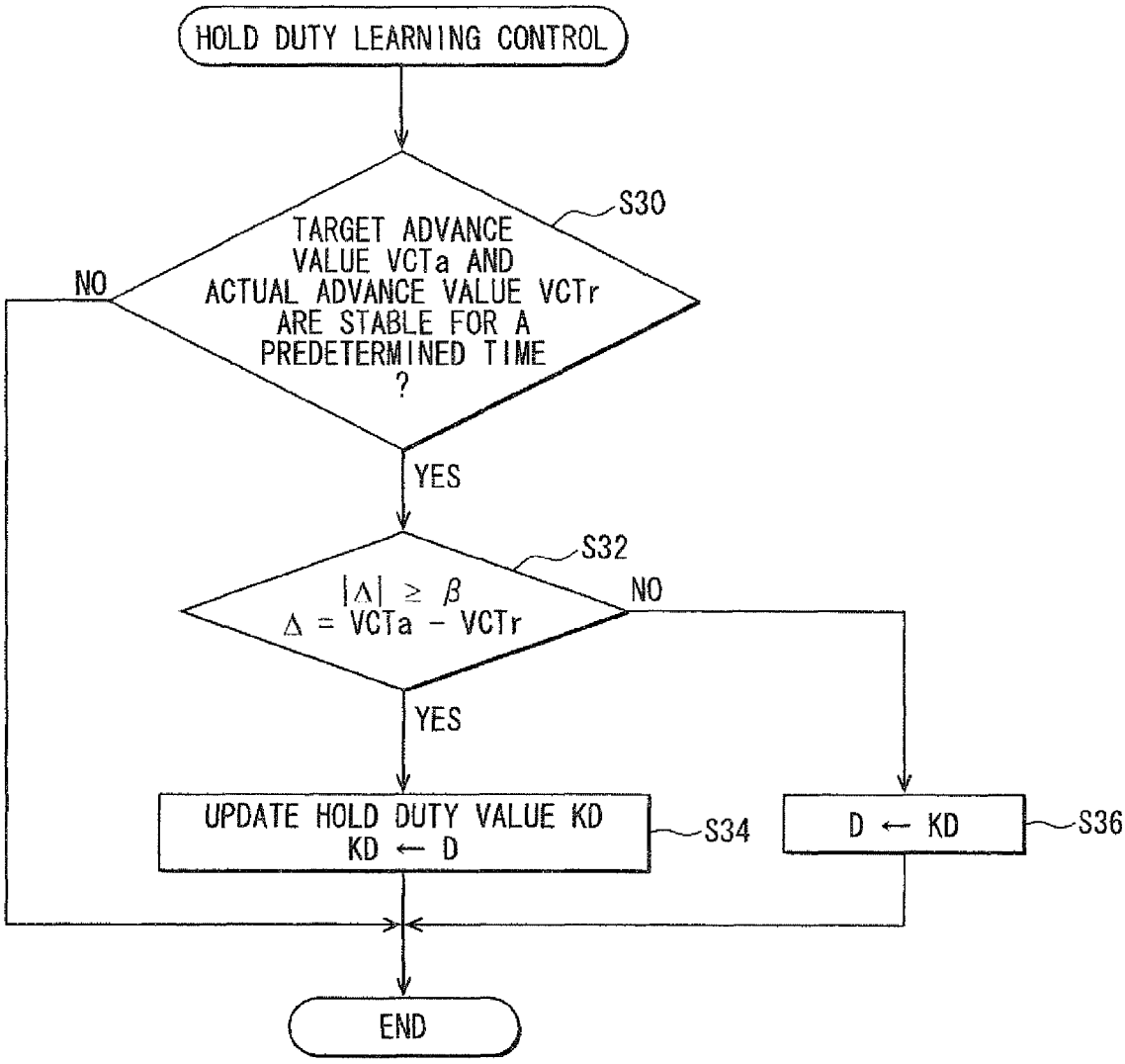
FIG. 4 is a flow chart illustrating a procedure of a hold duty value learning control executed by the microcomputer of the ECU shown in FIG. 1.

FIG. 4 shows a procedure of a learning control for learning the hold duty value KD. The execution of the process shown in FIG. 4 is repeated by the ECU 1040 by predetermined intervals, for example.

Firstly, at step S30, it is determined whether each of the target advance value VCTa and the actual advance value VCTr remains stable for a predetermined time. In other words, it is determined at step S30 whether the feed-back control has caused the actual advance value VCTr to substantially become the target advance value VCTa. In the above, it is determined whether each of the parameters VCTa, VCTr is stable based on whether each of the parameters VCTa, VCTr changes within a predetermined range. When it is determined at step S30 that the target advance value VCTa and the actual advance value VCTr are stable, it is determined that the target advance value VCTa and the actual advance value VCTr are under the hold state, and thereby control proceeds to step S32.

At step S32, it is determined whether the absolute value of the difference Δ of the target advance value VCTa relative to the actual advance value VCTr is equal to or greater than a predetermined value β. In other words, it is determined at step S32 whether the feed-back control has caused a steady difference between the actual advance value VCTr and the target advance value VCTa. The predetermined value β is set as a value for determining the occurrence of the above steady difference. When it is determined at step S32 that the absolute value of the difference Δ is equal to or greater than the predetermined value β, it is determined that the feed-back control causes the steady difference between the actual advance value VCTr and the target advance value VCTa. Then, control proceeds to step S34.

At step S34, the hold duty value KD is updated. In other words, when the steady difference is caused even after the execution of the feed-back control shown in FIG. 3, it is estimated that the hold duty value KD may deviate from an appropriate value. Thus, the hold duty value KD needs to be updated. In the present embodiment, the hold duty value KD is updated to become the present duty value D. Thus, the difference between the target advance value VCTa and the actual advance value VCTr is made smaller. It should be noted that in a case, where the duty value D, to which the hold duty value KD has been updated, is excessively large, the feed-back control shown in FIG. 3 is executed in order to update the duty value D.

In contrast, when it is determined at step S32 that the absolute value of the difference Δ is smaller than the predetermined value β, control proceeds to step S36, where the duty value D is replaced by the hold duty value KD instead of computing the duty value D at step S18 in the flow chart of FIG. 3. It should be noted that when it is determined at step S30 that the target advance value VCTa and the actual advance value VCTr are not stable or when process in steps S34 or S36 is completed, the series of steps in the process is temporarily stopped.

Figure 2B:
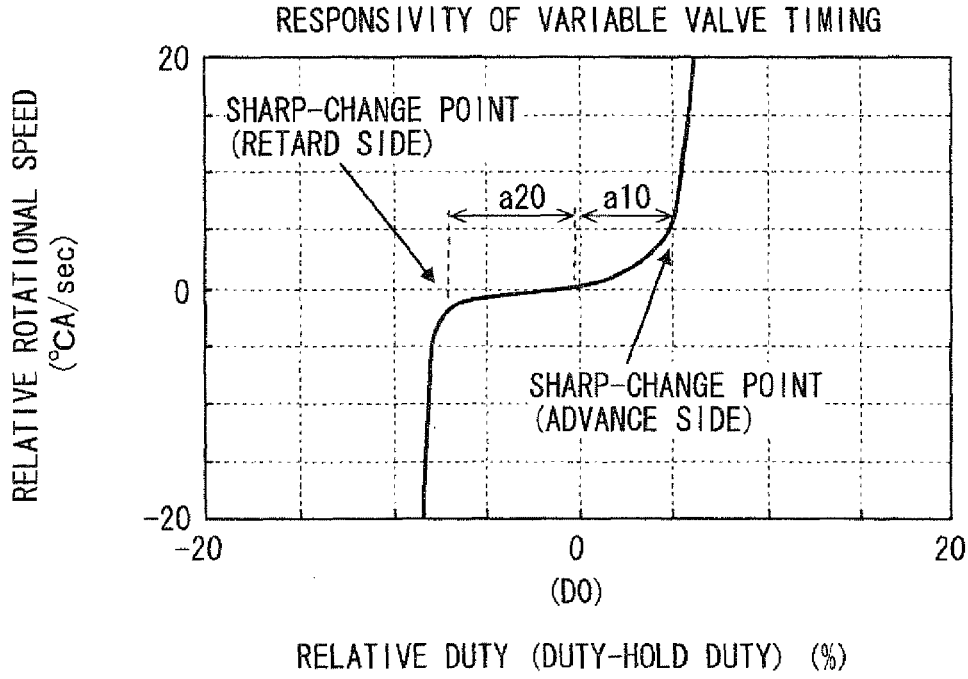
FIG. 2B is an enlarged chart illustrating a part near a hold duty in the chart in FIG. 2A.

The relation (response characteristic) between the duty value D and the actual advance value VCTr shown in FIGS. 2A and 2B changes depending on an individual difference and variation with time of the product and also depending on the influence of temperature. Specifically, temperature remarkably influences the variation in the dead zone width. The variation in the dead zone width caused by the temperature change will be described with reference to FIGS. 2A, 2B, 5A, and 5B. It should be noted that FIG. 2B is an enlarged view illustrating a part around the hold duty shown in the chart of FIG. 2A.

FIGS. 2A and 2B shows an example of response characteristic of the valve timing adjustment mechanism having the valve timing adjustment mechanism 1020 and the OCV 1030. In FIG. 2B, each of a10 and a20 indicates a hold dead zone region (dead zone width), in which the change speed of the actual advance value VCTr is kept substantially small even when the duty value D is slightly changed under a state, where the actual advance value VCTr is temporarily maintained based on the hold duty value KD. In other words, when the relative duty changes within the dead zone region, the change speed of the actual advance value VCTr is kept substantially small. As shown in FIG. 2B, when the duty value D is changed from the hold duty value KD, the change speed of the actual advance value VCTr starts changing sharply at a sharp-change point (the change amount per unit of time becomes equal to or greater than a predetermined amount at the point). However, when the duty value D is within a range between the hold duty value KD to the sharp-change point, the change speed of the actual advance value VCTr is kept very small. In other words, when the relative duty is changed from the duty value "D0" (first value), the change speed of the relative rotation speed starts changing sharply when the relative duty becomes a second value at the sharp-change point shown in FIG. 2B, for example. However, when the relative duty is within a range between the duty value "D0" and the sharp-change point or within a range between the first value and the second value, the change speed of the relative rotation speed is kept very small as shown in FIG. 2B.

More specifically, a20 corresponds to the hold dead zone region in the retard side, and a10 corresponds to the hold dead zone region in the advance side. Thus, the dead zone width is defined by a region between the hold duty and the sharp-change point. Each of b10 and b20 indicates a region, where the change speed of the actual advance value VCTr remarkably changes in accordance with or in proportional with the change of the duty value D. More specifically, b20 corresponds to the region in the retard side, and b10 corresponds to the region in the advance side. Also, each of c10 and c20 indicates an upper limit speed in a region where the change speed of the actual advance value VCTr hardly changes even when the duty value D is changed. More specifically, c20 is a relative rotation speed in the retard side, and c10 is a relative rotation speed in the advance side. In other words, c10 indicates the maximum speed when the duty is 100%, and c20 indicates the minimum speed when the duty is 0%.

Figure 5A:
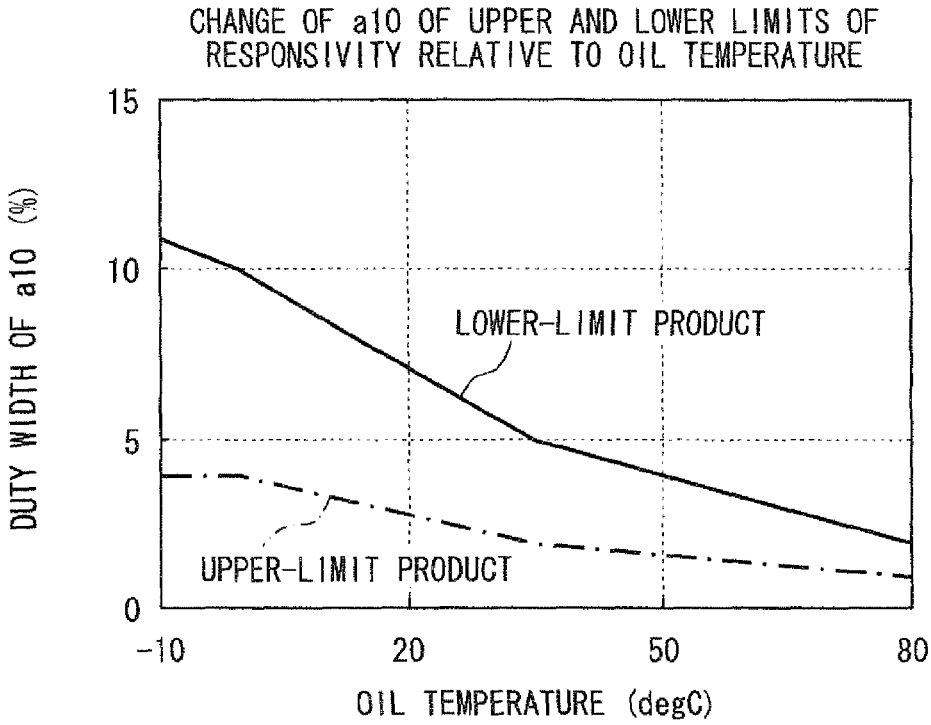
FIG. 5A is a chart illustrating a relation between a hold dead zone width and a hydraulic oil temperature in an advance side.
Figure 5B:
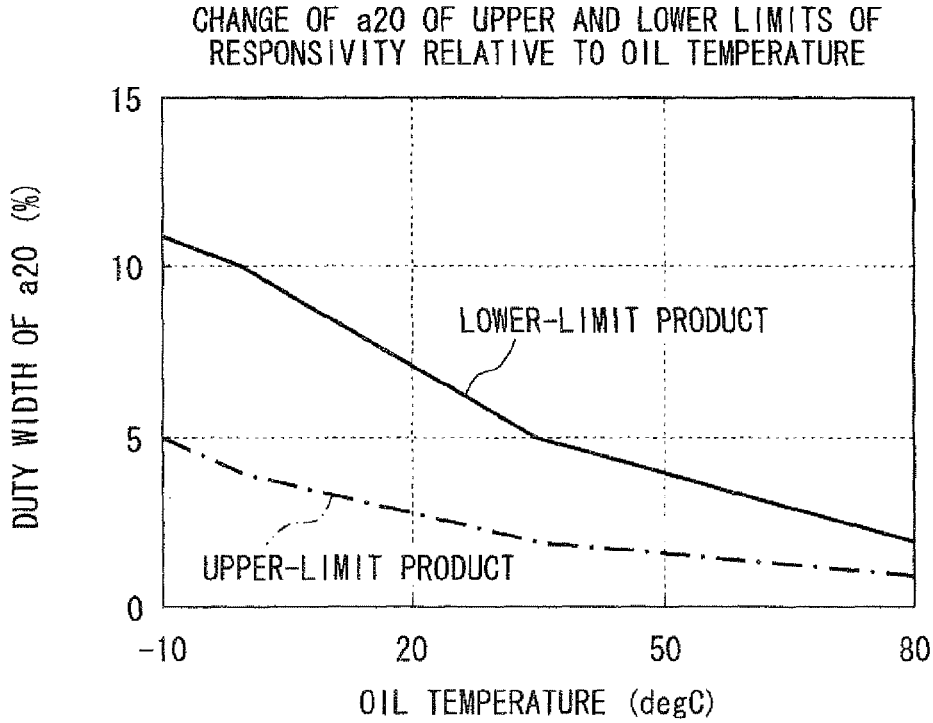
FIG. 5B is a chart illustrating a relation between the hold dead zone width and the hydraulic oil temperature in a retard side.

FIG. 5A shows a relation between the hold dead zone width and the hydraulic oil temperature in the advance side, and FIG. 5B shows a relation between the hold dead zone width and the hydraulic oil temperature in the retard side. For example, the manufactured products of the valve timing adjustment mechanism includes (a) an upper-limit product that has a highest response characteristic and (b) a lower limit product that has a lowest response characteristic. In FIGS. 5A and 5B, a dashed and single-dotted line indicates a hold dead zone width of the upper-limit product among the manufactured products, and a solid line indicates the lower limit product among the manufactured products. A deviation between the dead zone widths a10 and a20 for each oil temperature indicates a variable range, in which the response characteristic of the manufactured products is variable for the oil temperature. As shown in FIGS. 5A and 5B, as temperature of hydraulic oil decreases, the hold dead zone width a10, a20 becomes greater, and the variable range of the response characteristic becomes larger. Also, as temperature of hydraulic oil decreases, the change of the hold dead zone width a10, a20 relative to the temperature variation becomes larger. Furthermore, in a certain temperature section (for example, 70 to several tens over 100 degree C.), where temperature of hydraulic oil saturates along with the operation of the gasoline engine, the variable range of the response characteristic or the individual difference of the hold dead zone width is very small. In contrast, as temperature becomes lower than the above certain temperature section, the variable range of the response characteristic or the individual difference of the hold dead zone width becomes more remarkable. Also, in comparison of FIGS. 5A and 5B, it is appreciated that the relation between the hold dead zone width and the hydraulic oil temperature in the advance side is different from the relation in the retard side. Also, the hold dead zone width for the hydraulic oil temperature in the advance side is different from the hold dead zone width for the same hydraulic oil temperature in the retard side.

As above, the variation of the hold dead zone width caused by the change in hydraulic oil temperature is significantly large, and furthermore the variation the hold dead zone width caused by the individual difference is significantly large. A relation between the difference Δ and proportional factor FBP and differential factor FBD in the feed-back control in FIG. 3 is determined in consideration of the hold dead zone width. However, when the hold dead zone width is changed due to the change in the temperature, and at the same time the hold dead zone width of the individual difference is very large, an actual response characteristic of the valve timing adjustment mechanism may vary with in a wide variable range. Thus, a difference between the actual response characteristic and a standard response characteristic (or dead zone width) referred for the control of the actual advance value VCTr may become significantly larger, and thereby controlability may deteriorate without any correction process.

In other words, in the control of the relative rotation speed of the vane rotor 1022 by adjusting the duty value D to the solenoid 1037, the resulting relative rotation speed may widely change depending on the magnitude of the dead zone width that is influenced by the oil temperature at the time of the adjustment, even when the duty value D to the solenoid 1037 is adjusted at the same value. As a result, it is important to compute the duty value D based on the dead zone width at the time of the adjustment in order to accurately control the relative rotation speed. Also, when the relative rotation speed is accurately controlled, hunting of the actual advance value VCTr relative to the target advance value VCTa (target relative rotational position) is limited to the minimum, and thereby it is possible to improve responsivity by quickly rotating the vane rotor 1022 to the target relative rotational position relative to the housing 1021. In other words, it is possible to quickly adjust opening-closing timing of the intake valve or the exhaust valve to the desired timing.

Figure 6:
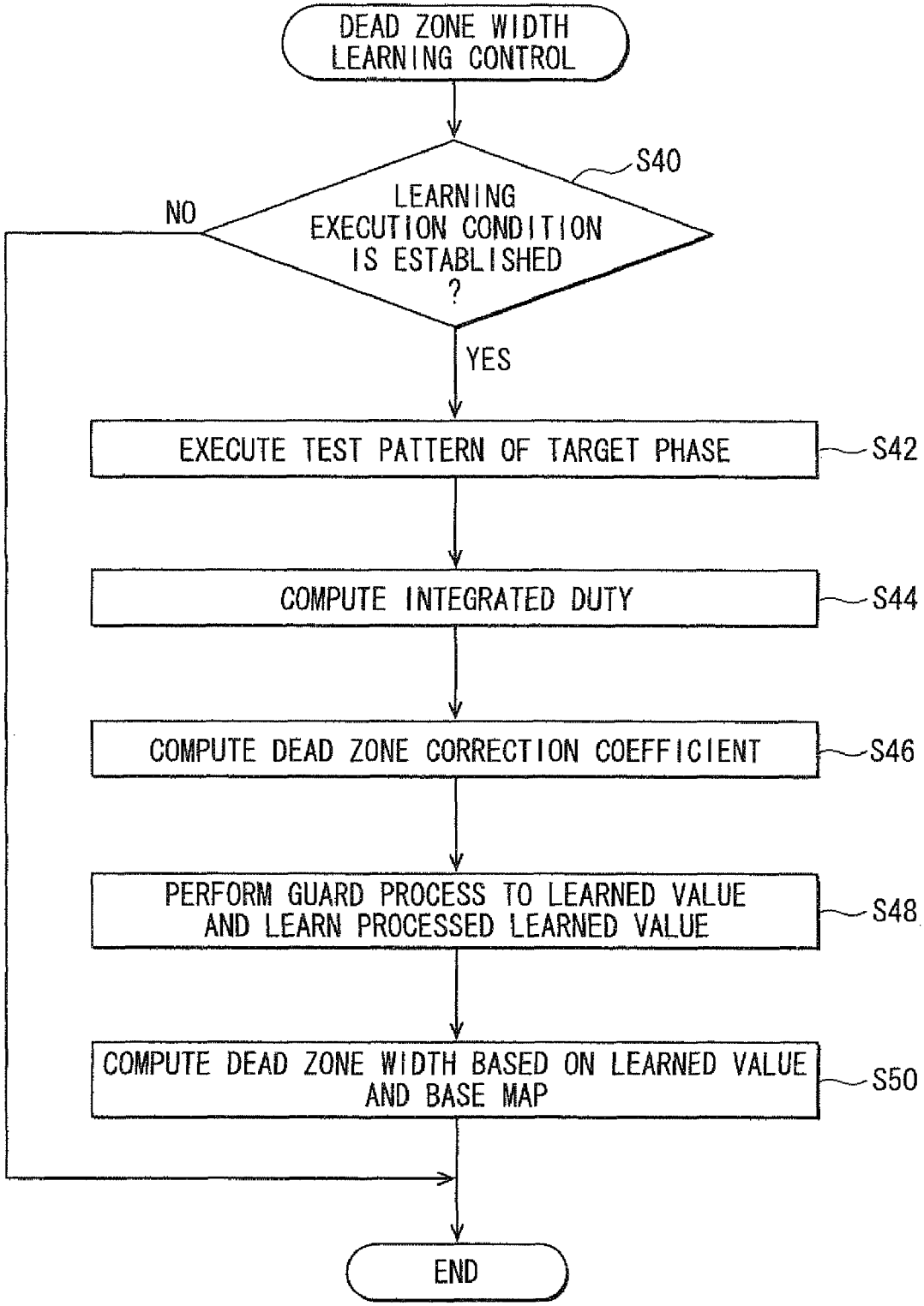
FIG. 6 is a flow chart illustrating a procedure of a dead zone width learning control executed by the microcomputer of the ECU shown in FIG. 1.

Thus, in the present embodiment, firstly, the hold dead zone width is learned, and then the offset correction amount OFD shown in FIG. 3 is computed based on the learned hold dead zone width. A learning operation for learning the hold dead zone width will be described below with reference to a flow chart shown in FIG. 6. It should be noted that the execution of the learning operation shown in FIG. 6 is repeated by the ECU 1040 at predetermined intervals, for example.

In the series of steps in the learning operation, firstly, it is determined at step S40 whether a learning execution condition is established. The learning execution condition includes the followings, for example.

Condition (a). Coolant temperature detected by the coolant temperature sensor 1054 is about a specified temperature THW0 that is equal to or smaller than 0° C.

Condition (b). An estimated value of the hydraulic oil temperature is generally indicates the coolant temperature.

Condition (c). Duration of the stopping of the engine immediately before the starting of the engine in the present operation is equal to or greater than a predetermined time Tr. The predetermined time Tr is set equal to or greater than a time required for achieving a thermal equilibrium state of the hydraulic oil with surroundings after the stopping of the engine in the previous operation.

Condition (d). The rotational speed is about a predetermined speed NE0.

The above conditions (a) to (c) are used for determining whether thermal equilibrium state of hydraulic oil with the surroundings is achieved. In other words, the above conditions (a) to (c) determines whether a present operational state is capable of achieving a high degree of accuracy in the estimation of the hydraulic oil temperature. In the conventional method for estimating the hydraulic oil temperature in general, an error of "±several degrees to several degrees over twenty" may occur. As shown in FIG. 5, the response characteristic may widely change in the temperature width. Therefore, the achievement of thermal equilibrium state needs to be satisfied in order to accurately estimate temperature of hydraulic oil of the variable valve timing adjustment mechanism 1020 and the OCV 1030. When the above conditions are satisfied, it is possible to highly accurately express temperature of hydraulic oil by using the coolant temperature. It should be noted that an oil temperature sensor 1058 for detecting temperature of hydraulic oil may be provided as shown by the dashed and single-doffed line of FIG. 1, and in the above case, the determination in step S40 may be replaced with the determination of whether the detection value by the oil temperature sensor 1058 remains at a constant value for more than a predetermined time period.

Figures 7A, 7B, 7C:
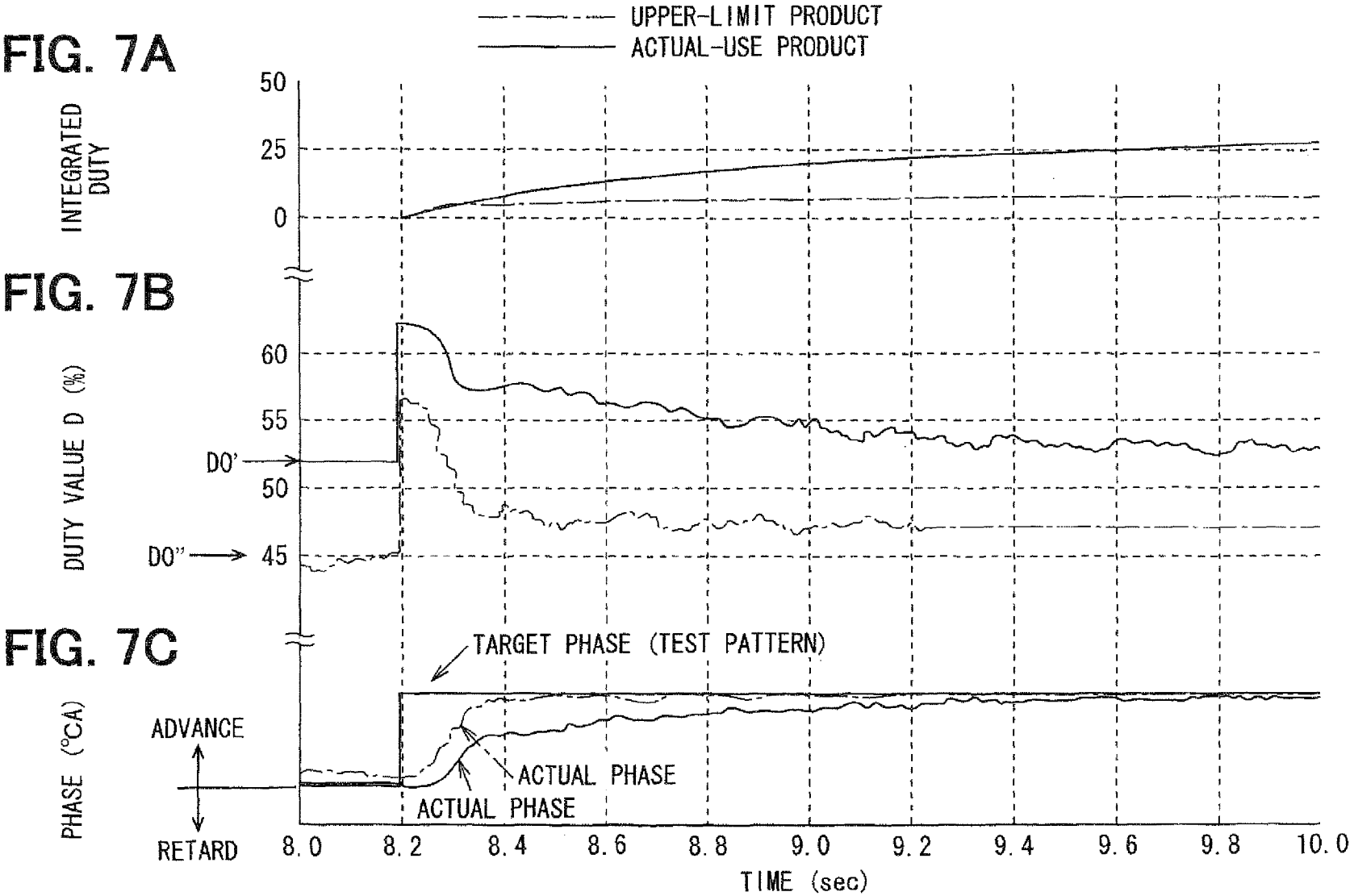
FIG. 7A is a chart illustrating behavior of integrated duties of an actual-use product and an upper-limit product with elapsed time.
FIG. 7B is a chart illustrating behavior of duty values of the actual-use product and the upper-limit product with elapsed time.
FIG. 7C is a chart illustrating behavior of phases of the actual-use product and the upper-limit product with elapsed time.

At step S42, a target phase is changed in accordance with a preset test pattern regardless of the target value computed in step S10 in FIG. 3. Specifically, as shown in a solid line of FIG. 7C, in the test pattern, the target phase is changed stepwise by a predetermined amount. In other words, the present value of the target phase is changed to a predetermined value stepwisely. In the example of FIG. 7C, the target phase is changed in the advance direction.

Solid lines shown in FIGS. 7A to 7C show behaviors of various operational values of an actual-use product that is a target of the learning operation of the valve timing adjustment mechanism 1020. Dashed and single-dotted lines in FIGS. 7A to 7C show behaviors of various operation of a reference product that is another valve timing adjustment mechanism different from the actual-use product. It should be noted that the reference product employs the upper-limit product shown by the solid line in FIG. 5 in the present embodiment. When the target phase is changed stepwise at step S42, the feed-back control shown in FIG. 3 changes the duty value D as shown in FIG. 7B. The numerals D0' and D0" shown in FIG. 7B indicate hold duty values for the actual-use product and the upper-limit product, respectively.

The inventors found out that as the dead zone width becomes larger, each of integrated values (integrated Duties) for the upper-limit product and the actual-use product becomes larger. Each of integrated values is made by integrating differences between the hold the duty value D0', D0" and the duty value D that is changed along the test pattern. FIG. 7A shows a trend of the integrated values and shows that when the valve timing adjustment mechanism has a lower responsive performance, the integrated value is likely to result in a larger value. This means that when the valve timing adjustment mechanism has a larger dead zone width, the integrated value finally becomes a larger value.

Control proceeds to step S44, where the above integrated duty for the actual-use product is computed. It should be noted that a period of time required for the integration begins after the test pattern for the target phase is executed and lasts for a predetermined period. Also, the predetermined interval is set as a period that is long enough to allow the duty value D or the integrated value to converge to reach a certain value. In the present embodiment, the execution of the test pattern for the target phase means that the target phase is stepwisely changed from one value to the other value along the test pattern shown in FIG. 7C.

Figures 8, 9:
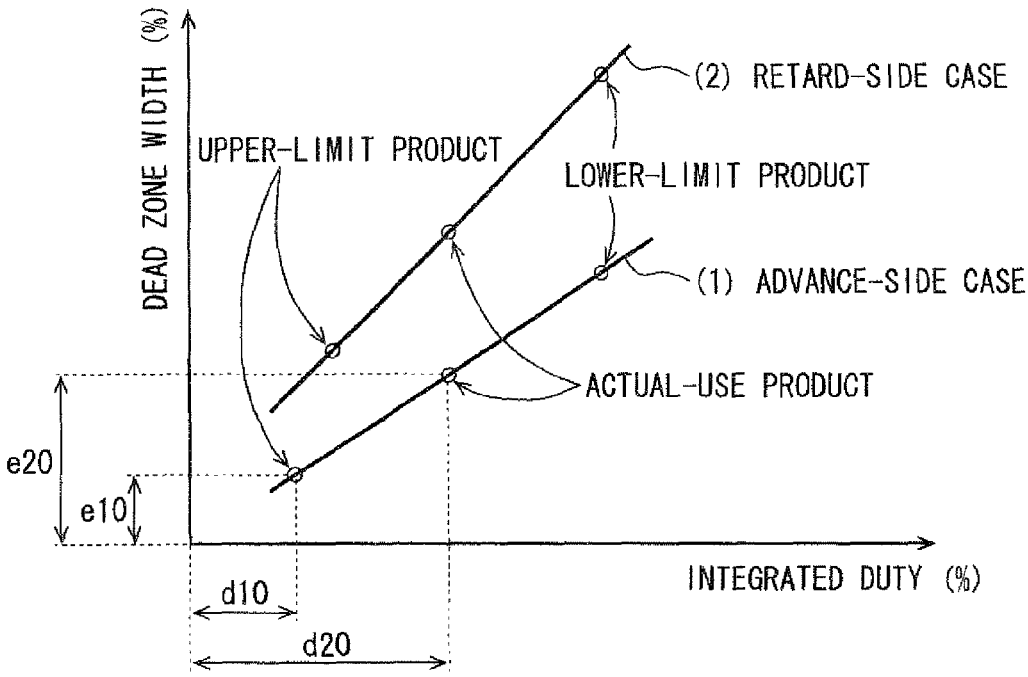
FIG. 8 is a chart for explaining a learned value d20/d10.
FIG. 9 is a chart illustrating a base map used for the dead zone width learning control shown in FIG. 6.

Then, control proceeds to step S46, where a dead zone correction coefficient d20/d10 is computed. The dead zone correction coefficient d20/d10 a ratio of an integrated duty d20 of the actual-use product relative to an integrated duty d10 of the upper-limit product. Solid line (1) in FIG. 8 shows a relation between the dead zone width and the integrated duty in the advance side. Also, solid line (2) in FIG. 8 shows a relation between the dead zone width and the integrated duty in the retard side. The dead zone width of the upper-limit product is indicated by numeral e10, and the dead zone width of the actual-use product is indicated by numeral e20. It should be noted that the computation of the dead zone correction coefficient d20/d10 uses a base map shown in FIG. 9. The base map corresponds to "standard data" and is a result obtained through experiments conducted to the upper-limit product in advance. For example, the standard data has a first standard data segment for the advance side, and a second standard data segment for the retard side as shown in FIG. 9. More specifically, the relations between the integrated duty d10 and the dead zone width e10 for the upper-limit product under different hydraulic oil temperatures are in advance obtained through experiments.

Specifically, at step S44, the integrated duty d20 of the actual-use product is computed based on the duty value D that has been changed along the test pattern. Then, a integrated duty d10, which corresponds to the hydraulic oil temperature at the time of the computation, is retrieved from the base map. The dead zone correction coefficient d20/d10 is computed based on the above retrieved integrated duty d10 and the integrated duty d20 computed in step S44.

Control proceeds to step S48, where the dead zone correction coefficient d20/d10 is set as a learned value, and a guard process is performed to the learned value such that the learned value d20/d10 is limited from becoming an excessively large value. Then, the learned value d20/d10 under the guard process is learned by storing and updating the learned value d20/d10 as a learned value in the memory 1042 (for example, ROM). In the above learning operation, the dead zone correction coefficient d20/d10 is learned only for one hydraulic oil temperature.

Then, control proceeds to step S50, where the dead zone width e20 for the actual-use product is computed based on the learned value d20/d10 learned at step S48 and the base map. Specifically, a dead zone width e10, which corresponds to a hydraulic oil temperature at a time of the execution of the test pattern, is retrieved from the base map at step S42, and the dead zone width e20 for the actual-use product is computed by multiplying the retrieved dead zone width e10 by the learned value d20/d10 Thus, computation equation indicates e20=e10×d20/d10. The dead zone width e20 for the actual-use product is learned as above.

Also, a dead zone width ex for a temperature x, which is different from the hydraulic oil temperature at a time of the execution of the test pattern, is also computed using the base map. Specifically, a dead zone width exmap, which corresponds to the temperature x in the base map, is retrieved, and a dead zone width ex of the actual-use product, which corresponds to each temperature x, is computed by multiplying the retrieved dead zone width exmap by the learned value d20/d10. Thus, the computation equation is indicated by ex=exmap×d20/d10.

It should be noted that when it is determined that the learning execution condition is not established at step S40 or when process at step S50 is completed, the hold dead zone width learning process in FIG. 6 is temporarily finished. Also, the learning operation in FIG. 6 is executed for computation in both the advance side and the retard side. Specifically, at step S42, the target phase is changed stepwise by the predetermined amount in the retard direction, although FIG. 7C only shows that the target phase is changed stepwise by the predetermined amount in the advance direction. Also, at steps S44 to S48, the integration of the integrated duty, the computation of the learned value d20/d10, storing and updating of the learned value, and the computation of the dead zone width e20 are executed for each of cases, in which the target phase is changed in the advance direction and in the retard direction. The base map includes relations of the integrated duty d10 and the dead zone width e10 relative to the hydraulic oil temperature in both cases of the advance side and the retard side.

As described above, the duty value D of the actual-use product is smaller than the duty value D of the upper-limit product because the actual-use product has a dead zone width larger than that of the upper-limit product. As a result, the duty value D required for the upper-limit product is not enough for the duty value D required for the actual-use product. Thus, during the feed-back control shown in FIG. 3, the duty value D needs to be offset-corrected based on the dead zone width e20 for the actual-use product. The offset-correction of the duty value D will be described below. Firstly, the offset correction amount OFD is computed based on the dead zone width e20 the actual-use product obtained through the learning operation shown in FIG. 6. The offset correction amount OFD corresponds to an amount that compensate the deviation between the duty value D of the actual-use product and the duty value D of the upper-limit product. As a result, it is possible to compensate the possible shortage of the duty value D of the actual-use product by adding the offset correction amount OFD to the duty value D of the upper-limit product.

According to the present embodiment, the below advantages are achievable.

(1) Because the integrated duty is highly correlated with the dead zone width while the test pattern is executed, the integrated duty d20 for the actual-use product is used for the computation of the dead zone width for the actual-use product. More specifically, the integrated duty d20 for the actual-use product is computed based first. Then, the dead zone width e20 for the actual-use product is computed based on the above computed integrated duty d20 and based on the corresponding integrated duty d10 and dead zone width e10, which correspond to the hydraulic oil temperature at the time of the computation, and which are retrievable from the base map. Thus, it is possible to precisely compute the dead zone width e20 for the actual-use product, which may otherwise erroneously change in accordance with the product variations, the variation with time, or the hydraulic oil temperature.

Then, because the duty value D is corrected by using the dead zone width e20 that is precisely obtained as above, the relative rotation speed is precisely controlled. As a result, in the feed-back control for controlling the relative rotation angle, the hunting is minimized and at the same time the responsivity is improved by rotating the vane rotor 1022 to the target advance value VCTa. Thereby, the above simple control is capable of quickly adjusting timing of opening and closing the intake or exhaust valves to the desired timing without performing the conventional inching control.

(2) The dead zone width e20 is not directly detected and learned in the present embodiment. However, firstly, the integrated duty d20 that is correlated with the dead zone width e20, is computed, and then, the dead zone correction coefficient d20/d10 based on the computation result is learned. The base map is prepared in advance in the present embodiment, and the base map includes the experimental result about the relation of the integrated duty d10 and the dead zone width e10 of the upper-limit product for different hydraulic oil temperatures. Then, the dead zone width e20 for each hydraulic oil temperature is computed based on the learned dead zone correction coefficient d20/d10 and the hydraulic oil temperature at the time of the learning by referring the base map.

As a result, the dead zone width e20 for each hydraulic oil temperature is computable without directly learning the dead zone width e20. It is possible to easily obtain the dead zone width e20 for each hydraulic oil temperature by computing the integrated duty d20. Furthermore, the learning of the dead zone correction coefficient d20/d10 based on the integrated duty d20 is not required for each hydraulic oil temperature. However, the learning of the dead zone correction coefficient d20/d10 is executed only for one hydraulic oil temperature. Thus, a process load, the memory, and a learning time of the microcomputer required for executing the learning operation are reduced advantageously.

(3) Because the dead zone correction coefficient d20/d10 is learned for the advance side and the retard side, it is possible to precisely compute the dead zone width e20 for each hydraulic oil temperature in the advance side and the retard side. As a result, it is possible to more precisely control the relative rotation speed, and thereby when the relative rotation angle is feed-back controlled, the hunting is minimized and at the same time the vane rotor 1022 is further quickly rotated to the target advance value VCTa.

(4) The dead zone correction coefficient d20/d10 to be learned is limited by the upper and lower limit values. Thus, even when the dead zone width e20 is erroneously learned based on the dead zone correction coefficient d20/d10, the computed dead zone width e20 is limited from exceeding upper and lower limit values. Thus, it is possible to prevent the offset correction amount OFD from becoming excessively large or small accordingly.

Second Embodiment

Similar components of the control system of the present embodiment, which are similar to the components of the control system of the first embodiment, will be indicated by the same numerals, and the explanation thereof will be omitted. In the above first embodiment, the dead zone correction coefficient d20/d10 is learned only for one hydraulic oil temperature. However, in the present embodiment, the test pattern is conducted for each hydraulic oil temperature in order to compute the integrated duty for each hydraulic oil temperature, and then the dead zone correction coefficient d20/d10 is learned for each hydraulic oil temperature. Then, the dead zone width ex of the actual-use product for each hydraulic oil temperature is computed based on the dead zone correction coefficient d20/d10 (learned value) for each hydraulic oil temperature and based on the base map shown in FIG. 9.

According to the present embodiment, because the dead zone correction coefficient d20/d10 is learned for each hydraulic oil temperature, the dead zone width is more precisely and accurately computed advantageously in addition to the advantages achievable in the first embodiment. However, because the number of hydraulic oil temperatures for the learning operation in the present embodiment is greater compared with the first embodiment, the process load, the memory, and the learning time of the microcomputer required for the learning operation are increased accordingly in the present embodiment.

Other Embodiment

Each of the above embodiments may be modified as below. Also, the present invention is not limited to the above embodiments, but the characteristic of each of the embodiments may be combined as required.

In each of the above embodiments, the integrated duty of the change of the duty value D caused by the execution of the test pattern corresponds to "a parameter correlated with the dead zone width", and the dead zone correction coefficient d20/d10 obtained based on the integrated duty and the base map is learned. However, the learning operation is not limited to the above, but the learning operation may be executed to any coefficient provided that the coefficient is obtainable based on the integrated duty and the base map. For example, the dead zone width e20 may be alternatively learned.

Alternative to the integrated duty, the parameter may employ a difference between the actual advance value VCTr and the target advance value VCTa, which difference is obtained after a predetermined time has elapsed since the execution of the test pattern. In the above alternative case, the difference itself may be directly learned, and an inclination of the difference or an integrated value of the difference may be alternatively learned. There is a correlation, in which as the dead zone width becomes larger, the difference becomes larger, the inclination becomes smaller, and the integrated value becomes larger.

In the first embodiment, the dead zone width is computed from the learned value (the dead zone correction coefficient d20/d10), and the offset correction amount OFD is then computed based on the computed dead zone width. However, the computation or the estimation of the dead zone width at step S50 in FIG. 6 may be alternatively skipped, and the offset correction amount OFD may be directly computed from the learned value. In the above case, it is not required to store the dead zone width e10 in the base map, and thus, the memory is required to only store a physical quantity similar to the learned value or a coefficient obtained from the physical quantity for each oil temperature. Due to the above, it is possible to compute the offset correction amount OFD based on the deviation between the learned value for a certain oil temperature and the physical quantity in the base map.

The base map according to the first embodiment stores the relations between the integrated duty and the dead zone width in the advance side and in the retard side. However, alternatively, the base map may store only the relation of one of the advance and retard sides. In the above case, it may be assumed that the dead zone width of the other one of the advance and retard sides is identical with the dead zone width of the stored one of the advance and retard sides. Also, the dead zone width of the other side may be alternatively obtained by multiplying the dead zone width of the one side by a predetermined coefficient or may be obtained by adding a predetermined factor to the dead zone width of the one side.

The base map according to the first embodiment stores various values for each oil temperature associated with another valve timing adjustment mechanism serving as the reference product to be referred. More specifically, the reference product employs the upper-limit product that is assumed to have a highest response characteristic among the manufactured and shipped valve timing adjustment mechanisms. In contrast to the above, the reference product may alternatively employ another adjustment mechanism (nominal product) having an average response characteristic, or may employ the lower limit product. Thus, in the above alternative case, the base map stores various values of the nominal product and the lower limit product for each oil temperature.

The internal combustion engine is not limited to the spark ignition internal combustion engine, such as a gasoline engine. However, the internal combustion engine may be a compression ignition internal combustion engine, such as a diesel engine.

Third Embodiment

The third embodiment of the present invention will be described.

A valve timing control apparatus for the internal combustion engine according to the third embodiment of the present invention will be described with reference to accompanying drawings.

Firstly, general schematic configuration of a system will be described by referring to FIG. 10.

An engine 11 is an internal combustion engine and includes a crankshaft 12, a timing chain 13 (or a timing belt), sprockets 14, 15, an intake-side camshaft 16, and an exhaust-side camshaft 17. The crankshaft 12 transmits a drive force to the intake-side camshaft 16 and the exhaust-side camshaft 17 through the timing chain 13 and the sprockets 14, 15. The intake-side camshaft 16 is provided with a variable valve timing apparatus 18 (variable valve mechanism) that changes valve timing (valve opening-closing characteristic) of an intake valve (not shown) by changing a rotational phase (or camshaft phase) of the intake-side camshaft 16 relative to the crankshaft 12. The variable valve timing apparatus 18 has an oil pressure circuit, to which an oil pump 20 supplies hydraulic oil in an oil pan 19. By causing a hydraulic control valve 21 to control oil pressure in the oil pressure circuit, the valve timing (or a timing advance value) of the intake valve is controlled.

Also, a cam angle sensor 22 is provided at a position radially outward of the intake-side camshaft 16 and outputs cam angle signals at multiple cam angles for cylinder recognition. A crank angle sensor 23 is provided at a position radially outward of the crankshaft 12 and outputs a crank angle signal at every predetermined crank angle. The output signals outputted by the cam angle sensor 22 and the crank angle sensor 23 are inputted into an engine control circuit (ECU) 24. The ECU 24 computes actual valve timing of the intake valve and computes an engine rotation speed based on a frequency of an output pulse of the signals outputted by the crank angle sensor 23.

Also, the ECU 24 receives output signals outputted by an accelerator sensor 44, an intake air amount sensor 45, a coolant temperature sensor 46, and an oil temperature sensor 47. The ECU 24 detects an operational state of the engine 11 based on the various signals from the sensors and executes a fuel injection control and an ignition control in accordance with the engine operational state. Also, the ECU 24 executes a valve timing control to feed-back control the variable valve timing apparatus 18 and to feed-back control the hydraulic control valve 21 such that actual valve timing of the intake valve becomes target valve timing. In other words, the ECU 24 executes the valve timing control such that an actual camshaft phase of the intake-side camshaft 16 becomes a target camshaft phase of the intake-side camshaft 16. Also, the ECU 24 includes a ROM 41, a RAM 42, and a back-up RAM 43 (SRAM). The ROM 41 serves as a nonvolatile storage unit that stores data items, such as various programs, maps, constants, and flags. The RAM 42 temporarily stores computation data. The back-up RAM 43 serves as a rewritable nonvolatile memory that is capable of keeping stored data by the assist of a battery as a power source even when the engine is stopped.

Next, a configuration of the variable valve timing apparatus 18 will be described with reference to FIG. 10 and FIG. 11. As shown in FIG. 11, the sprocket 14 is rotatably supported at a position radially outward of the intake-side camshaft 16, and the variable valve timing apparatus 18 has a housing 25 that is fixed to the sprocket 14 through a bolt 26. Thus, rotation of the crankshaft 12 is transmitted to the sprocket 14 and the housing 25 through the timing chain 13, and thereby the sprocket 14 and the housing 25 rotate synchronously with the crankshaft 12. In contrast, the intake-side camshaft 16 has one end portion that is fastened to a rotor 27 by a stopper 28 and a bolt 29. The stopper 28 is provided between the rotor 27 and the bolt 29, and the rotor 27 is received in the housing 25 such that the rotor 27 is rotatable relative to the housing 25.

Figure 10:
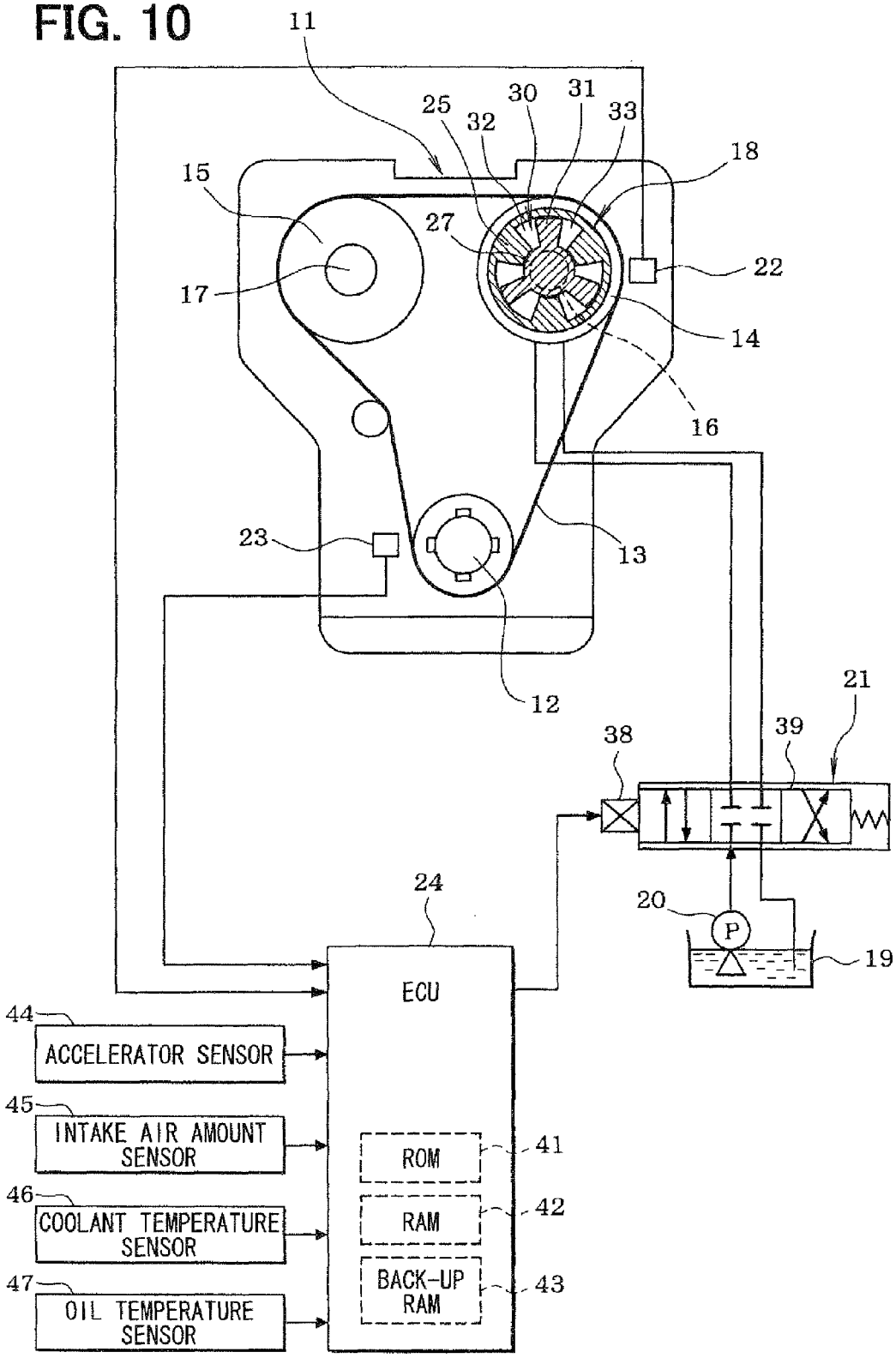
FIG. 10 is a drawing schematically illustrating a variable valve timing control arrangement according to the third embodiment of the present invention.
Figure 11:
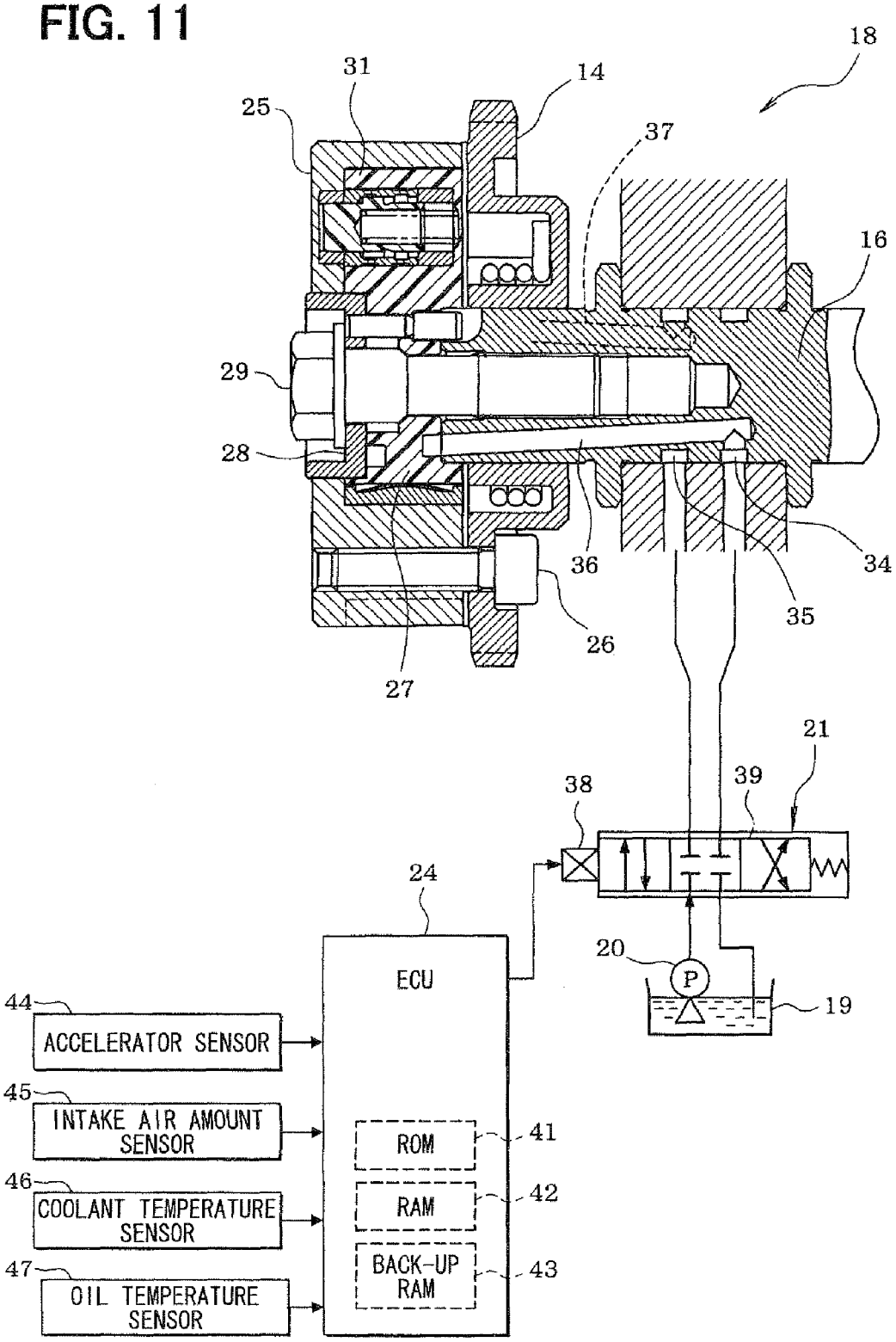
FIG. 11 is a longitudinal cross-sectional view of a variable valve timing apparatus of the third embodiment.

As shown in FIG. 10, the housing 25 defines therein multiple fluid chambers 30, each of which is divided into an advance chamber 32 and a retard chamber 33 by a corresponding one of vanes 31 provided at a radially outer surface of the rotor 27.

Also, as shown in FIG. 11, the engine 11 provides a drive force to drive the oil pump 20, and the oil pump 20 pumps hydraulic oil from the oil pan 19 to supply the hydraulic oil to an advance groove 34 and a retard groove 35 of the intake-side camshaft 16 through the hydraulic control valve 21. The advance groove 34 is connected with an advance oil passage 36 that is communicated with each advance chamber 32. In contrast, the retard groove 35 is connected with a retard oil passage 37 that is communicated with each retard chamber 33.

In a state, where the advance chamber 32 and the retard chamber 33 receives oil pressure over a predetermined pressure, the position of the vane 31 is fixed in the fluid chamber 30 by oil pressure in the advance chamber 32 and by oil pressure in the retard chamber 33. Accordingly, rotation of the housing 25 caused by rotation of the crankshaft 12 is transmitted to the rotor 27 (the vane 31) through hydraulic oil, and thereby the intake-side camshaft 16 is rotated integrally with the rotor 27. After the engine is stopped, oil pressure in the housing 25 decreases, and a lock pin (not shown) provided at the vane 31 is fitted into a lock hole (not shown) of the housing 25 by a spring force. Thereby, the vane 31 is accordingly locked to the housing 25 at a reference position (for example, a full retard position, an intermediate position), which is suitable for starting the engine. When oil pressure is raised equal to or greater than a predetermined oil pressure, which is large enough for unlocking the lock pin, after the engine is started, the oil pressure pushes the lock pin out of the lock hole such that the lock pin is unlocked. As a result, the rotor 27 becomes rotatable relative to the housing 25, and accordingly valve timing becomes changeable.

The hydraulic control valve 21 includes a linear solenoid 38 and a valve element 39. The hydraulic control valve 21 changes an amount of hydraulic oil that is supplied to each advance chamber 32 and each retard chamber 33 by driving the valve element 39 based on an electric current supplied to the linear solenoid 38 such that continuously changing an opening degree of each oil pressure port. As a result, the housing 25 and the rotor 27 (the vane 31) are rotated relative to each other, and thereby the rotational phase or the camshaft phase of the intake-side camshaft 16 relative to the crankshaft 12 is changed for changing valve timing of the intake valve.

During the operation of the engine, the ECU 24 feed-back controls the hydraulic control valve 21 of the variable valve timing apparatus 18 such that actual valve timing of the intake valve (actual camshaft phase of the intake-side camshaft 16) becomes target valve timing (target camshaft phase of the intake-side camshaft 16). In the description below, "variable valve timing apparatus" is referred as "VCT".

Figure 12A:
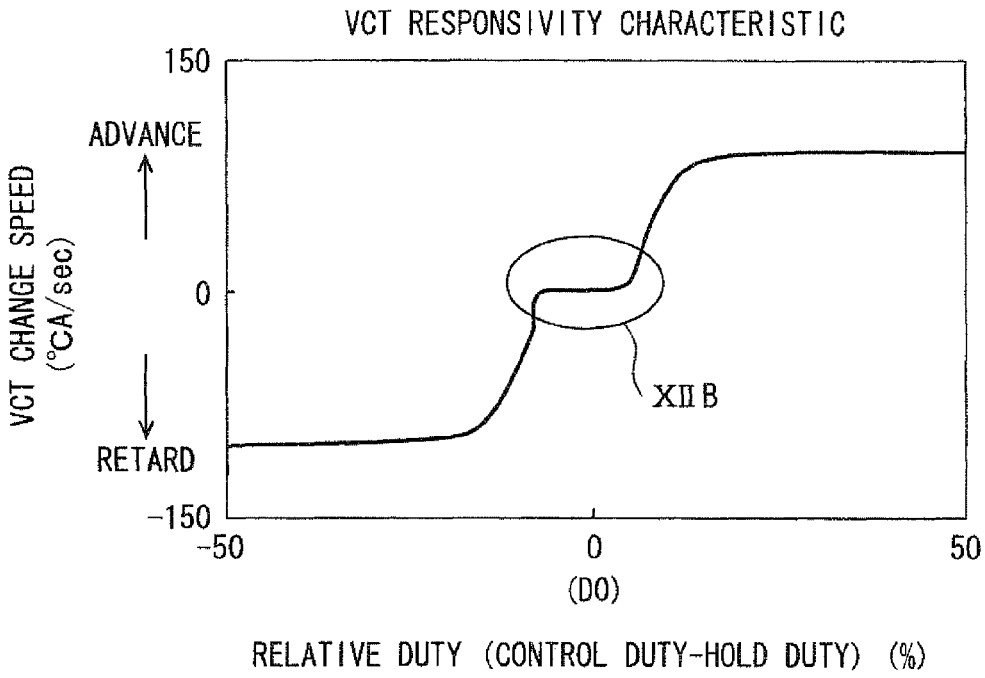
FIG. 12A is a VCT response characteristic diagram illustrating a relation between a relative duty and a VCT change speed.
Figure 12B:
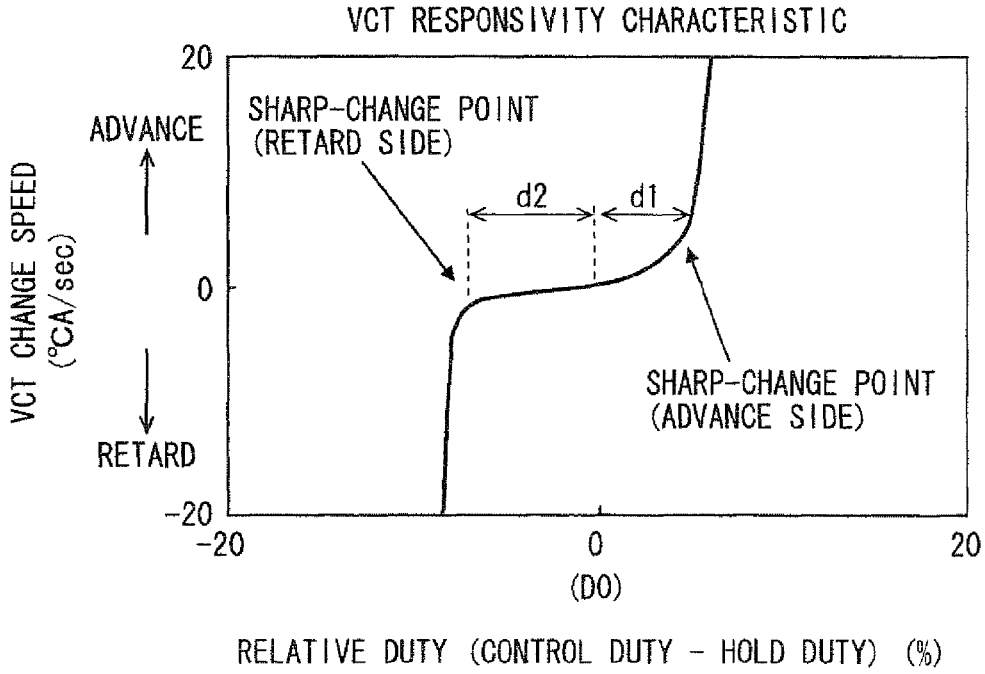
FIG. 12B is an enlarged view illustrating a part of the VCT response characteristic diagram of FIG. 12A, the part located in a vicinity of a hold duty.

In general, FIGS. 12A and 12B shows a relation between a control duty and a change speed of actual valve timing of the VCT 18 (hereinafter referred as "VCT change speed"). As shown in FIGS. 12A and 12B, there are dead zones d1, d2 around a hold duty D0 (hold control amount) for maintaining the actual valve timing at target valve timing (target value). More specifically, when the control duty changes within the dead zones d1, d2, the VCT change speed remains around 0, and thereby the valve timing of the VCT 18 hardly reacts to the control duty or hardly moves. The dead zone d1 is on the advance side of the hold duty, and the dead zone d2 is on the retard side of the hold duty. As shown in FIG. 12B, the VCT change speed sharply changes when the relative duty goes beyond the sharp-change point on the advance side or the sharp-change point on the retard side, for example. An abscissa axis in FIGS. 12A and 12B indicates a relative duty that corresponds to a difference between the control duty and the hold duty D0 ("relative duty"="control duty"−"hold duty D0"). Note that even when the abscissa axis in FIGS. 12A and 12B alternatively indicates the control duty instead of the relative duty, characteristic of the VCT change speed is expressed by a curved line substantially the same with the curved lines currently shown in FIGS. 12A and 12B.

There is an advance-side region located on an advance side of the dead zone d1, and the VCT change speed in the advance direction is increased in accordance with the control duty (relative duty) when the control duty is within the advance-side region. Furthermore, there is a saturated-advance-side region that is located on the advance side of the advance-side region, and the VCT change speed remains constant at a maximum value when the control duty is within the saturated-advance-side region. There is a retard-side region located on a retard side of the dead zone d2, and the VCT change speed in the retard direction is increased in accordance with the control duty (relative duty) when the control duty is within the retard-side region. In FIGS. 12A and 12B, the advance direction indicates a positive value in an ordinate axis and the retard direction indicates a negative value. Thus, when the VCT change speed in the retard direction is increased, the VCT change speed that is negative is increased in an absolute value accordingly. There is also a saturated-retard-side region located on the retard side of the retard-side region. The VCT change speed remains constant when the control duty is within the saturated-retard-side region.

Figure 13A:
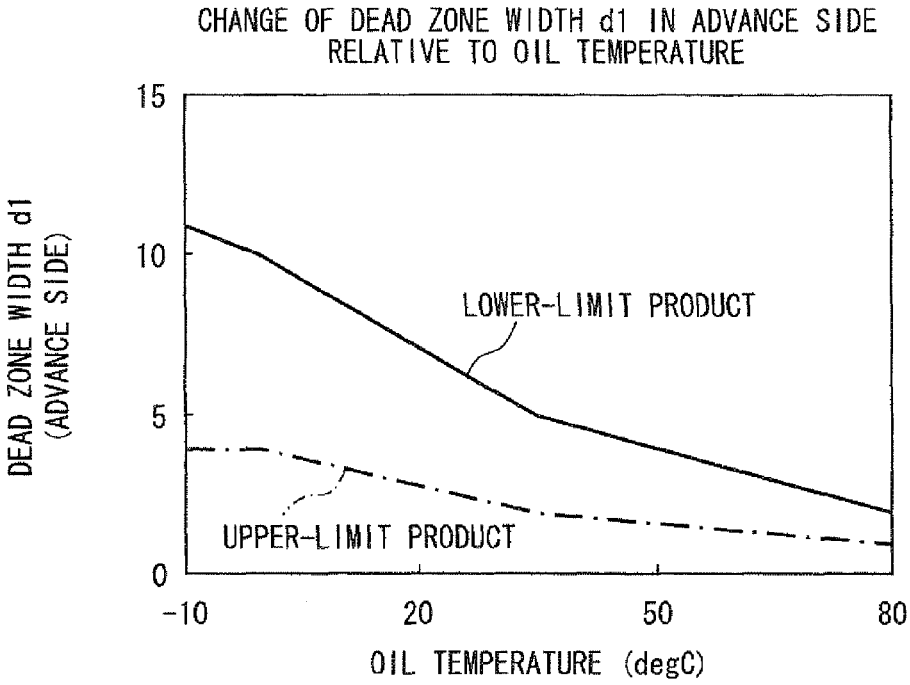
FIG. 13A is a chart illustrating a relation between a dead zone width and a hydraulic oil temperature for upper and lower limit products of the VCT in an advance side.
Figure 13B:
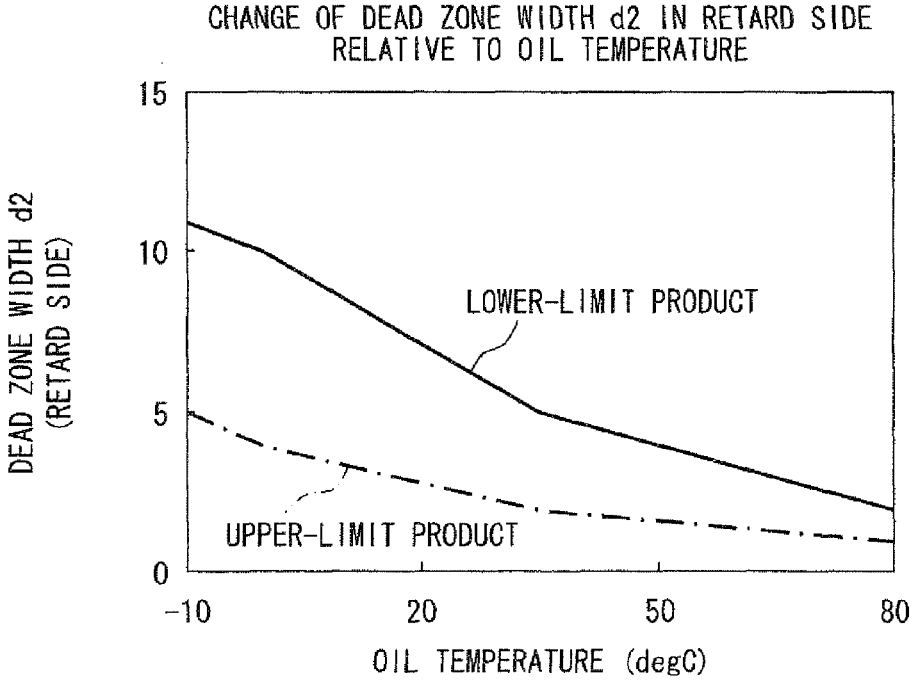
FIG. 13B is a chart illustrating a relation between the dead zone width and the hydraulic oil temperature for the upper and lower limit products of the VCT in a retard side.

In contrast, FIG. 13A indicates a relation between the dead zone width and the hydraulic oil temperature for upper and lower limit products of the VCT 18 in the advance side. FIG. 13B indicates a relation between the dead zone width and the hydraulic oil temperature for the upper and lower limit products of the VCT 18 in the retard side. Thus, each of FIGS. 13A and 13B show a variable range of the responsivity of the VCT 18, which is defined by the upper and lower limit products. In FIGS. 13A and 13B, the dashed and single-dotted line indicates a dead zone width of the upper-limit product that has a highest responsivity among the variable range of responsivity for the VCT 18. Also, solid line indicates a dead zone width of the lower limit product having a lowest responsivity among the variable range of responsivity. More specifically, FIG. 13A shows characteristic of the dead zone width d1 relative to the oil temperature in the advance side, and FIG. 13B shows characteristic of the dead zone width d2 relative to the oil temperature in the retard side. FIGS. 13A and 13B show that even for the same oil temperature, the dead zone widths d1, d2 are slightly different from each other. The dead zone width changes in accordance with the responsivity of the VCT 18. Also, the dead zone width of the upper-limit product and of the lower limit product is increased as the oil temperature decreases. Furthermore, as the oil temperature decreases, a difference between the dead zone width of the upper-limit product and the dead zone width of the lower limit product is increased.

Figures 14A, 14B, 14C:
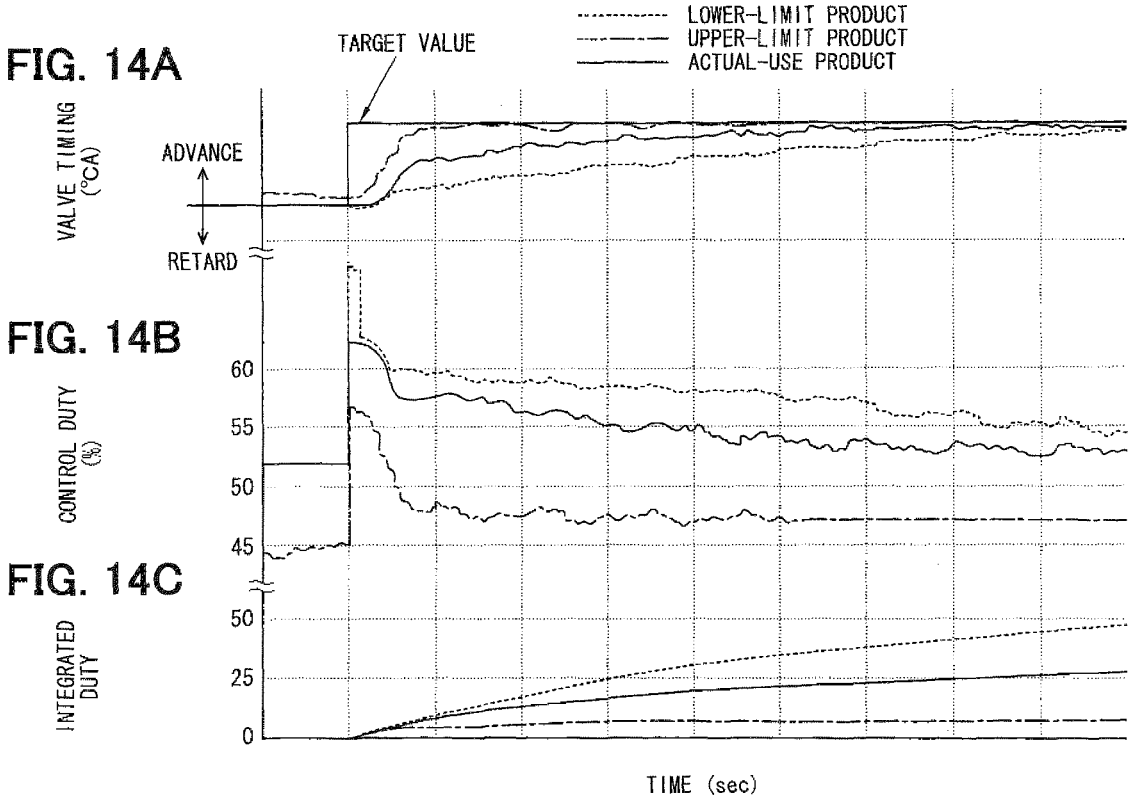
FIG. 14A is a timing chart illustrating a behavior of valve timing during a learning operation.
FIG. 14B is a timing chart illustrating a behavior of a control duty during the learning operation.
FIG. 14C is a timing chart illustrating a behavior of an integrated duty during the learning operation.

FIG. 14A is a timing chart illustrating a behavior of valve timing during a learning operation. FIG. 14B is a timing chart illustrating a behavior of a control duty during the learning operation. FIG. 14C is a timing chart illustrating a behavior of an integrated duty during the learning operation. Also, FIGS. 14A to 14C show the variable range of the responsivity of the VCT 18 for each of valve timing, the control duty, and the integrated duty. In the learning operation, the target value of the valve timing of the VCT 18 is stepwisely changed from a first value to a second value in a state, where the actual valve timing is maintained at the target value of the first value. The integrated duty corresponds to an integrated value of the relative duty (=difference between the control duty and the hold duty), and the integrated duty serves as a "dead zone width correlation parameter".

Figure 15:
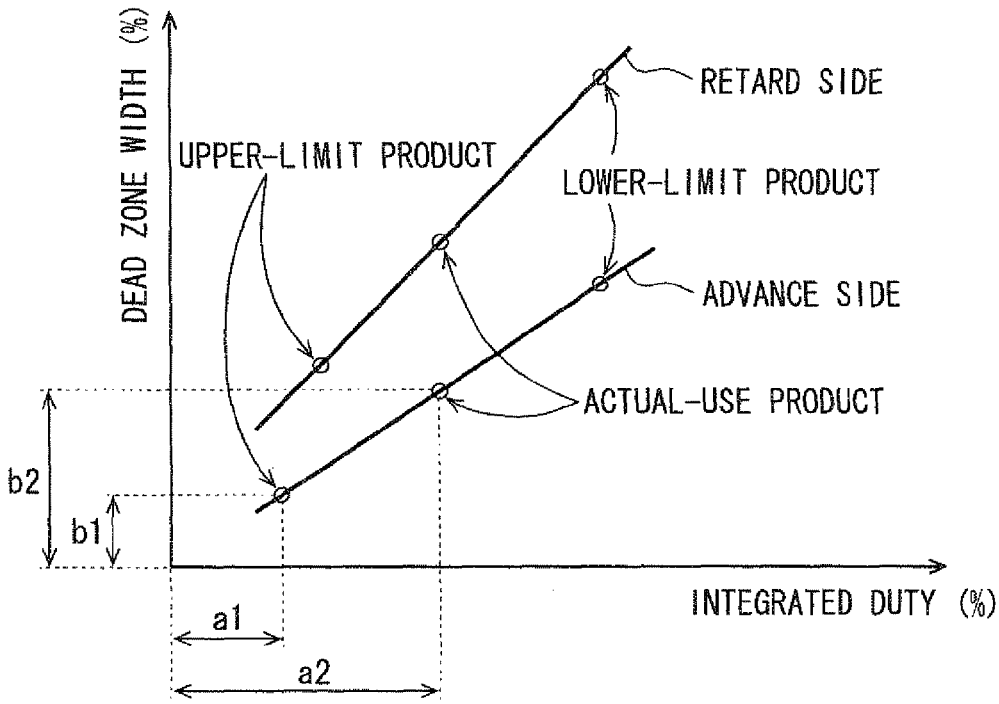
FIG. 15 is a diagram for explaining a correlation between the integrated duty and the dead zone width.

The actual valve timing changes with the change of target value by a certain delay in according with the responsive performance of the VCT 18. Thus, in a case, where the responsivity of the VCT 18 is lower, the latency or delay becomes larger. As a result, when the responsivity of the VCT 18 becomes lower, the difference between the target value and the actual valve timing remains greater than a certain value for a certain time period. Accordingly, the integrated duty becomes larger if the responsivity of the VCT 18 is lower. FIG. 15 shows a relation between the integrated duty and the dead zone width, and there is a correlation between the integrated duty and the dead zone width as shown in FIG. 15. When the integrated duty becomes larger, the dead zone width becomes larger. Even for the same integrated duty, the dead zone width while the VCT 18 is driven in the advance direction is different from the dead zone width while the VCT 18 is driven in the retard direction.

In the present embodiment, when a predetermined condition for executing a dead zone width learning process is established, the integrated duty is computed during a period before a predetermined learning time elapses since the target value is forcibly stepwisely changed. The integrated duty corresponds to a parameter that is correlated with the dead zone width (hereinafter referred as "dead zone width correlation parameter"). Then, the dead zone is learned based on the integrated duty. After the learning operation has been completed, the control duty of the VCT 18 is offset-corrected based on the learned value of the dead zone to drive the VCT 18 when the target value is changed.

Further, in the present embodiment, for example, an integrated duty a1 and a dead zone width b1 for the upper-limit product that serves as the reference product are computed in advance based on experiments or simulation during designing of the products. Thus, the data items associated with the integrated duty a1 and the dead zone width b1 are prestored in a nonvolatile storage unit, such as the ROM 41 of the ECU 24 during the manufacturing of the products. Then, a learning correction coefficient related with a ratio a2/a1 is computed based on a learned integrated duty a2 for the actual-use product and the integrated duty a1 of the upper-limit product retrieved from the ROM 41. The dead zone width b1 (dead zone width base value) for the upper-limit product is corrected by the above learning correction coefficient in order to compute a dead zone width b2 for the actual-use product. Then, the control duty of the VCT 18 is offset-corrected in accordance with the dead zone width b2.

$$\text{dead zone width } b2 = \text{dead zone width base value} \times \text{learning correction coefficient}$$

The responsivity reference product is not limited to the upper-limit product. For example, the responsivity reference product may employ the lower limit product or a intermediate product having a intermediate or average responsivity.

Also, because the dead zone width changes with the oil temperature as shown in FIGS. 13A and 13B, the integrated duty a1 and the dead zone width b1 of the responsivity reference product for each temperature section of the oil temperature or the other temperature correlated with the oil temperature are computed in advance in the designing phase of the product. The oil temperature and the other temperature correlated with the oil temperature correspond to a "oil temperature parameter". The other temperature may be, for example, a temperature of coolant. In the manufacturing phase of the product, the nonvolatile storage unit, such as the ROM 41 of the ECU 24, prestores data sets (see FIG. 17) of the integrated duty a1 and the dead zone width b1 for each temperature section. Then, the learning correction coefficient that corresponds to the ratio a2/a1 is computed based on a learning correction coefficient map shown in FIG. 18. More specifically, a2 indicates the learned integrated duty a2 of the actual-use product, and a2 indicates the integrated duty a1 of the upper-limit product, which is retrieved from the ROM 41, and which corresponds to the temperature section of a present oil temperature. Then, the dead zone width b1 (dead zone width base value) of the upper-limit product, which is retrieved from the ROM 41, and which corresponds to the temperature section of the present oil temperature, is corrected by the learning correction coefficient to compute the dead zone width b2 of the actual-use product. Thus, the dead zone width b2 is learned for each temperature section.

Furthermore, in the present embodiment, because the dead zone width varies even for the same integrated duty depending on whether the VCT 18 is driven in the advance direction or in the retard direction, the integrated duty a1 and the dead zone width b1 for the upper-limit product are computed in advance in the designing phase of the product for both driving directions (the advance and retard directions). Then, in the manufacturing phase of the product, the computed data sets (see FIG. 17) of the integrated duty a1 and the dead zone width b1 are stored in the nonvolatile storage unit. Then, an advance-side learning operation and a retard-side learning operation are executed. More specifically, in the advance-side learning operation, the target value is forcibly changed in the advance direction in order to compute the integrated duty in the advance side such that a value of the dead zone width in the advance side is learned Also, in the retard-side learning operation, the target value is forcibly changed in the retard direction in order to compute the integrated duty in the retard side such that a value of the dead zone width in the retard side is learned. After the above learning operations have been completed, the learned value of the control duty of the VCT 18 is offset-corrected based on the above learned value of the dead zone width in the advance side when the target value is changed in the advance direction. In contrast, when the target value is changed in the retard direction, the control duty of the VCT 18 is offset-corrected based on the above learned value of the dead zone width in the retard side.

Figure 16:
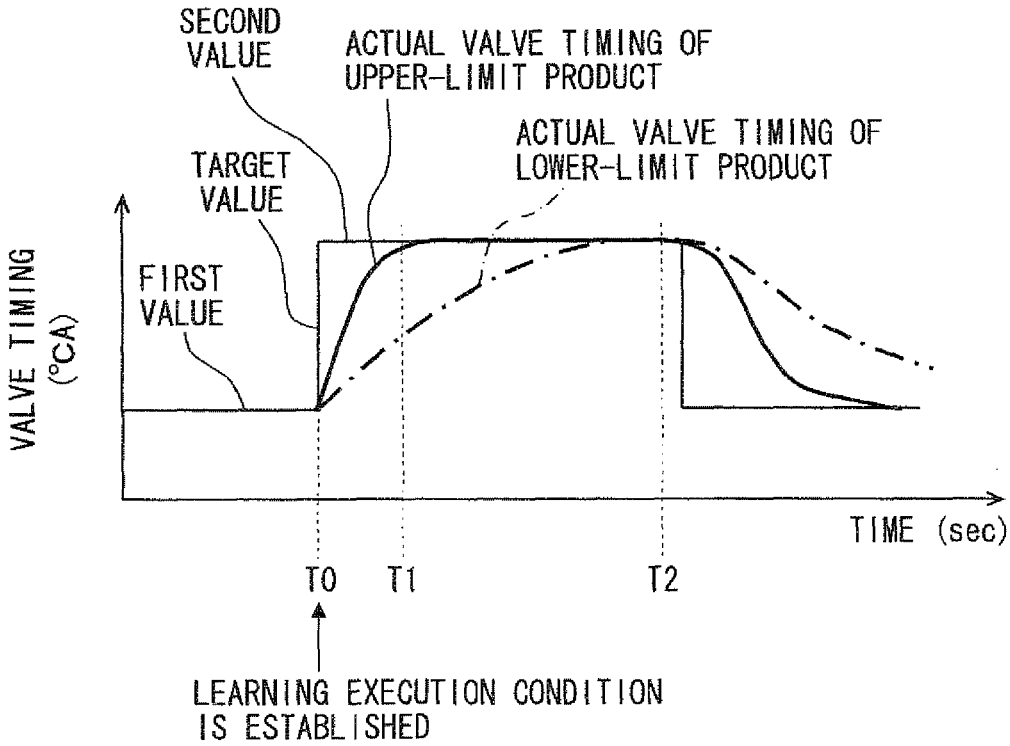
FIG. 16 is a diagram illustrating a behavior of a relation between (a) target valve timing and (b) actual valve timing and (b) for explaining a variable range of responsivity of the VCT during the learning operation.

As described above, in the present embodiment, when the predetermined dead zone width learning execution condition is established, the target value is forcibly changed as shown in FIG. 16 from the first value to the second value. The relative duty (the difference between the control duty and the hold duty) is integrated for a predetermined learning time since a time of forcibly changing the target value (time point T0). For example, when time is T0, the target value is equal to or less than the first value. When the predetermined learning time has elapsed, the integration of the integrated duty (the integrated value of the relative duty) is finished, and the thus-computed integrated duty is used as the dead zone width correlation parameter. In the above case, after the actual valve timing of the VCT 18 has reached the target value (second value of the target value) set by the forcible change from the first value, the control duty of the VCT 18 is maintained around the hold duty. As a result, the relative duty becomes nearly zero, and the integrated duty (the integrated value of the relative duty) remains substantially the same after the actual valve timing of the VCT 18 has reached the target value set by the forcible change. Considering the above, the learning time is set equivalent to a certain time required for the actual valve timing to become the target value set by the forcible change. Thus, there is no need to learn the integrated duty for more than the above certain time period.

In view of the above, in the present embodiment, the learning time is set within a range equal to or greater than a first time period (T1-T0) and equal to or less than a second time period (T2-T0). More specifically, when the target value is forcibly changed, it takes the first time period for the actual valve timing of the upper-limit product to reach the changed target value or to reach the second value from the first value. Also, when the target value is forcibly changed as above, it takes the second time period for the actual valve timing of the lower limit product to reach the changed target value. When the learning time becomes longer within the above range, the correlation between the dead zone width and the integrated duty becomes higher, and thereby the learning accuracy in the learning operation is effectively improved. This is because the responsivity (characteristic) of the actual-use product, which is a target of the learning operation, varies within the variable range of the responsivity from that of the upper-limit product to that of the lower limit product. Furthermore, because as the learning time becomes longer, the learning operation is more likely to be cancelled even during the execution of the learning operation due to the dissatisfaction of the dead zone width learning execution condition. Thus, in order to increase the frequency of executing the learning operation, the learning time is shortened as much as possible within the above range.

Furthermore, because the dead zone width (responsivity) changes depending on whether the VCT 18 is driven in the advance direction or in the retard direction, the time period required for the actual valve timing to become the target value set by the forcible change depends on whether the VCT 18 is driven in the advance direction or in the retard direction. Thus, in the present embodiment, the learning time is individually preset for the case of the advance side and for the other case of the retard side in accordance with the dead zone width (responsivity) in the advance side and in the retard side. Then, the data of the above learning time in accordance with the dead zone width is stored in the nonvolatile storage unit, such as the ROM 41 of the ECU 24.

Figure 19:
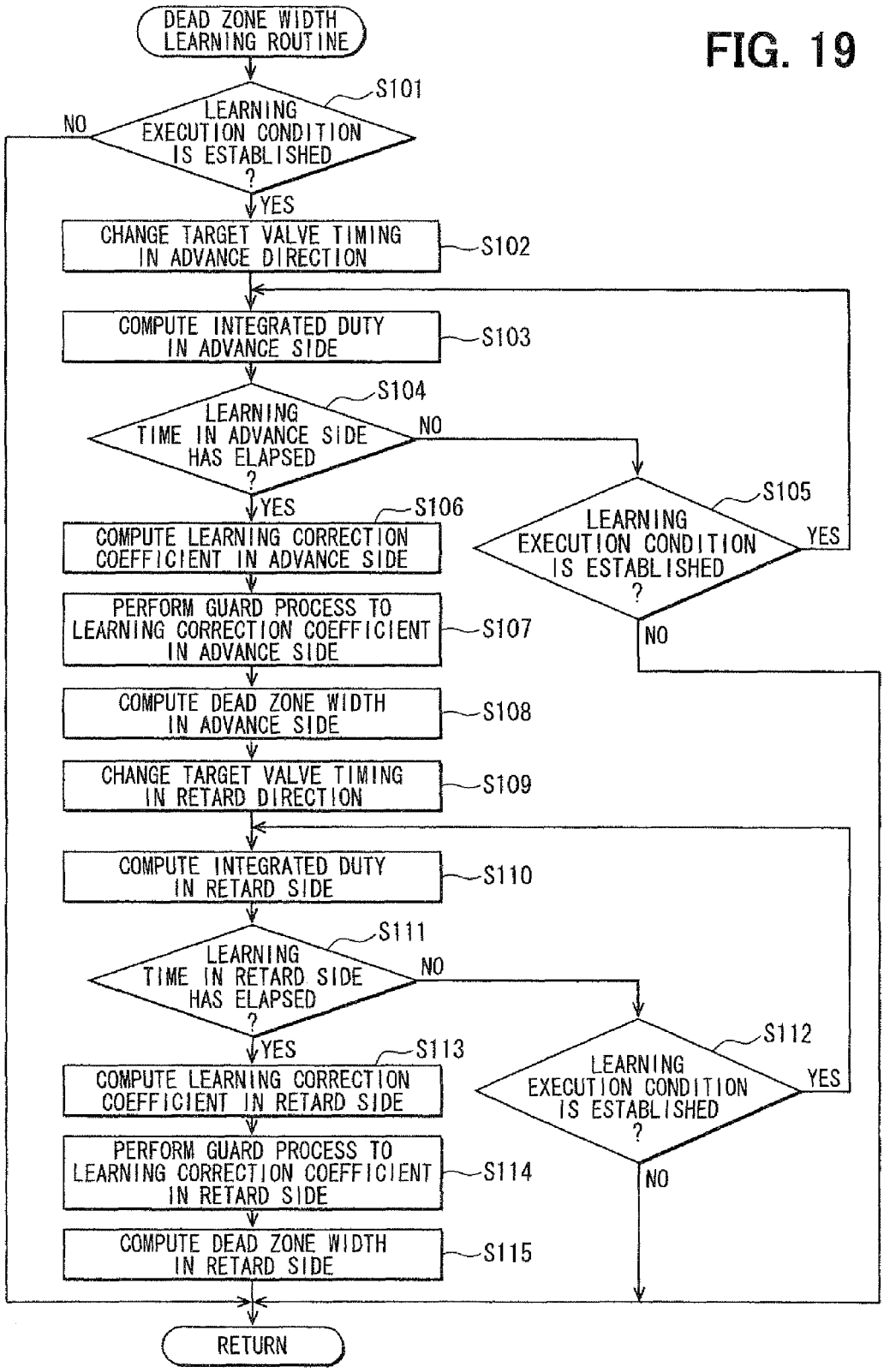
FIG. 19 is a flow chart for explaining a procedure of a dead zone width learning routine.
Figure 20:
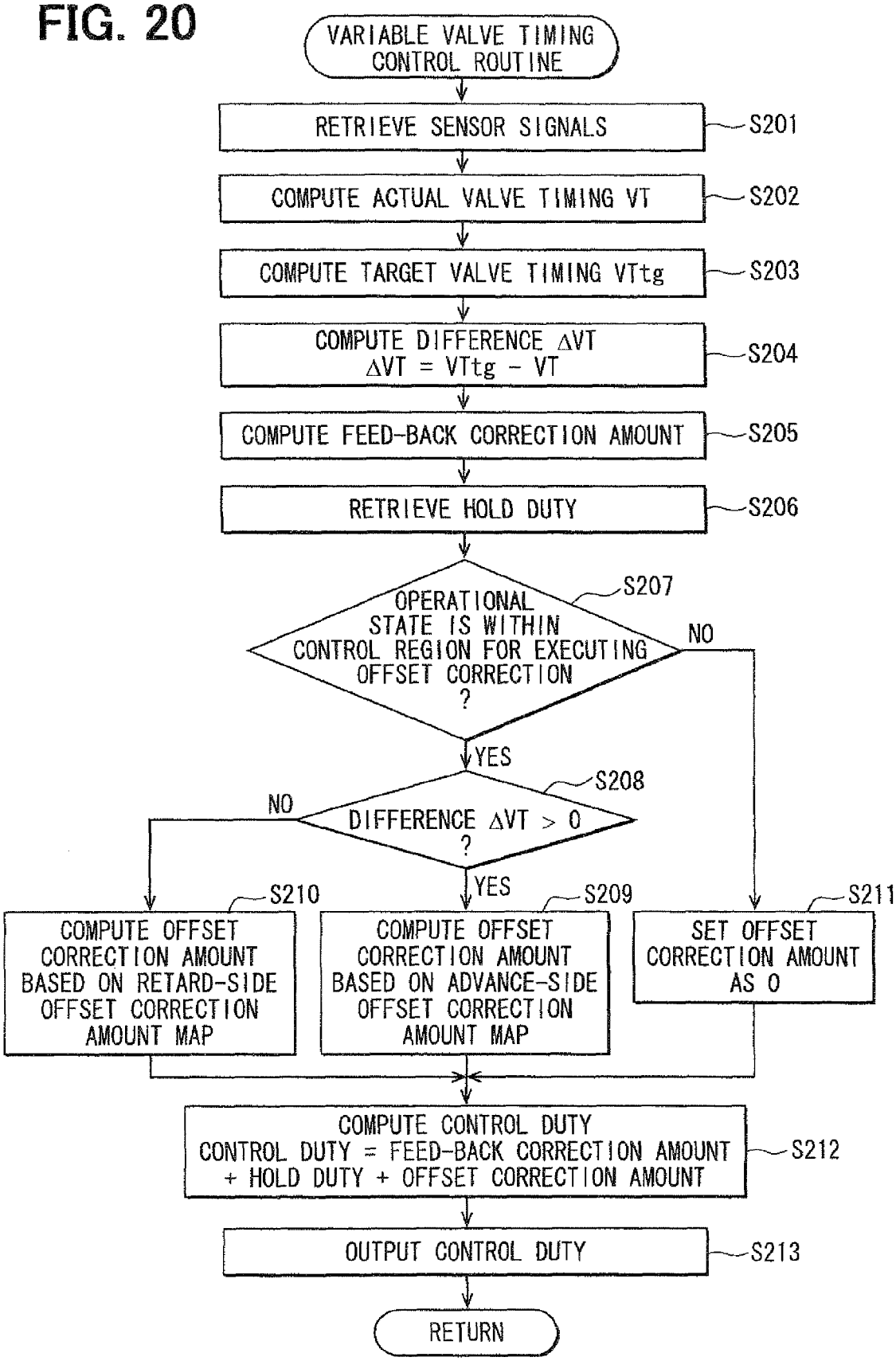
FIG. 20 is a flow chart for explaining a procedure of a variable valve timing control routine.

The dead zone width learning process and the variable valve timing control of the present embodiment will be executed by the ECU 24 based on routines shown in FIG. 19 and FIG. 20. The process of each routine will be described below.

[Dead Zone Width Learning Routine]

The dead zone width learning routine shown in FIG. 19 is periodically executed by the ECU 24 while the ignition switch is on or while a power source of the ECU 24 is on. The dead zone width learning routine serves as a dead zone width learning means. When the present routine is started, firstly, it is determined at step S101 whether a condition for executing the dead zone width learning process is satisfied based on the following conditions (1) to (3), for example.

(1) A predetermined time (for example, several seconds) has elapsed after starting of the engine. The above predetermined time allows the pressure of oil that drives the VCT 18 to rise to above a predetermined oil pressure, which disables the lock state of the VCT 18, or which pushes the lock pin out of the lock hole of the VCT 18.

(2) An accelerator pedal is not pressed.

(3) Self-diagnosis function (not shown) has not detected abnormality of a VCT control system.

In general, after the engine is stopped, the oil pressure decreases such that the lock pin of the VCT 18 is fitted into the lock hole, and thereby the VCT 18 is locked at the reference position (for example, the full retard position, the intermediate position). Thus, the lock state of the VCT 18 is required to be disabled in order to drive the VCT 18 for the learning operation of the dead zone width. Due to the above, the condition (1) is provided.

The condition (2) is provided in order to immediately start the vehicle or to immediately accelerate the vehicle when the driver presses the accelerator pedal even while the dead zone width learning process is being executed.

The condition (3) is provided because when there is abnormality in the VCT control system, it is impossible to normally execute the learning operation of the dead zone width.

If any one of the above three conditions (1) to (3) is not satisfied, the dead zone width learning execution condition is not established. Thus, the present routine is ended without executing the following steps that follows step S101.

In contrast, when all of three conditions (1) to (3) are satisfied, the dead zone width learning execution condition is established, and then the learning operation for learning the dead zone width in the advance side will be executed as follows. Firstly, at step S102, target valve timing (target value) is forcibly changed stepwise in the advance direction by a predetermined crank angle (for example, 10 to 15° CA). Then, control proceeds to step S103, where a relative duty, which is caused by the target valve timing set by the forcible change in the advance direction, is integrated. Then, the integrated duty in the advance side is updated.

Then, control proceeds to step S104, where it is determined whether the learning time in the advance side has elapsed since the target valve timing is forcibly changed in the advance direction. The learning time in the advance side is set within the range that is equal to or greater than the first time period (T1-T0) and that is equal to or smaller than the second time period (T2-T0). The first time period allows the actual valve timing of the upper-limit product to reach the target valve timing set by the forcible change in the advance direction. Also, the second time period allows the actual valve timing of the lower limit product to reach the target valve timing set by the forcible change in the advance direction. As a result, the time within the above range enables precise learning of the dead zone width in the advance side in a relatively short time.

If it is determined at step S104 that the learning time in the advance side has not elapsed yet, control proceeds to step S105, where it is determined whether the dead zone width learning execution condition determined at the step S101 still remains established. If it is determined that the dead zone width learning execution condition remains established, control returns to step S103, where the computation of the integrated duty in the advance side is executed.

If it is determined at step S105 that the dead zone width learning execution condition becomes dissatisfied before the learning time in the advance side has elapsed, the present routine is ended at the above timing of determination. Thus, for example, if the accelerator pedal is pressed before the learning time in the advance side has elapsed, the learning operation for learning the dead zone width in the advance side is prohibited at the timing of pressing. Thus, the operation is shifted to a normal variable valve timing control, and thereby the target valve timing is set in accordance with the amount of depressing the accelerator pedal.

In contrast, if the dead zone width learning execution condition remains established until the learning time in the advance side has elapsed, the determination result at step S104 corresponds to "Yes". Then, control proceeds to step S106, where the learning correction coefficient in the advance side is computed based on the ratio a2/a1 by using the learning correction coefficient map shown in FIG. 18. In the above computation, a2 is the integrated duty a2 in the advance side at the time, at which the learning time in the advance side has elapsed. Also, a1 is the integrated duty a1 in the advance side for the upper-limit product, which is retrieved from the ROM 41, and which corresponds to the temperature section including the present oil temperature (or coolant temperature).

Then, control proceeds to step S107, where the guard process is executed such that the learning correction coefficient in the advance side stays within a range of predetermined upper and lower limit guard values. In other words, if the learning correction coefficient in the advance side computed in step S106 is within the range of the upper and lower limit guard values, the learning correction coefficient in the advance side is learned without any modification of the coefficient. In contrast, when the learning correction coefficient in the advance side computed in step S106 is beyond the range of the upper and lower limit guard values, the learning correction coefficient in the advance side is limited by the guard value or the learning correction coefficient is made equal to the guard value. As a result, it is possible to prevent the erroneous learning of the learning correction coefficient in the advance side.

Then, control proceeds to step S108, where the dead zone width b1 (dead zone width base value) in the advance side for the upper-limit product for the temperature section that corresponds to present oil temperature (or coolant temperature) is retrieved from the ROM 41, and then the dead zone width b1 is corrected by the learning correction coefficient in the advance side to compute the dead zone width b2 in the advance side for the actual-use product. In the above way, the dead zone width b2 in the advance side is learned for each temperature section. Then, the learned value of the temperature section of interest in the dead zone width learning process map in the advance side is updated. The dead zone width learning process map is stored in the back-up RAM 43 (SRAM) serving as the rewritable nonvolatile memory.

dead zone width *b*2 in advance side=dead zone width base value in advance side×learning correction coefficient in advance side After the dead zone width b2 in the advance side is learned as above, the learning operation for learning the dead zone width in the retard side will be executed as follows. Firstly, at step S109 the target valve timing (target value) is forcibly changed stepwise in the retard direction by a predetermined crank angle (for example, 10 to 15° CA). Then, control proceeds to step S110, where a relative duty, which is caused by the target valve timing set by the forcible change in the retard direction, is integrated. Then, the integrated duty in the retard direction is updated.

Then, control proceeds to step S111, where it is determined whether the learning time in the retard side has elapsed since the timing of forcibly changing the target valve timing in the retard direction. Note that the learning time in the retard side is set in a range that is equal to or greater than one time period and that is equal to or less than the other time period. It takes the one time period for the actual valve timing of the upper-limit product to reach the target valve timing set by the forcible change in the retard direction. Also, it takes the other time period for the actual valve timing of the lower limit product to reach the target valve timing set by the forcible change in the retard direction. The learning time within the above range enables precise learning of the dead zone width in the retard side with a relatively short learning time.

If it is determined at step S111 that the learning time in the retard side has not elapsed yet, control proceeds to step S112, where it is determined whether the dead zone width learning execution condition determined at the step S101 still remains established. If it is determined that the dead zone width learning execution condition still remains established, control returns to step S110, where the computation of the integrated duty in the retard side is continued.

If it is determined at step S112 that the dead zone width learning execution condition is not established before the learning time in the retard side has elapsed, the present routine is ended at the timing of determination. Thus, for example, if the accelerator pedal is pressed before the learning time in the advance side has elapsed, the learning operation for learning the dead zone width in the advance side is prohibited at the timing of pressing. Thus, the operation is shifted to a normal variable valve timing control, and thereby the target valve timing is set in accordance with the amount of depressing the accelerator pedal.

In contrast, if the dead zone width learning execution condition remains established until the learning time in the retard side has elapsed, the determination result at step S111 corresponds to "Yes". Then, control proceeds to step S113, where the learning correction coefficient in the retard side is computed based on a computed ratio by using the learning correction coefficient map shown in FIG. 18. The above computed ratio is obtained by (a) the integrated duty in the retard side at the time, at which the learning time in the retard side has elapsed and (b) the integrated duty in the retard side for the upper-limit product for the temperature section that corresponds to the present oil temperature (or coolant temperature). The integrated duty in the retard side for the upper-limit product is retrieved from the ROM 41.

Then, control proceeds to step S114, where the guard process is executed such that the learning correction coefficient in the retard side is limited within the range of predetermined upper and lower limit guard values. In other words, when the learning correction coefficient in the retard side computed at step S113 is within the range of the upper and lower limit guard values, the learning correction coefficient in the retard side is learned without limiting the coefficient to the range. In contrast, if the learning correction coefficient in the retard side computed at step S113 is beyond the range of the upper and lower limit guard values, the learning correction coefficient in the retard side is limited by the guard value, or the learning correction coefficient is made equal to the guard value. Thus, it is possible to prevent the erroneous learning of the learning correction coefficient in the retard side.

Then, control proceeds to step S115, where the dead zone width in the retard side (dead zone width base value) for the upper-limit product for the temperature section that corresponds to the present oil temperature (or coolant temperature) is retrieved from the ROM 41, and the retrieved dead zone width in the retard side is corrected by the learning correction coefficient in the retard side to compute the dead zone width in the retard side for the actual-use product. As above, the dead zone width in the retard side is learned for each temperature section, and the learned value of the temperature section of interest in the dead zone width in the retard side learning operation map is updated. The learning operation map is stored in the back-up RAM 43 (SRAM) serving as the rewritable nonvolatile memory.

dead zone width in retard side=dead zone width base value in retard side×learning correction coefficient in retard side

[Variable Valve Timing Control Routine]

A variable valve timing control routine shown in FIG. 20 is repeatedly executed by the ECU 24 every predetermined time or every predetermined crank angle during the operation of the engine. The variable valve timing control routine serves as a "control means". When the present routine is started, firstly, output signals from various sensors are retrieved at step S201. Then, control proceeds to step S202, where present actual valve timing VT is computed. Then, control proceeds to step S203, where target valve timing VTtg is computed based on the engine operational state, and at step S204, a difference ΔVT (=VTtg−VT) between the target valve timing VTtg and the actual valve timing VT is computed.

Then, control proceeds to step S205, where by executing, for example, a PD control computation based on the difference ΔVT between the target valve timing VTtg and the actual valve timing VT, a feed-back correction amount is computed by the following equation.

$$\text{feed-back correction amount}=Kp\times\Delta VT+Kd\times d(\Delta VT)/dt, \text{ where}$$

d(ΔVT)/dt=[ΔVT(i)−ΔVT(i−1)]/dt, dt is a computation cycle, Kp is a proportional gain, Kd is a derivative gain. ΔVT(i) is a difference ΔVT in a present computation, and ΔVT(i−1) is a difference ΔVT in a previous computation.

Then, control proceeds to step S206, where the hold duty is retrieved. The hold duty may employ a learned value leaned through a hold duty learning routine (not shown) or may employ a predetermined value for the hold duty.

Then, in order to prevent the control hunting caused by the offset correction based on the learned value of the dead zone width, it is determined at step S207 whether the operational state is within a control region suitable for executing the offset correction. For example, the determination of the operational state is made by determining whether an absolute value of the difference ΔVT between the target valve timing VTtg and the actual valve timing VT is equal to or greater than a determination value. The determination value may be a fixed value but may be determined using a map based on at least one of the present oil temperature, the engine rotation speed, and a load. When it is determined at step S207 that the operational state is beyond the control region for executing the offset correction, control proceeds to step S211 where the offset correction amount is set at 0. Thus, the offset correction of the control duty is cancelled such that the control hunting is prevented.

In contrast, when it is determined at step S207 that the operational state is within the control region for executing the offset correction, control proceeds to step S208, where it is determined whether the difference ΔVT between the target valve timing VTtg and the actual valve timing VT is equal to or greater than 0 (positive value) in order to determine whether the drive direction of the valve timing is in the advance direction. When it is determined that the difference ΔVT is equal to or greater than 0 (positive value), it is determined that the control direction of the valve timing is the advance direction. Thus, control proceeds to step S209, where the dead zone width learning process map in the advance side stored in the back-up RAM 43 (SRAM) is searched in order to retrieve the learned value of the dead zone width in the advance side for the temperature section corresponding to the present oil temperature (or coolant temperature). Then, in accordance with the learned value of the dead zone width in the advance side, the offset correction amount for correcting the control duty is set based on an advance-side offset correction amount map. The above computed advance-side offset correction amount is a positive value.

Also, when it is determined at step S208 that the difference ΔVT is equal to or less than 0 (negative value), it is determined accordingly that the valve timing is controlled is the retard direction. Then, control proceeds to step S210, where the retard side learning operation map stored in the back-up RAM 43 (SRAM) is searched for the dead zone width, and the learned value for the dead zone width in the retard side for the temperature section corresponding to the present oil temperature (or coolant temperature) is retrieved. Then, in accordance with the learned value of the dead zone width in the retard side, the offset correction amount for correcting the control duty is set based on a retard-direction offset correction amount map. The above computed retard-direction offset correction amount is a negative value.

After the offset correction amount is set at any one of steps S209 to S211 as above, control proceeds to step S212, where the control duty is computed by adding the offset correction amount and the hold duty to the feed-back correction amount that corresponds to the difference ΔVT.

$$\text{control duty}=\text{feed-back correction amount}+\text{hold duty}+\text{offset correction amount}$$

Furthermore, in order to compensate the influence caused by the change of the battery voltage, the above control duty may be corrected in accordance with the battery voltage.

Then, control proceeds to step S213, where the control duty is outputted such that the hydraulic control valve 21 of the VCT 18 is driven in a direction to make the actual valve timing close to the target valve timing.

In the present embodiment as described above, during the learning operation for learning the dead zone width, the control duty of the VCT 18 is not required to be oscillated. Thus, for example, in the designing phase of the valve timing control apparatus, the characteristic of the dead zone width is measured, and then design values are computed based on the measured characteristic. Usually, the computed design values are substantially evaluated before the valve timing control apparatus is put into the market. Because the learning of the dead zone width is simplified as above in the present embodiment, the evaluation of the design values is also facilitated accordingly. As a result, the production cost including the designing cost of the valve timing control apparatus is effectively reduced advantageously.

Furthermore, in the present embodiment, the learning time of the dead zone width is set in a range, which is equal to or greater than the first time period, and which is equal to or less than the second time period. The first time period allows the actual valve timing of the upper-limit product of the VCT 18 to reach the target value set by the forcible change. Also, the second time period allows the actual valve timing of the lower limit product of the VCT 18 to reach the target value set by the forcible change. As a result, the learning time is made as short as possible, and still the accuracy in the learning operation is successfully achievable.

Furthermore, in the present embodiment, the learning time used in the advance side is different from the learning time used in the retard side in accordance with the dead zone widths (responsivity) in the advance and retard sides. The above difference is made because the dead zone width (responsivity) changes depending on the drive direction of the VCT 18, and thereby a time required for the actual valve timing to reach the target value set by the forcible change differs when the drive direction is in the advance direction from a time required when the VCT 18 is driven in the retard direction. Thus, the learning time is optimized for the advance side and the retard side (for cases, where the drive direction is the advance direction and is the retard direction).

Also, in the present embodiment, data sets of the integrated duty a1 and the dead zone width b1 for the responsivity reference product is computed in advance in the designing phase of the product. Then, the above computed data sets are prestored in the nonvolatile storage unit, such as the ROM 41 of the ECU 24, in the manufacturing phase of the product. In the above, the responsivity reference product employs the upper-limit product having the highest responsivity among the manufactured products. Then, the learning correction coefficient is computed based on the ratio a2/a1, where a2 indicates the learned integrated duty a2 of the actual-use product, and a1 indicates the retrieved integrated duty a1 of the upper-limit product retrieved from the ROM 41. The dead zone width b1 (dead zone width base value) of the upper-limit product is corrected by the above learning correction coefficient to compute the dead zone width b2 of the actual-use product. As a result, the dead zone width of the actual-use product is easily and effectively learned based on the responsivity reference product (the upper-limit product).

Then, in the present embodiment, data sets of the integrated duty a1 and the dead zone width b1 for the responsivity reference product for each temperature section of the oil temperature or a temperature correlated with the oil temperature (for example, coolant temperature) are prestored in the nonvolatile storage unit, such as the ROM 41 of the ECU 24. The above prestorage is made because the dead zone width is different for different oil temperature, in general. Then, the learning correction coefficient is computed in accordance with the ratio a2/a1 by using the learning correction coefficient map shown in FIG. 18. In the above, a2 is the learned integrated duty a2 of the actual-use product, and a1 is the retrieved integrated duty a1 of the upper-limit product for the temperature section corresponding to the present oil temperature, and the integrated duty a1 is retrieved from the ROM 41. Then, the learning correction coefficient is corrected by the dead zone width b1 (dead zone width base value) of the upper-limit product for the temperature section corresponding to the present oil temperature in order to compute the dead zone width b2 of the actual-use product. In the above, the dead zone width b1 is also retrieved from the ROM 41. As a result, the dead zone width b2 is computed for each temperature section. Thus, the dead zone width of the actual-use product is precisely learned for each temperature section as a countermeasure for a situation, where the dead zone width changes with different oil temperature. Thereby, the accuracy in the learning operation for learning the dead zone is effectively improved.

Furthermore, in the present embodiment, the integrated duty a1 and the dead zone width b1 of the responsivity reference product is computed in advance for each of the advance side and the retard side, and the data sets of the integrated duty a1 and the dead zone width b1 are prestored in the nonvolatile storage unit, such as the ROM 41 of the ECU 24. The above computation of the data sets in advance is made because the dead zone width changes even for the same integrated duty depending on whether the drive direction of the VCT 18 is in the advance direction or in the retard direction. Then, the advance-side learning operation for learning the dead zone width in the advance side is executed by forcibly changing the target value in the advance direction to compute the integrated duty in the advance side. Also, the retard-side learning operation for learning the dead zone width in the retard side is executed by forcibly changing the target value in the retard direction in order to compute the integrated duty in the retard side. If the target value is changed in the advance direction after the above learning operations are completed, the control duty of the VCT 18 is offset-corrected based on the learned value of the dead zone width in the advance side. If the target value is changed in the retard direction after the above learning operations are completed, the control duty of the VCT 18 is offset-corrected based on the learned value of the dead zone width in the retard side. As a result, in a case, where the dead zone width (responsivity) is different depending on the drive direction of the VCT 18, when the VCT 18 is driven either one of in the advance direction and in the retard direction, the dead zone width that is learned for the corresponding drive direction of the VCT 18 compensates the dead zone width (responsivity). As a result, the control duty of the VCT 18 is appropriately offset-corrected advantageously.

Also, in the present embodiment, when the accelerator pedal is pressed, the learning operation for learning the dead zone width is prohibited. Thus, even in a case, where the dead zone width learning execution condition is established, the vehicle is immediately started or the vehicle is immediately accelerated when the driver presses the accelerator pedal.

In the present embodiment, firstly, the dead zone width is learned, and then the learned value of the dead zone width is stored and updated in the back-up RAM 43 (SRAM) serving as the rewritable nonvolatile memory. However, alternatively, the learned value of the integrated duty or the learning correction coefficient may be firstly stored or updated in the back-up RAM 43 (SRAM), and then the dead zone width may be computed based on the learned value of the integrated duty or the learning correction coefficient retrieved from the back-up RAM 43 (SRAM) during the variable valve timing control. Then, the offset correction amount is computed based on the dead zone width.

Also, in the present embodiment, the dead zone width correlation parameter employs the integrated duty of the relative duty that is the difference between the control duty and the hold duty, and the integrated duty is a time integrated value (integrated value) of the relative duty. Alternatively, for example, the dead zone width correlation parameter may employ a change speed of the relative duty. Also, alternatively, the dead zone width correlation parameter may employ one of (a) a change speed of the actual valve timing, (b) a time integrated value of the actual valve timing, (c) a change speed of a difference A between the target valve timing and the actual valve timing, and (d) a time integrated value of the difference A. The difference A serves as a "first difference".

Note that, the present embodiment shows an example, in which the present invention is applied to a variable valve timing control for controlling the intake valve. However, the present invention may be applicable to a variable valve timing control for controlling an exhaust valve. Also, the present invention may be applicable even to a system that does not have the oil temperature sensor 47, if the system has a temperature sensor, such as a coolant temperature sensor 46, that is capable of sensing a temperature (coolant temperature) correlated with the oil temperature.

Also, application of the present invention is not limited to the variable valve timing control arrangement. However, the present invention may be alternatively applied to a system that controls a variable valve mechanism having a dead zone and a nonlinear control characteristic. For example, the above alternatively system includes a hydraulic variable valve mechanism that changes a valve opening-closing characteristic, such as a valve lift amount, a working angle. Thus, the present invention may be modified as required provided that the modification does not deviate from a gist of the present invention.

Fourth Embodiment

The fourth embodiment of the present invention will be described with reference to accompanying drawings. Similar components in the fourth embodiment similar to those in the third embodiment will be indicated by the same numeral, and the explanation thereof will be omitted.

The oil temperature sensor 47 corresponds to a temperature detecting unit, and the output signal outputted by the oil temperature sensor 47 is inputted into the ECU 24.

In the present embodiment, the dead zone width is computed similarly to the third embodiment using the data maps and the chart shown in FIGS. 12A to 18.

As shown in FIGS. 13A and 13B, as oil temperature decreases, the dead zone width increases and thereby the response or the movement of the VCT 18 deteriorates. As a result, as the oil temperature decreases, it takes more time for the actual valve timing to reach the target value (second value) set by the forcible change. As described above, as the learning time becomes longer, the dead zone width learning execution condition is more likely to become dissatisfied during the learning operation, and thereby the learning operation is more likely to be cancelled. Thus, the frequency of executing the learning operation may decrease.

Figures 21, 22:
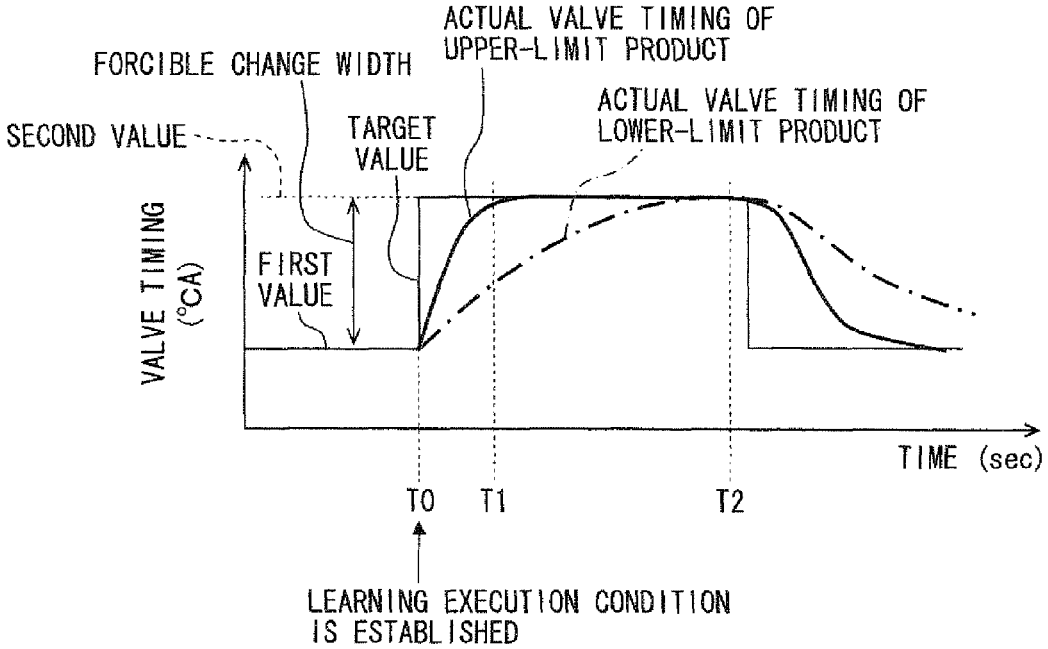
FIG. 21 is a diagram for explaining a behavior of a relation between (a) target valve timing and (b) actual valve timing for explaining a variable range of responsivity of the VCT during the learning operation according to the fourth embodiment of the present invention.
FIG. 22 is a diagram for conceptually explaining a forcible change width map.

As a countermeasure for the above, in the present embodiment, as shown in FIG. 22, as oil temperature detected by the oil temperature sensor 47 (or the coolant temperature detected by the coolant temperature sensor 46) decreases, a forcible change width of the target value at the beginning of the learning operation is increased. For example, as shown in FIG. 21, the forcible change width corresponds to a difference of the target value between a first value (before the changing of the target value at time T0) and a second value (set by the changing of the target value at time T0). For example, in a case, where the oil temperature is low, a difference between the target value (target valve timing) and the actual valve timing is enlarged by increasing the forcible change width of the target value at the beginning of the learning operation. Accordingly, the control duty of the VCT 18 is increased, and thereby the responsivity of the VCT 18 is improved. Thus, even when the oil temperature is low, the integrated duty is accurately learned within a relatively short learning time.

Furthermore, in the present embodiment, it is considered that the dead zone width (responsivity) varies with the drive direction of the VCT 18. Thus, the forcible change width of the target value is individually preset for each drive direction (in the advance direction and in the retard direction) as shown in FIG. 22 in the designing phase of the product. The data of the forcible change width is stored in the nonvolatile storage unit, such as the ROM 41 of the ECU 24, in the manufacturing phase of the product. Due to the above, when the VCT 18 is driven in the advance direction or in the retard direction, it is possible to set the forcible change width of the target value at the beginning of the learning operation at an appropriate value depending on the drive direction of the VCT 18 with consideration of the difference of the dead zone width (responsivity).

Figure 23:
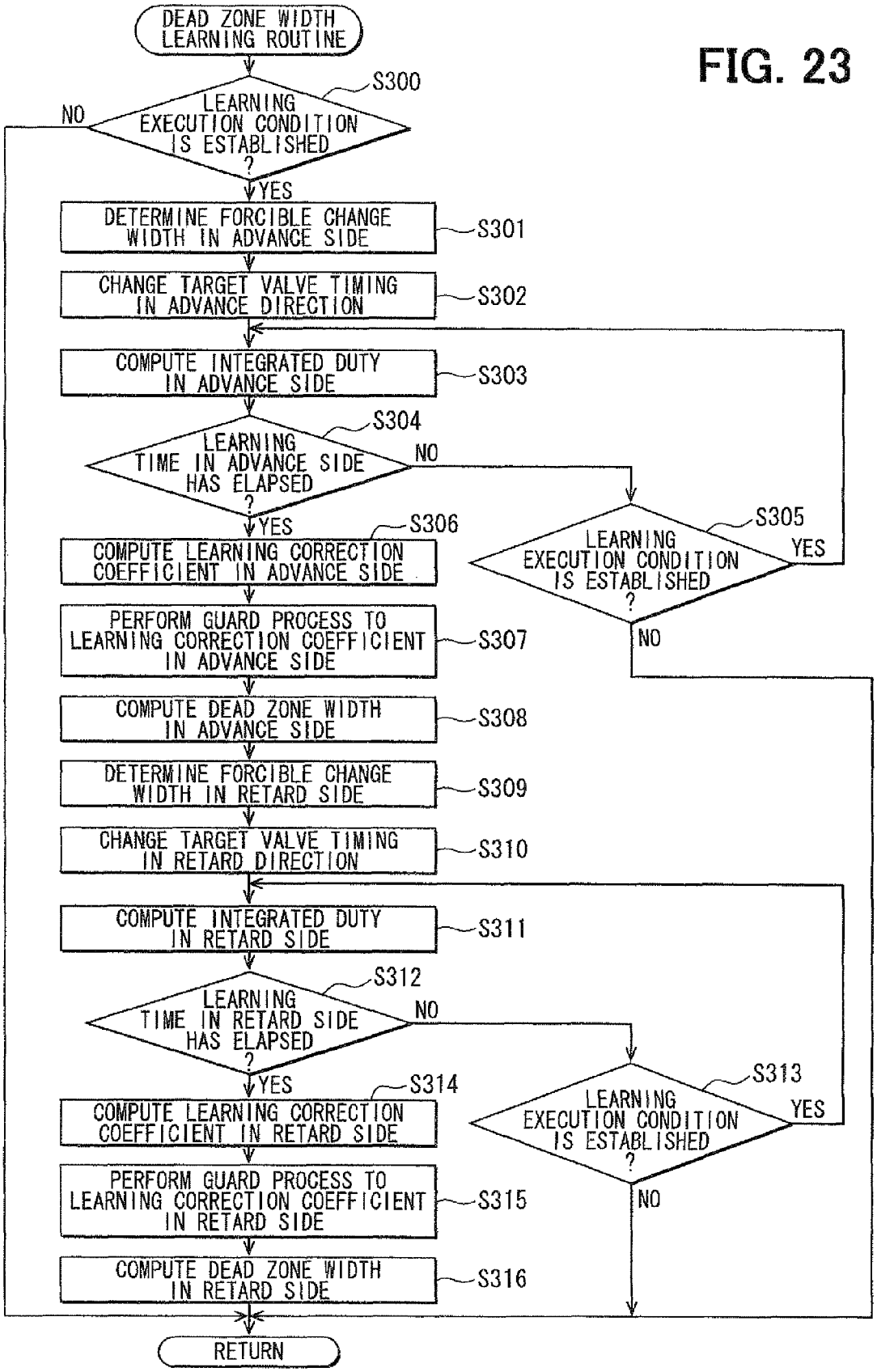
FIG. 23 is a flow chart for explaining a flow of a process of a dead zone width learning routine.

The dead zone width learning process and the variable valve timing control of the present embodiment are executed by the ECU 24 based on each routine shown in FIG. 23 and FIG. 20. Processes of each routine will be described below.

[Dead Zone Width Learning Routine]

The dead zone width learning routine shown in FIG. 23 is periodically executed by the ECU 24 while the ignition switch is on (or while the power source of the ECU 24 is on). The dead zone width learning routine serves as a dead zone width learning means. When the present routine is started, firstly, at step S300, it is determined whether the dead zone width learning execution condition is established, for example, based on the three conditions (1) to (3) described in the third embodiment.

When the one of the three conditions (1) to (3) is not satisfied it is determined that the dead zone width learning execution condition is not established, and thereby the present routine is finished without executing any process.

In contrast, the three conditions (1) to (3) are all satisfied, it is determined that the dead zone width learning execution condition is established, and firstly, the learning operation for learning the dead zone width in the advance side is executed as below. Firstly, at step S301, the forcible change width of the target valve timing in the advance side is set in accordance with the oil temperature detected by the oil temperature sensor 47 (or the coolant temperature detected by the coolant temperature sensor 46) by referring to the forcible change width map shown in FIG. 22. Then, control proceeds to step S302, where the target valve timing is forcibly changed stepwise in the advance direction by the amount corresponding to the retrieved forcible change width in the advance side. Then, control proceeds to step S303, where a relative duty (difference between the control duty and the hold duty) caused by the target valve timing set by the forcible change in the advance direction is integrated to update the integrated duty in the advance side (the integrated value of the relative duty).

Then, control proceeds to step S304, where it is determined whether the learning time in the advance side has elapsed since a time, at which the target valve timing is forcibly changed in the advance direction. The learning time in the advance side is defined within a range that is equal to or greater than the first time period (T1-T0) and that is equal to or less than the second time period (T2-T0). In the above, the actual valve timing of the upper-limit product requires the first time period to become the target valve timing set by the forcible change in the advance direction. Also, the actual valve timing of the lower limit product requires the second time period to become the target valve timing set by the forcible change in the advance direction. If the learning time is within the range, it is possible to accurately learn the dead zone width in the advance side with a relatively short learning time.

When it is determined at step S304 that the learning time in the advance side has not yet elapsed, control proceeds to step S305, where it is determined whether the dead zone width learning process execution condition of step S300 has remained established. When the dead zone width learning execution condition has remained established, control returns to step S303, where computation of the integrated duty in the advance side is continued.

If it is determined at step S305 that the dead zone width learning execution condition becomes dissatisfied before the learning time in the advance side has elapsed, the present routine is finished at the time of determination. Thus, for example, if the accelerator pedal is pressed before the learning time in the advance side has elapsed, the learning operation for learning the dead zone width in the advance side is prohibited at the timing of pressing. Thus, the operation is shifted to a normal variable valve timing control, and thereby the target valve timing is set in accordance with the amount of depressing the accelerator pedal.

In contrast, if it is determined that the dead zone width learning execution condition has remained established until the learning time in the advance side has elapse, the determination result at step S304 corresponds to "Yes". Thus, control proceeds to step S306, where the learning correction coefficient in the advance side is computed using the learning correction coefficient map shown in FIG. 18 in accordance with the ratio a2/a1. In the above ratio a2/a1, a2 corresponds to the integrated duty a2 in the advance side at the time at which the learning time in the advance side has elapsed. Also, a1 corresponds to the integrated duty a1 in the advance side for the upper-limit product in a temperature section that corresponds to the present oil temperature (or coolant temperature). The integrated duty a1 in the advance side is retrieved from the ROM 41.

Then, control proceeds to step S307, where the guard process is performed in order to limit the learning correction coefficient in the advance side within a range between the predetermined upper and lower limit guard values. In other words, when the learning correction coefficient in the advance side computed in step S306 is within the range between the upper and lower limit guard values, the learning correction coefficient in the advance side is learned without modifying the learning correction coefficient. When the learning correction coefficient in the advance side computed at step S306 is beyond the range between the upper and lower limit guard values, the learning correction coefficient in the advance side is limited by the guard value. As a result, the learning correction coefficient becomes the guard value. Thus, it is possible to prevent the erroneous learning of the learning correction coefficient in the advance side.

Then, control proceeds to step S308, where the dead zone width b1 in the advance side (dead zone width base value) of the upper-limit product is retrieved from the ROM 41. The dead zone width b1 in the advance side is the dead zone width of a temperature section that corresponds to the present oil temperature (or coolant temperature). Then, the dead zone width b1 in the advance side is corrected by the learning correction coefficient in the advance side such that the dead zone width b2 in the advance side for the actual-use product is computed. Thus, the dead zone width b2 in the advance side is learned for each temperature section such that the learned value of the temperature section in the dead zone width learning process map in the advance side stored in the back-up RAM 43 (SRAM) is updated.

dead zone width $b2$ in advance side=dead zone width base value in advance side×learning correction coefficient in advance side As above, after the dead zone width b2 in the advance side has been learned, the learning of the dead zone width in the retard side is executed as follows. Firstly, at step S309, a forcible change width of the target valve timing in the retard side is determined in accordance with an oil temperature detected by the oil temperature sensor 47 (or the coolant temperature detected by the coolant temperature sensor 46) by referring to the forcible change width map shown in FIG. 22. Then, control proceeds to step S310, where target valve timing is forcibly changed stepwise in the retard direction by the amount corresponding to the forcible change width in the retard direction. Then, control proceeds to step S311, where a relative duty, which is caused by the target valve timing set by the forcible change of in the retard direction, is integrated to update the integrated duty in the retard side (the integrated value of the relative duty).

Then, control proceeds to step S312, where it is determined whether the learning time in the retard side has elapsed since the time, at which the target valve timing is forcibly changed in the retard direction. The learning time in the retard side is set in a range between the one time period to the other time period. For example, the actual valve timing of the upper-limit product requires the one time period to reach the target valve timing set by the forcible change in the retard direction. Also, the actual valve timing of the lower limit product requires the other time period to reach the target valve timing set by the forcible change in the retard direction. If the learning time is within the above range defined by the one time period and the other time period, it is possible to accurately learn the dead zone width in the retard side with a relatively short learning time.

When it is determined at step S312 that the learning time in the retard side has not elapsed yet, control proceeds to step S313, where it is determined whether the dead zone width learning execution condition of the step S300 still remains established. When the dead zone width learning execution condition still remains established, control returns to step S311, where the computation of the integrated duty in the retard side is continued.

When it is determined at step S313 that the dead zone width learning execution condition becomes dissatisfied before the learning time in the retard side has elapsed, the present routine is ended at the time of determination. Thus, for example, if the accelerator pedal is pressed before the learning time in the advance side has elapsed, the learning operation for learning the dead zone width in the advance side is prohibited at the timing of pressing. Thus, the operation is shifted to a normal variable valve timing control, and thereby the target valve timing is set in accordance with the amount of depressing the accelerator pedal.

In contrast, if the dead zone width learning execution condition remains established until the learning time in the retard side has elapsed, the determination result at step S312 corresponds to "Yes". Thus, control proceeds to step S314, where a learning correction coefficient in the retard side is computed by using the learning correction coefficient map shown in FIG. 18 based on a ratio of (a) the learned integrated duty in the retard side for the actual-use product to (b) the retrieved integrated duty in the retard side for the upper-limit product. More specifically, the learned integrated duty in the retard side is measured at the time, at which the learning time in the retard side has elapsed. Also, the retrieved integrated duty in the retard side is retrieved from the ROM 41 and is related with the temperature section that includes the present oil temperature (or coolant temperature).

Then, control proceeds to step S315, where the guard process is performed in order to limit the learning correction coefficient in the retard side within a range between the predetermined upper and lower limit guard values. More specifically, when the learning correction coefficient in the retard side computed at step S314 is within the range between the upper and lower limit guard values, the learning correction coefficient in the retard side is learned without modifying the learning correction coefficient. When the learning correction coefficient in the retard side computed at step S314 is beyond the range between the upper and lower limit guard values, the learning correction coefficient in the retard side is limited by the guard value or the learning correction coefficient is made equal to the guard value. Thus, it is possible to prevent the erroneous learning of the learning correction coefficient in the retard side.

Then, control proceeds to step S316, where the dead zone width in the retard side (dead zone width base value) for the upper-limit product for the temperature section that corresponds to the present oil temperature (or coolant temperature) is retrieved from the ROM 41, and the retrieved dead zone width in the retard side is corrected by the learning correction coefficient in the retard side in order to compute the dead zone width in the retard side for the actual-use product. Thus, the dead zone width in the retard side is learned for each temperature section, and the learned value of the dead zone width in the temperature section of interest in the retard side learning operation map is updated. The learning operation map is stored in the back-up RAM 43 (SRAM).

dead zone width in retard side=dead zone width base value in retard side×learning correction coefficient in retard side In the present embodiment, in order to learn the dead zone width, it is not necessary to oscillate the control duty of the VCT 18. Thus, for example, in the designing phase of the valve timing control apparatus, the characteristic of the dead zone width is measured, and then design values are computed based on the measured characteristic. Usually, the computed design values are substantially evaluated before the valve timing control apparatus is put into the market. Because the learning of the dead zone width is simplified as above in the present embodiment, the evaluation of the design values is also facilitated accordingly. As a result, the production cost including the designing cost of the valve timing control apparatus is effectively reduced advantageously.

Furthermore, in the present embodiment, in addition to the advantages achievable in the third embodiment, further advantages are achievable. For example, in the present embodiment, it is considered that as the oil temperature decreases, the dead zone width becomes larger, and thereby the responsive performance of the VCT 18 deteriorates or the motion of the VCT 18 becomes otherwise delayed. As a result, the forcible change width of the target valve timing (target value) at the beginning of the learning operation is changed in accordance with the oil temperature detected by the oil temperature sensor 47 (or the coolant temperature detected by the coolant temperature sensor 46). Thus, it is possible to set the forcible change width of the target valve timing at the beginning of the learning operation larger as the oil temperature decreases or as the dead zone width becomes larger. Thus, as the oil temperature decreases, the difference between the actual valve timing and the target valve timing set at the beginning of the learning operation is enlarged. As a result, the control duty of the VCT 18 is increased accordingly to the decrease of the oil temperature such that the responsive performance of the VCT 18 is improved. Thus, even when the oil temperature is low, it is possible to accurately learn the dead zone width correlation parameter (integrated duty) with a relatively short learning time.

Furthermore, in the present embodiment, it is considered that the dead zone width (responsivity) is different depending on whether the VCT 18 is driven in the advance direction or in the retard direction. Thus, the forcible change width of the target valve timing is individually set in the advance direction and in the retard direction. As a result, when the VCT 18 is driven in the advance direction and in the retard direction, the forcible change width of the target valve timing at the beginning of the learning operation is set at an appropriate value that is determined in accordance with the drive direction of the VCT 18 in order to compensate the difference of the dead zone width (responsivity).

Also, in the present embodiment, the forcible change width of the target valve timing at the beginning of the learning operation is changed in accordance with the oil temperature or the coolant temperature. However, the control gain (for example, the proportional gain, the derivative gain) may be alternatively changed in accordance with the oil temperature or the coolant temperature. For example, the control gain is used during the learning operation in the computation of the feed-back correction amount based on the difference ΔVT between the target valve timing and the actual valve timing. By increasing the control gain during the learning operation accordingly to the increase of the oil temperature or the coolant temperature, the feed-back correction amount is increased in accordance with the difference ΔVT between the target valve timing and the actual valve timing. As a result, it is possible to achieve the advantages similar to those achievable when the forcible change width of the target valve timing at the beginning of the learning operation is increased.

Fifth Embodiment

The fifth embodiment of the present invention will be described with reference to accompanying drawings. In the fifth embodiment, the components similar to those in the third and fourth embodiments are indicated by the same numeral, and the explanation thereof is omitted.

The present embodiment is applied to a valve timing control apparatus on an intake side of the internal combustion engine.

Firstly, a schematic configuration of a general system will be described referring to FIG. 10.

The variable valve timing apparatus 18 corresponds to a variable valve mechanism. The variable valve timing apparatus 18 has an oil pressure circuit, to which the oil pump 20 supplies hydraulic oil in the oil pan 19. By controlling the hydraulic control valve 21 (oil pressure control device) in order to control the oil pressure in the oil pressure circuit, valve timing (advance amount) of the intake valve is controlled.

Also, output signals outputted from all of the accelerator sensor 44, the intake air amount sensor 45, the coolant temperature sensor 46 (temperature detecting unit), the oil temperature sensor 47 (temperature detecting unit) are inputted to the ECU 24. The ECU 24 detects the engine operational state based on the various sensor signals, and executes the fuel injection control and the ignition control based on the engine operational state. Also, the ECU 24 executes the variable valve timing control to feed-back control the variable valve timing apparatus 18 (the hydraulic control valve 21) such that the actual valve timing of the intake valve (actual camshaft phase of the intake-side camshaft 16) becomes the target value (target camshaft phase of the intake-side camshaft 16).

In the present embodiment, the dead zone width is computed similarly to the third and fourth embodiments using the data maps and the chart shown in FIGS. 12A to 18.

During the variable valve timing control, a basic control duty is computed by adding a feed-back correction amount to a hold duty (hold control amount). The feed-back correction amount is determined in accordance with the difference between the target value and the actual value of the valve timing (actual valve timing), and the hold duty is a duty value required to maintain the actual valve timing under a stable state or a constant state. Then, the basic control duty is corrected by an offset correction amount that is based on the dead zone width learned value (the learned value of the dead zone width) such that a final control duty is determined.

control duty=feed-back correction amount+hold duty+offset correction amount

Thus, in order to increase the accuracy of the variable valve timing control, it is necessary to improve the accuracy of the dead zone width learned value or the offset correction amount and also to improve the accuracy of the hold duty. Also, the control duty is determined using the above equation in order to learn the dead zone width. Thus, it is necessary to improve the accuracy of the hold duty in order to improve accuracy in the learning operation for learning the dead zone width.

In general, the hold duty that is obtained by the learning operation has a different value for a different oil temperature. Thus, the entire temperature range used for the learning operation is divided into multiple temperature sections such that the hold duty is learned for each of the temperature sections. However, in a case, where a hold duty has been learned in a certain temperature section and a hold duty in the other temperature section different from the above certain section has not been learned, the hold duty learned in the certain temperature section is not able to be used for executing the variable valve timing control in the other temperature section. Thus, the accuracy in performing the variable valve timing control may deteriorate. Furthermore, because the frequency of executing the learning operation for learning the hold duty is different for the different temperature section. As a result, accuracy in the learning operation of the hold duty may become lower for the temperature section having the lower frequency. Therefore, the accuracy in the variable valve timing control may deteriorate.

In the present embodiment, hold duty standard characteristic data (hold control amount standard characteristic data) that defines a relation between the hold duty and the oil temperature or temperature, such as coolant temperature, that is correlated with the oil temperature is computed in advance in the designing phase of the product or in the manufacturing phase of the product. Then, the computed data is stored in the nonvolatile storage unit, such as the ROM 41 of the ECU 24. Then, the hold duty is learned when a temperature stays within a predetermined temperature section that corresponds to, for example, a temperature section of oil temperature after the warming-up of the engine. Then, the hold duty for the other temperature section is set based on the learned hold duty learned value of the predetermined temperature section and based on the hold duty standard characteristic data retrieved from the ROM 41.

In the above case, a method for setting the hold duty includes, for example, the following two methods.

[Hold Duty Setting Method (Part 1)]

Figures 24, 25:
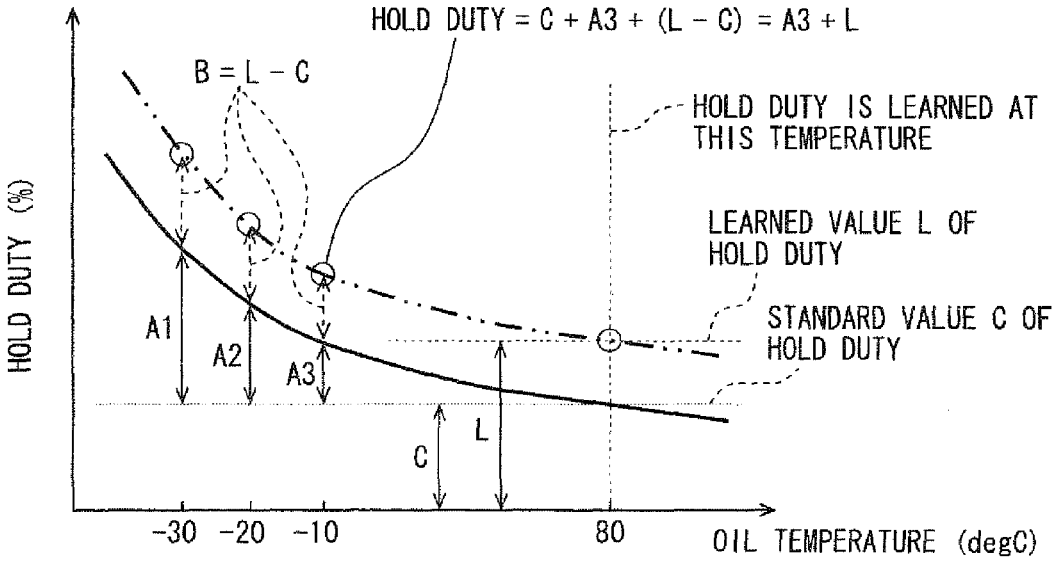
FIG. 24 is a diagram for conceptually explaining one example of a hold duty correction amount map.
FIG. 25 is a diagram for explaining a hold duty setting method (Part 1)

FIG. 24 and FIG. 25 show hold duty standard characteristic data. As shown in FIG. 25, a specific value of the hold duty for a temperature section for executing the learning operation of the hold duty is set as a standard value C. For example, the temperature section for the learning operation corresponds to the oil temperature after the warming up of the engine. Also, a correction amount serving as a "temperature correction amount" is prepared to correct the standard value C in order to compensate a hold duty for each of the different temperature sections. The hold duty standard characteristic data in FIG. 24 includes the correction amount A1 to A5 for each temperature section. In the present embodiment, the hold duty is learned when the oil temperature becomes a certain value (for example, 85 deg C.) that corresponds to the temperature after the warming up of the engine. Then, the learned value L of the hold duty is corrected based on the corresponding correction amounts A1 to A5, for the multiple temperature sections that are retrieved from the hold duty correction amount map of FIG. 24 such that the hold duty for each temperature section is determined. The hold duty standard value C and the correction amount A1 to A5 for each temperature section are theoretically computed in advance in the designing phase of the product or in the manufacturing phase of the product.

$$\text{hold duty of temperature section } i = C + Ai + (L - C) = Ai + L$$

Ai indicates a correction amount of a temperature section i.

[Hold Duty Setting Method (Part 2)]

Figures 26, 27:
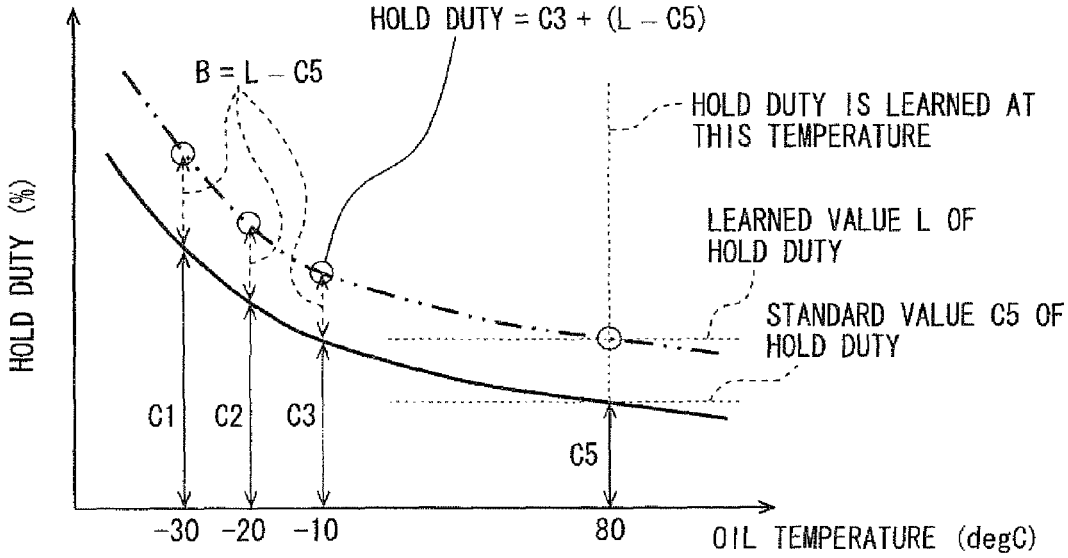
FIG. 26 is a diagram for conceptually explaining one example of a hold duty standard value map.
FIG. 27 is a diagram for explaining a hold duty setting method (Part 2)

The other method for setting the hold duty will be described below. FIG. 26 and FIG. 27 show another hold duty standard characteristic data that includes a hold duty standard value C1 to C5 for each temperature section. A correction amount B serving as a "hold control correction amount" is defined as a difference (L−C5) between the hold duty learned value L and the hold duty standard value C5. The learned value L of the hold duty is learned for the predetermined temperature section (for example, corresponding to the oil temperature after the warming up of the engine), and the hold duty standard value C5 for the predetermined temperature section is obtained from the hold duty standard characteristic data of FIG. 26. Then, the hold duty standard value C1, C2, C3, etc. for each temperature section is corrected by the correction amount B such that the hold duty for each temperature section is determined. The hold duty standard value C1, C2, C3, etc. for each temperature section is theoretically computed in advance in the designing phase of the product or in the manufacturing phase of the product.

$$\text{hold duty for temperature section } i = Ci + B = Ci + (L - C5)$$

In the above equation, Ci indicates a hold duty standard value for a temperature section i.

The hold duty for each temperature section determined by any one of the above hold duty setting methods is collectively stored as a learning map in the back-up RAM 43 (SRAM). The control duty may be alternatively computed by selecting a specific hold duty from the stored hold duties for the temperature sections in the learning map. The specific hold duty corresponds to the temperature section including the present oil temperature detected by the oil temperature sensor 47. Alternatively, every time the oil temperature detected by the oil temperature sensor 47 changes during the operation of the engine, the hold duty for another temperature section including the detected temperature may be computed through one of the above methods in order to compute the control duty.

Figures 28, 29, 30:
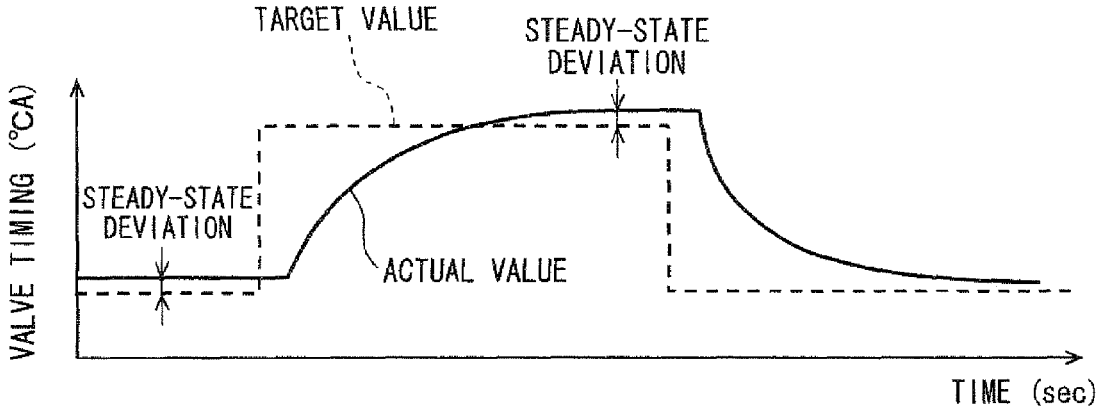
FIG. 28 is a diagram for explaining the advance-side learning operation, the retard-side learning operation, and a process for correcting the hold duty based on the steady-state deviation.
FIG. 29 is a diagram for conceptually explaining one example of the advance-side hold duty steady-state deviation correction map.
FIG. 30 is a diagram for conceptually explaining one example of the retard-side hold duty steady-state deviation correction map.

In the present embodiment, the control duty is computed by the hold duty determined through one of the above methods. Then, both the advance-side learning operation and the retard-side learning operation are executed during the learning operation of the dead zone width. In the advance-side learning operation, the integrated duty in the advance side is computed by forcibly changing the target value in the advance direction as shown in FIG. 28 such that the dead zone width in the advance side is learned. Also, in the retard-side learning operation, the integrated duty in the retard side is computed by forcibly changing the target value in the retard direction such that the dead zone width in the retard side is learned. In the above, a steady-state deviation between the target value and the actual value of the valve timing (or between the target valve timing and the actual valve timing) is computed immediately before the target value is forcibly changed in the advance direction or in the retard direction, and then a correction amount in accordance with the steady-state deviation (offset) is determined by referring to a corresponding hold duty steady-state deviation correction map shown in FIG. 29 or in FIG. 30 in order to correct the hold duty. In the above, the steady-state deviation or the offset is a difference between the target value and the actual value of the valve timing in a steady state, in which both of the target value and the actual valve timing are substantially unchanged. When the target value is forcibly changed in the advance direction, the advance-side hold duty steady-state deviation correction map shown in FIG. 29 is used. When the target value is forcibly changed in the retard direction, the retard-side hold duty steady-state deviation correction map shown in FIG. 30 is used.

In the above case, the hold duty may be alternatively corrected based on the steady-state deviation only when the steady-state deviation between the target value and the actual valve timing is equal to or greater than a predetermined value. In other words, when the steady-state deviation is less than the predetermined value, the steady-state deviation is small enough such that it is determined that the steady-state deviation is negligible. Accordingly, the correction of the hold duty based on the steady-state deviation is not executed. Thus, it is possible to avoid excessive execution of the correction of the hold duty, and thereby the load of the ECU 24 caused by executing the computations is effectively reduced.

In the setting process of the hold duty according to the present embodiment, the dead zone width learning process and the variable valve timing control are executed by the ECU 24 based on the corresponding routine shown in FIGS. 31, 32, 19, and 20. A process for each routine will be described below.

[Main Routine]

Figure 31:
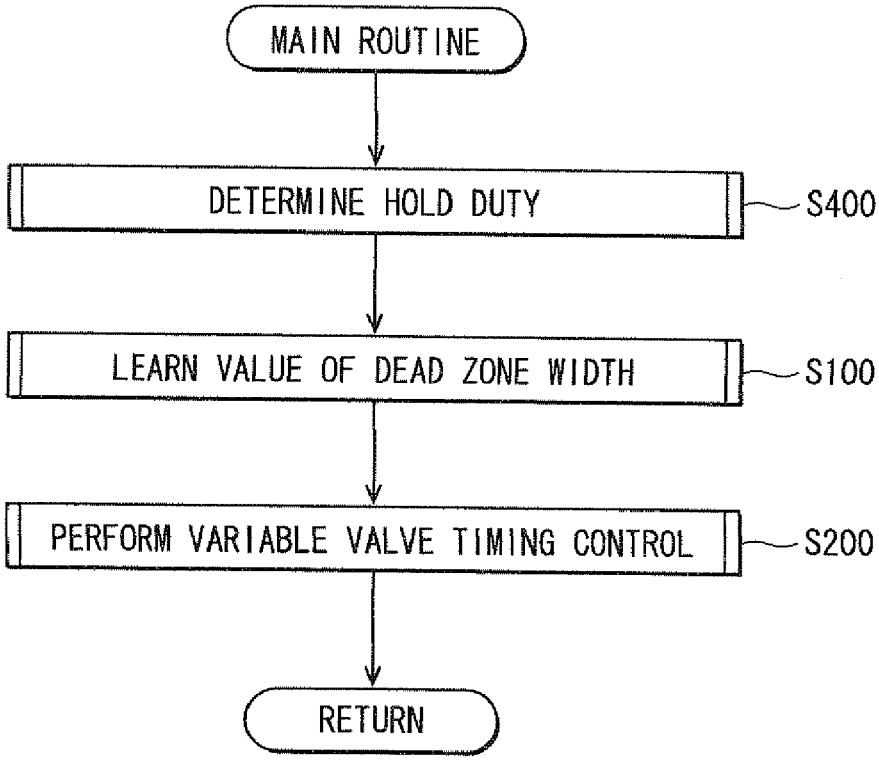
FIG. 31 is a flow chart for explaining a process of a main routine.
Figure 32:
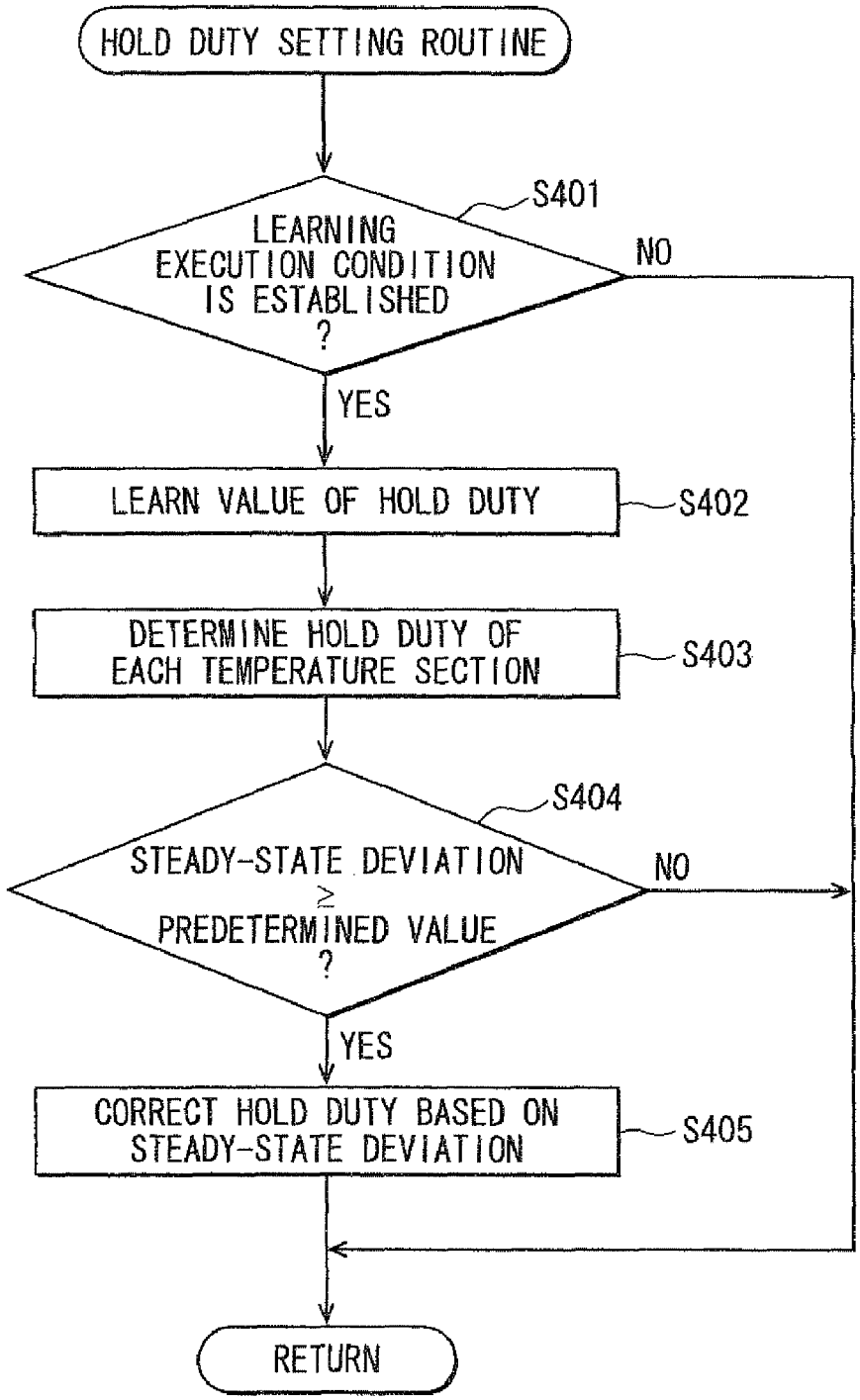
FIG. 32 is a flow chart for explaining a process of a hold duty setting routine.

The ECU 24 periodically executes a main routine shown in FIG. 31 during the ignition switch is on (during the power source of the ECU 24 is on). When the present routine is started, firstly, a hold duty setting routine shown in FIG. 32 is executed at step S400. In the hold duty setting routine, when the hold duty learning execution condition is established, a hold duty is learned at the predetermined temperature section including, for example, the oil temperature or coolant temperature after the warming up of the engine. The hold duty for each temperature section is set using one of the above methods based on the learned value of the hold duty of the predetermined temperature section and based on the hold duty standard characteristic data (the hold duty correction amount map of FIG. 24 or the hold duty standard value map of FIG. 26) retrieved from the ROM 41.

Then, control proceeds to step S100, where the dead zone width learning routine shown in FIG. 19 is executed to learn the dead zone width. Then, control proceeds to step S200, where the variable valve timing control routine shown in FIG. 20 is executed to determine the control duty using the feed-back correction amount, the hold duty, and the dead zone width learned value in accordance with the difference between the target value and the actual valve timing.

[Hold Duty Setting Routine]

The hold duty setting routine shown in FIG. 32 is a subroutine executed at step S400 of the main routine shown in FIG. 31 and serves as a "control means", also the variable valve timing control routine shown in FIG. 20 serves as a "control means". When the present routine is started, firstly, at step S401, it is determined whether a hold duty learning execution condition is established based on, for example, three conditions (1) to (3) as follows.

(1) The oil temperature detected by the oil temperature sensor 47 (or the coolant temperature detected by the coolant temperature sensor 46) is within the predetermined temperature section (for example, corresponding to the oil temperature after the warming-up of the engine).

(2) The operation is under a steady state, where both the target value and the actual valve timing are substantially unchanged.

(3) The self-diagnosis function (not shown) does not detect abnormality of the VCT control system.

When any one of the three conditions (1) to (3) is not satisfied, it is determined that the hold duty learning execution condition is not established, thereby the present routine is finished without executing the following process.

In contrast, when the three conditions (1) to (3) are all satisfied, it is determined that the hold duty learning execution condition is established, and thereby control proceeds to step S402, where a present control duty for the predetermined temperature section is learned as the hold duty. The process at step S402 serves as a "hold control amount learning means".

Then, control proceeds to step S403, where the hold duty for each temperature section is determined through any one of the above methods based on (a) the above hold duty learned value at the predetermined temperature section and (b) the hold duty standard characteristic data (the hold duty correction amount map of FIG. 24 or the hold duty standard value map of FIG. 26) retrieved from the ROM 41.

Then, control proceeds to step S404, where it is determined whether the steady-state deviation between the target value and the actual valve timing is equal to ore greater than the predetermined value. When the steady-state deviation is less than the predetermined value, it is determined that the steady-state deviation is substantially small such that the deviation does not cause any disadvantage. As a result, the correction of the hold duty based on the steady-state deviation is not executed, and then the present routine is finished.

In contrast, when it is determined at step S404 that the steady-state deviation is equal to or greater than the predetermined value, control proceeds to step S405, where a correction amount in accordance with the steady-state deviation is set by referring to the hold duty steady-state deviation correction map of FIG. 29 or FIG. 30 correspondingly to the actual drive direction of the valve timing.

[Dead Zone Width Learning Routine]

The dead zone width learning routine of FIG. 19 is a subroutine of the main routine shown in FIG. 31, and is executed at step S100. The dead zone width learning routine of FIG. 19 serves as a "dead zone width learning means". When the present routine is started, firstly, it is determined at step S101 whether the dead zone width learning execution condition is established or not based on, for example, the three conditions (1) to (3) described in the third and the fourth embodiments.

When any one of the above three conditions (1) to (3) is not satisfied, it is determined that the dead zone width learning execution condition is not established, and thereby the present routine is finished without executing the following process.

In contrast, when all of the three conditions (1) to (3) are satisfied, it is determined that the dead zone width learning execution condition is established, and thereby firstly, the learning operation for learning the dead zone width in the advance side is executed as follows. Firstly, at step S102, the target value (target valve timing) is forcibly changed stepwise in the advance direction by a predetermined crank angle (for example, 10 to 15° CA). Thus, the variable valve timing control routine shown in FIG. 20 sets the control duty based on the feed-back correction amount, the hold duty, and the dead zone width learned value in accordance with the difference between the target value and the actual valve timing such that the actual valve timing is driven in the advance direction to the target value set by the forcible change. Then, control proceeds to step S103, where the relative duty (difference between the control duty and the hold duty) caused by the target value, which is set by the forcible change in the advance direction, is integrated in order to update the integrated duty in the advance side (the integrated value of the relative duty). The explanation of similar steps similar to those in the third and fourth embodiments will be omitted below.

In the present embodiment, at step S108, after the dead zone width b2 in the advance side is learned, the dead zone width in the retard side is learned in the following manner. Firstly, at step S109, the target value (target valve timing) is forcibly changed stepwise in the retard direction by a predetermined crank angle (for example, 10 to 15° CA). Thus, the control duty is determined through the variable valve timing control routine shown in FIG. 20 based on the feed-back correction amount, the hold duty, and the dead zone width learned value in accordance with the difference between the target value and the actual valve timing such that the actual valve timing is driven in the retard direction toward the target value after the forcible change. Then, control proceeds to step S110, where the relative duty caused by the target value, which is set by the forcible change in the retard direction, is integrated in order to update the integrated duty in the retard side (the integrated value of the relative duty).

[Variable Valve Timing Control Routine]

The variable valve timing control routine shown in FIG. 20 is the subroutine of the main routine shown in FIG. 31 and is executed at step S200. The variable valve timing control routine shown in FIG. 20 serves as a control means. The variable valve timing control routine of the present embodiment is basically the same as the routine in the third and fourth embodiments. Thus, explanation of the variable valve timing control routine will be omitted unless there is different procedure in the present embodiment different from the procedure in the third and fourth embodiments.

In the present embodiment, at step S206, a hold duty of a temperature section that corresponds to the present oil temperature (or present coolant temperature) is retrieved from the hold duties for temperature sections set by the hold duty setting routine of the FIG. 32.

In the present embodiment, in the designing phase of the product or in the manufacturing phase of the product, the hold duty standard characteristic data (the hold duty correction amount map of FIG. 24 or the hold duty standard value map of FIG. 26) is stored in advance in the nonvolatile storage unit, such as the ROM 41 of the ECU 24. As above, the hold duty standard characteristic data defines the relation between (a) the hold duty and (b) the oil temperature or temperature, such as coolant temperature, that is correlated with the oil temperature. Then, the hold duty is learned when the temperature is within the predetermined temperature section (for example, temperature section that corresponds to oil temperature or coolant temperature after the engine is warmed up). Then, the hold duty of the other temperature section other than the predetermined temperature section is determined based on (a) the hold duty learned value learned for the predetermined temperature section and (b) the hold duty standard characteristic data retrieved from the ROM 41. Thus, it is possible to accurately determined the hold duty for each of the other temperature sections by learning the hold duty only for one predetermined temperature section, and then by using (a) the learned value of the hold duty of the predetermined temperature section and (b) the hold duty standard characteristic data retrieved from the ROM 41. In other words, it is not necessary to learn the hold duties for the other temperature sections in the present embodiment. Thus, it is possible to obtain the advantages of learning all the hold duties for all the temperature sections just by learning the hold duty of the selected temperature section. As a result, it is possible to achieve the accuracy of variable valve timing control for all the temperature sections.

Furthermore, in the present embodiment, the temperature section used for the learning operation for learning the hold duty is determined at a temperature section that corresponds to a temperature after the warming-up of the engine. The above setting is made because it is possible to more accurately learn the hold duty at the certain temperature section achievable by the warming up of the engine than learning the hold duty at a temperature lower than the above certain temperature section. As a result, it is possible to effectively accurately learn the hold duty.

Furthermore, in the present embodiment, because the steady-state deviation between the target value and the actual valve timing is caused by the deviation of the hold duty, the hold duty for each temperature section is corrected based on the steady-state deviation, and then the control duty is set based on the corrected hold duty. Thus, the accuracy of the hold duty for each temperature section is further improved.

Then, in the present embodiment, the dead zone width is learned after accurately setting the hold duty for each temperature section as above. As a result, it is possible to improved the accuracy in the learning operation for learning the dead zone width, and thereby it is possible to offset-correct the control duty accurately based on the accurate learned value of the dead zone width. As a result, it is possible to further improve the accuracy of the variable valve timing control.

Additional advantages and modifications will readily occur to those skilled in the art. The invention in its broader terms is therefore not limited to the specific details, representative apparatus, and illustrative examples shown and described.

What is claimed is:

1. A valve timing control apparatus for a valve timing adjustment mechanism that adjusts timing of opening and closing one of an intake valve and an exhaust valve of an internal combustion engine having an output shaft and a camshaft, the valve timing control apparatus comprising:

an output-side rotor that is rotatable synchronously with the output shaft;

a cam-side rotor that is rotatable synchronously with the camshaft that opens and closes the one of the intake valve and the exhaust valve;

a hydraulic pump that is configured to supply hydraulic oil such that one of the output-side and cam-side rotors rotates relative to the other one of the rotors;

a control device that outputs a drive command signal associated with rotation of the one of the rotors relative to the other one of the rotors;

a control valve that controls the speed of the rotation of the one of the rotors relative to the other one of the rotors by controlling supply of the hydraulic oil in accordance with the drive command signal outputted by the control device;

a storage device that prestores standard data indicating a predetermined relation for a reference product of the valve timing adjustment mechanism between a dead zone width and a parameter correlated with the dead zone width for each hydraulic oil temperature, wherein:

the dead zone width corresponds to a change amount of the drive command signal that is changed from a first value to a second value;

when the drive command signal is the first value, the rotors are in a hold state, where the speed of the rotation of the one of the rotors relative to the other one of the rotors is substantially zero such that a rotational position of the one of the rotors relative to the other one of the rotors is substantially maintained; and when the drive command signal is changed from the first value and becomes the second value, the speed of the rotation of the one of the rotors relative to the other one of the rotors starts changing sharply; and learning means for detecting and learning a value of the parameter of the dead zone width of the valve timing adjustment mechanism during the hold state by changing the drive command signal, wherein:

the control device computes the drive command signal based on the value learned by the learning means, the standard data, and hydraulic oil temperature.

2. The valve timing control apparatus according to claim 1, wherein:

the learning means detects and learns the value of the parameter of the dead zone width of the valve timing adjustment mechanism for each hydraulic oil temperature by changing the drive command signal for each hydraulic oil temperature during the hold state.

3. The valve timing control apparatus according to claim 1, wherein:

the standard data stored in the storage device includes a first standard data segment for an advance case, where the drive command signal is changed in an advance direction such that the one of the rotors rotates relative to the other one of the rotors in the advance direction;

the standard data stored in the storage device includes a second standard data segment for a retard case, where the drive command signal is changed in a retard direction such that the one of the rotors rotates relative to the other one of the rotors in the retard direction;

the learning means causes the control device to change the drive control signal in the advance direction in order to learn the value of the parameter of the dead zone width of the valve timing adjustment mechanism for the advance case; and the learning means causes the control device to change the drive control signal in the retard direction in order to learn the value of the parameter of the dead zone width of the valve timing adjustment mechanism for the retard case.

4. The valve timing control apparatus according to claim 1, wherein the learned value of the parameter is limited in a range defined by an upper limit value and a lower limit value.

5. The valve timing control apparatus according to claim 1, wherein:

the drive command signal indicates a duty value for controlling of an electric power supplied to the control valve; and the parameter indicates an integrated value of the duty value.

6. The valve timing control apparatus according to claim 1, wherein:

the control device computes the drive command signal in order to perform a feed-back control based on a difference between a target relative rotational position and an actual relative rotational position; and the control device offset-corrects the drive command signal based on the learned value of the parameter learned by the learning means.

7. A valve timing control arrangement comprising:

the valve timing control apparatus according to claim 1; and the valve timing adjustment mechanism.

8. A valve timing control apparatus for an internal combustion engine having an intake valve and an exhaust valve, the valve timing control apparatus comprising:

a variable valve mechanism that uses oil pressure as a drive source to change a valve opening-closing characteristic of at least one of the intake valve and the exhaust valve;

dead zone width learning means for executing a learning operation, in which the dead zone width learning means changes a control amount used for controlling the variable valve mechanism by changing a target value of the valve opening-closing characteristic from a first value to a second value in order to learn a value of one of a width of a dead zone and a dead zone width correlation parameter that is correlated with the dead zone width when the valve opening-closing characteristic is maintained at the first value, wherein:

the variable valve mechanism is limited from being controlled even when the control amount of the variable valve mechanism is changed within the dead zone;

the dead zone width learning means executes the learning operation when a predetermined dead zone width learning execution condition is established; and the dead zone width learning means learns the value of the one of the dead zone width and the dead zone width correlation parameter during a period before a predetermined learning time has elapsed since a time, at which the dead zone width learning means forcibly changes the target value; and control means for offset-correcting the control amount used for controlling the variable valve mechanism based on the learned value learned by the dead zone width learning means after the dead zone width learning means completes the learning operation, wherein the control means drives the variable valve mechanism based on the corrected control amount.

9. The valve timing control apparatus according to claim 8, wherein:

the predetermined learning time is equal to or greater than a first time period and is equal to or less than a second time period;

a valve opening-closing characteristic of an upper-limit product of the variable valve mechanism reaches the second value from the first value when the first time period has elapsed since the time of changing the target value;

a valve opening-closing characteristic of a lower-limit product of the variable valve mechanism reaches the second value from the first value when the second time period has elapsed since the time of changing the target value;

the upper-limit product has a highest responsivity among products of the variable valve mechanism; and the lower-limit product has a lowest responsivity among products of the variable valve mechanism.

10. The valve timing control apparatus according to claim 8, wherein:

the dead zone width correlation parameter is one of:

a change speed of the valve opening-closing characteristic of the variable valve mechanism;

a time integrated value of the valve opening-closing characteristic;

a change speed of a first difference between the target value of the valve opening-closing characteristic of the variable valve mechanism and an actual value of the valve opening-closing characteristic of the variable valve mechanism;

a time integrated value of the first difference;

a change speed of a second difference between the control amount for controlling the variable valve mechanism and a hold control for maintaining the valve opening-closing characteristic of the variable valve mechanism at the first value; and a time integrated value of the second difference.

11. The valve timing control apparatus according to claim 8, further comprising:

a nonvolatile storage unit that stores data of a dead zone width and a corresponding dead zone width correlation parameter of a responsivity reference product of the variable valve mechanism, wherein:

the dead zone width learning means computes a learning correction coefficient in accordance with a ratio of the learned value of the dead zone width correlation parameter of an actual-use product to a retrieved value of the dead zone width correlation parameter of the responsivity reference product, which is retrieved from the nonvolatile storage unit; and the dead zone width learning means corrects a retrieved value of the dead zone width of the responsivity reference product, which is retrieved from the nonvolatile storage unit, by the learning correction coefficient in order to obtain the dead zone width of the actual-use product.

12. The valve timing control apparatus according to claim 11, wherein:

the nonvolatile storage unit stores the dead zone width and the corresponding dead zone width correlation parameter of the responsivity reference product for each of a plurality of temperature sections, each of which corresponds to an oil temperature parameter, the oil temperature parameter corresponding to one of an oil temperature of the variable valve mechanism and a temperature that is correlated with the oil temperature;

the dead zone width learning means computes the learning correction coefficient in accordance with the ratio of the learned value of the dead zone width correlation parameter of the actual-use product to the retrieved value of the dead zone width correlation parameter of responsivity reference product, which is associated with one of the plurality of temperature sections that corresponds to a present oil temperature parameter; and the dead zone width learning means corrects the retrieved value of the dead zone width of the responsivity reference product, which is associated with the one of the plurality of temperature sections, by the learning correction coefficient in order to obtain the dead zone width of the actual-use product.

13. The valve timing control apparatus according to claim 8, wherein:

the valve opening-closing characteristic is valve timing;

the learning operation executed by the dead zone width learning means includes:

an advance-side learning operation, in which the dead zone width learning means forcibly changes the target value in an advance direction in order to learn the value of the one of the dead zone width and the dead zone width correlation parameter in an advance side; and a retard-side learning operation, in which the dead zone width learning means forcibly changes the target value in a retard direction in order to learn the value of the one of the dead zone width and the dead zone width correlation parameter in a retard side;

the control means offset-corrects the control amount of the variable valve mechanism based on the learned value of the one of the dead zone width and the dead zone width correlation parameter in the advance side when the target value is changed in the advance direction after both the advance-side and retard-side learning operations are completed; and the control means offset-corrects the control amount of the variable valve mechanism the learned value of the one of the dead zone width and the dead zone width correlation parameter in the retard side based on when the target value is changed in the retard direction after both the advance-side and retard-side learning operations are completed.

14. The valve timing control apparatus according to claim 8, wherein:

the dead zone width learning execution condition includes that a predetermined time has elapsed since a starting of the internal combustion engine; and the predetermined time causes oil pressure, which drives the variable valve mechanism, to become equal to or greater than a predetermined oil pressure required to disable a lock state of the variable valve mechanism.

15. The valve timing control apparatus according to claim 8, wherein the dead zone width learning means includes a unit that prohibits the learning operation when an accelerator pedal is pressed.

16. A valve timing control apparatus for an internal combustion engine having an intake valve and an exhaust valve, the valve timing control apparatus comprising:

a variable valve mechanism that uses oil pressure as a drive source to change a valve opening-closing characteristic of at least one of the intake and exhaust valves;

dead zone width learning means for executing a learning operation, in which the dead zone width learning means changes a control amount used for controlling the variable valve mechanism by changing a target value of the valve opening-closing characteristic from a first value to a second value in order to learn a value of a dead zone width correlation parameter that is correlated with a width of a dead zone when the valve opening-closing characteristic is maintained at the first value, wherein the variable valve mechanism is limited from being controlled even when the control amount of the variable valve mechanism is changed within the dead zone;

control means for driving the variable valve mechanism by offset correcting the control amount of the variable valve mechanism based on the learned value of the dead zone width correlation parameter after the learning operation by the dead zone width learning means is completed; and a temperature detecting unit that detects an oil temperature parameter that is associated with one of an oil temperature of the variable valve mechanism and a temperature correlated with the oil temperature, wherein:

the dead zone width learning means forcibly changes the target value in order to learn the value of the dead zone width correlation parameter when a predetermined dead zone width learning execution condition is established; and the dead zone width learning means changes one of a forcible change width of the target value at the beginning of the learning operation and a control gain during the learning operation in accordance with the oil temperature parameter detected by the temperature detecting unit, the forcible change width corresponding to a difference between the first value and the second value of the target value of the valve opening-closing characteristic.

17. The valve timing control apparatus according to claim 16, wherein:

the dead zone width learning means increases the one of the forcible change width of the target value at the beginning of the learning operation and the control gain during the learning operation as the oil temperature parameter detected by the temperature detecting unit decreases.

18. The valve timing control apparatus according to claim 16, wherein:

the dead zone width correlation parameter is one of:

a change speed of the valve opening-closing characteristic of the variable valve mechanism;

a time integrated value of the valve opening-closing characteristic;

a change speed of a first difference between the target value of the valve opening-closing characteristic of the variable valve mechanism and an actual value of the valve opening-closing characteristic of the variable valve mechanism;

a time integrated value of the first difference;

a change speed of a second difference between the control amount for controlling the variable valve mechanism and a hold control for maintaining the valve opening-closing characteristic of the variable valve mechanism at the first value; and a time integrated value of the second difference.

19. The valve timing control apparatus according to claim 16, further comprising:

a nonvolatile storage unit that stores data of a dead zone width and a corresponding dead zone width correlation parameter of a responsivity reference product of the variable valve mechanism, wherein:

the dead zone width learning means computes a learning correction coefficient in accordance with a ratio of the learned value of the dead zone width correlation parameter of an actual-use product to a retrieved value of the dead zone width correlation parameter of the responsivity reference product, which is retrieved from the nonvolatile storage unit; and the dead zone width learning means corrects a retrieved value of the dead zone width of the responsivity reference product, which is retrieved from the nonvolatile storage unit, by the learning correction coefficient in order to obtain the dead zone width of the actual-use product.

20. The valve timing control apparatus according to claim 19, wherein:

the nonvolatile storage unit stores the dead zone width and the corresponding dead zone width correlation parameter of the responsivity reference product for each of a plurality of temperature sections, each of which corresponds to the oil temperature parameter;

the dead zone width learning means computes the learning correction coefficient in accordance with the ratio of the learned value of the dead zone width correlation parameter of the actual-use product to the retrieved value of the dead zone width correlation parameter of responsivity reference product, which is associated with one of the plurality of temperature sections that corresponds to a present oil temperature parameter; and the dead zone width learning means corrects the retrieved value of the dead zone width of the responsivity reference product, which is associated with the one of the plurality of temperature sections, by the learning correction coefficient in order to obtain the dead zone width of the actual-use product.

21. The valve timing control apparatus according to claim 16, wherein:

the valve opening-closing characteristic is valve timing;

the learning operation executed by the dead zone width learning means includes:

an advance-side learning operation, in which the dead zone width learning means forcibly changes the target value in an advance direction in order to learn the value of the one of the dead zone width and the dead zone width correlation parameter in an advance side; and a retard-side learning operation, in which the dead zone width learning means forcibly changes the target value in a retard direction in order to learn the value of the one of the dead zone width and the dead zone width correlation parameter in a retard side;

the control means offset-corrects the control amount of the variable valve mechanism based on the learned value of the one of the dead zone width and the dead zone width correlation parameter in the advance side when the target value is changed in the advance direction after both the advance-side and retard-side learning operations are completed; and the control means offset-corrects the control amount of the variable valve mechanism the learned value of the one of the dead zone width and the dead zone width correlation parameter in the retard side based on when the target value is changed in the retard direction after both the advance-side and retard-side learning operations are completed.

22. The valve timing control apparatus according to claim 21, wherein:

the dead zone width learning means includes a unit that sets the one of the forcible change width of the target value at the beginning of the learning operation and the control gain during the learning operation independently in the advance-side learning operation and in the retard-side learning operation.

23. A valve timing control apparatus for an internal combustion engine having an intake valve and an exhaust valve, the valve timing control apparatus comprising:

a variable valve mechanism that adjusts valve timing of at least one of the intake valve and the exhaust valve based on oil pressure serving as a drive source;

an oil pressure control device that controls pressure of oil that drives the variable valve mechanism;

control means for controlling the oil pressure control device such that an actual value of the valve timing becomes a target value of the valve timing, wherein:

the control means computes a control amount used for controlling the oil pressure control device based on a feed-back correction amount, which is determined based on a difference between the target value and the actual value of the valve timing and based on a hold control amount, which is required to maintain the actual value of the valve timing under a constant state;

a temperature detecting unit that detects an oil temperature parameter that is one of an oil temperature and a temperature that is correlated with the oil temperature;

a nonvolatile storage unit that prestores hold control amount standard characteristic data that defines a relation between the oil temperature parameter and the hold control amount; and hold control amount learning means for learning a value of the hold control amount of a predetermined temperature section, wherein:

the control means determines the hold control amount of a temperature section corresponding to the oil temperature parameter based on the learned value of the hold control amount of the predetermined temperature section and based on a retrieved value of the hold control amount standard characteristic data, which is retrieved from the storage unit, in order to compute the control amount of the oil pressure control device.

24. The valve timing control apparatus according to claim 23, wherein:

the temperature section is one of a plurality of temperature sections;

the hold control amount standard characteristic data stored in the storage unit includes a temperature correction amount of each of the plurality of temperature sections, the temperature correction amount being based on the hold control amount of the predetermined temperature section;

the control means determines the hold control amount of each of the plurality of temperature sections by correcting the learned value of the hold control amount of the predetermined temperature section, which is learned by the hold control amount learning means, by using the temperature correction amount retrieved from the storage unit for each of the plurality of temperature sections; and the control means computes the control amount of the oil pressure control device based on the hold control amount of one of the plurality of temperature sections, to which the oil temperature parameter presently detected by the temperature detecting unit corresponds.

25. The valve timing control apparatus according to claim 23, wherein:

the temperature section is one of a plurality of temperature sections;

the hold control amount standard characteristic data stored in the storage unit includes a hold control amount standard value of each of the plurality of temperature sections, the control means determines a hold control correction amount based on a difference between the learned value of the hold control amount of the predetermined temperature section and a retrieved value of the hold control amount standard value of the predetermined temperature section, which is retrieved from the storage unit;

the control means determines the hold control amount of each of the plurality of temperature sections by correcting the hold control amount standard value of each of the plurality of temperature sections based on the hold control correction amount;

the control means computes the control amount of the oil pressure control device based on the hold control amount of one of the plurality of temperature sections, to which the oil temperature parameter presently detected by the temperature detecting unit corresponds.

26. The valve timing control apparatus according to claim 23, wherein:

the predetermined temperature section corresponds to a temperature section after warming up of the internal combustion engine.

27. The valve timing control apparatus according to claim 23, wherein:

the temperature section is one of a plurality of temperature sections;

the control means determines the hold control amount of each of the plurality of temperature sections based on the learned value of the hold control amount of the predetermined temperature section and the hold control amount standard characteristic data;

the control means corrects the hold control amount of each of the plurality of temperature sections based on a steady-state deviation between the target value and the actual value of the valve timing; and the control means computes the control amount of the oil pressure control device using the corrected hold control amount.

28. The valve timing control apparatus according to claim 27, wherein:

the control means corrects the hold control amount based on the steady-state deviation between the target value and the actual value of the valve timing when the steady-state deviation is equal to or greater than a predetermined value.

29. The valve timing control apparatus according to claim 23, further comprising:

the temperature section is one of a plurality of temperature sections;

a dead zone width learning means that executes a learning operation, in which the dead zone width learning means changes the control amount for controlling the oil pressure control device in order to learn a value of a width of a dead zone when the actual value of the valve timing is maintained under the constant state, wherein the oil pressure control device is limited from being controlled even when the control amount of the oil pressure control device is changed within the dead zone, wherein:

the dead zone width learning means learns the value of the dead zone width after the hold control amount learning means learns the value of the hold control amount of the predetermined temperature section and also after the control means determines the hold control amount of the other one of the plurality of temperature sections based on the learned value of the hold control amount and the hold control amount standard characteristic data;

the control means offset-corrects the control amount of the oil pressure control device, which is computed based on the feed-back correction amount and the hold control amount, in accordance with the learned value of the dead zone width.

* * * * *